United States Patent [19]

Okumura et al.

[11] Patent Number: 4,994,362

[45] Date of Patent: Feb. 19, 1991

[54] HIGH SILVER HALIDE CHLORIDE CONTENT COLOR PHOTOGRAPHIC LIGHT-SENSITIVE MATERIALS INCLUDING CYAN COUPLERS AND NITROGEN-CONTAINING HETEROCYCLIC MERCAPTO COMPOUNDS

[75] Inventor: Mitsuhiro Okumura, Hino, Shun Takada, Odawara, both of Japan

[73] Assignee: Konica Corporation, Tokyo, Japan

[21] Appl. No.: 282,385

[22] Filed: Dec. 9, 1988

[30] Foreign Application Priority Data

Dec. 15, 1987 [JP] Japan ..... 62-316995

[51] Int. Cl.[5] ..... G03C 1/34; G03C 7/38

[52] U.S. Cl. ..... 430/558; 430/384; 430/385; 430/611; 430/567

[58] Field of Search ..... 430/558, 384, 385, 611, 430/567

[56] References Cited

U.S. PATENT DOCUMENTS

| | | | |
|---|---|---|---|
| 4,818,672 | 4/1989 | Masukawa et al. | 430/558 |
| 4,839,263 | 6/1989 | Miyoshi et al. | 430/385 |
| 4,839,270 | 6/1989 | Kojima et al. | 430/611 |

FOREIGN PATENT DOCUMENTS

| | | | |
|---|---|---|---|
| 137271 | 4/1985 | European Pat. Off. . | |
| 246624 | 11/1987 | European Pat. Off. . | |
| 249453 | 12/1987 | European Pat. Off. . | |
| 2948937 | 7/1980 | Fed. Rep. of Germany . | |
| 2253142 | 11/1987 | Japan | 430/611 |
| 3046445 | 2/1988 | Japan | 430/611 |
| 1545507 | 5/1979 | United Kingdom . | |

OTHER PUBLICATIONS

Patent Abstracts of Japan, vol. 11, No. 253 (P-606) [2700]; 8/15/87, JPA 62-59444; 3/16/87.

*Primary Examiner*—Richard L. Schilling
*Assistant Examiner*—Lee C. Wright
*Attorney, Agent, or Firm*—Jordan B. Bierman

[57] ABSTRACT

A silver halide color photographic light sensitive material and a image forming method using the photographic material. The photographic material comprises a support having thereon a silver halide emulsion layer containing silver halide grains having a silver chloride content of not less than 90 mol %, a cyan coupler represented by the following formula C-1 and a nitrogen-containing hetero-cyclic mercapto compound.

Formula C-1

The photographic material is developed with a color developer substantially not containing benzyl alcohol for a time not more than 2 minutes 30 seconds. An color image having preferable light-absorption characteristics and a high maximum density is obtained. The photographic material is also excellent in storage stability.

30 Claims, No Drawings

HIGH SILVER HALIDE CHLORIDE CONTENT COLOR PHOTOGRAPHIC LIGHT-SENSITIVE MATERIALS INCLUDING CYAN COUPLERS AND NITROGEN-CONTAINING HETEROCYCLIC MERCAPTO COMPOUNDS

FIELD OF THE INVENTION

This invention relates to a silver halide color photographic light-sensitive material and, more particularly, to a silver halide color photographic light-sensitive material which is excellent in rapid processing compatibility, excellent in the spectral absorption characteristics of dye produced, capable of obtaining a high maximum density. low in fogginess and excellent in the stability of a raw product on standing.

BACKGROUND OF THE INVENTION

In recent years, a silver halide photographic light-sensitive material has been desired to have the characteristics such as a rapid processability, a high image quality, an excellent processing stability, a low cost, and so forth. Among those light-sensitive materials, a rapidly processable silver halide photographic light-sensitive material has been demanded in particular.

As one of the methods for obtaining such a light-sensitive material, it has been known that a color processing is made more rapid by making use of such a silver halide emulsion as that of silver chloride or silver chlorobromide which has a substantially high silver chloride content. For example, the technologies applicable to the above-mentioned method are described in U.S. Pat. Nos. 4,183,756 and 4,225,666; Japanese Patent Publication Open to Public Inspection (hereinafter referred to as Japanese Patent O.P.I. Publication) Nos. 55-26589, 58-91444, 58-95339, 58-94340, 58-95736, 58-106538, 58-107532, 58-107533, 58-108533 and 58-125612; and So forth.

Meanwhile, in a silver halide color photographic light-sensitive material, a light-sensitive silver halide emulsion and a coupler so-called dye-forming coupler capable of forming a dye upon reaction with an oxidized aromatic primary amine developing agent are generally used. Among those couplers, phenol or naphthol-type coupler has popularly been used so far in a cyan coupler, of which are described in, for example, U.S. Pat. Nos. 2,369,929 and 2,474,293. The cyan dye images obtained by making use of phenol- or naphthol-type coupler have had serious color reproduction problems raised by having an unsatisfactory sharp-cut spectral absorption in the short wavelength region of the cyan dye and by having an unnecessary absorption in the green spectral region thereof. For the purpose of solving the above-mentioned problems, an unnecessary absorption correction has so far been tried on negative light-sensitive materials by means of masking or the like. However, such a correction has not been preferable, because the sensitivity of the light-sensitive material has been lowered. While, in the case of reversal type light-sensitive materials or printing papers, there has been no measure for the correction. It has been the present situations where a color reproducibility has been affected considerably.

Taking the above-mentioned situations into consideration, imidazole type cyan couplers each having a novel structure have been proposed in, for example, Japanese patent application Nos. 61-138,868, 61-38,869 and 61-261,488, and so forth. Those cyan couplers are excellent in the spectral absorption characteristics of their cyan dyes formed. To be more concrete, they have excellent characteristics such as a sharp-cut spectral absorption in the short wavelength region, a few unnecessary absorption in both green and blue regions, a high maximum density obtained by a high absorption coefficient of the cyan dye, and so forth.

However, when combining the above-mentioned silver chloride emulsion or a silver chlorobromide emulsion having a high silver chloride content and an imidazole type cyan coupler, for the purpose of preparing a rapid processable light-sensitive material, it was found from the studies made by the present inventors that fog was seriously increased and photographic characteristics of a raw sample were liable to be varied during the storage of the sample on standing. It has, therefore, been difficult to prepare a rapid processing type photographic light-sensitive material containing a cyan coupler capable of displaying excellent characteristics.

SUMMARY OF THE INVENTION

It is one of the objects of the invention to provide a silver halide color photographic light-sensitive material which is excellent in rapid processability, excellent in the spectral absorption characteristics of a dye formed, capable of obtaining a high maximum density, low in fogginess and excellent in stability of raw products on standing.

The objects of the invention can be achieved with a silver halide color photographic light-sensitive material comprising a support having thereon silver halide emulsion layer, wherein said silver halide emulsion layer contains silver halide grains having a silver chloride content of not less than 90 mol %, a cyan coupler represented by the following formula C-1 and a nitrogen-containing heterocyclic compound.

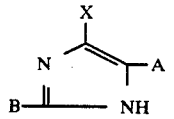

Formula C-1 wherein A and B each represent an organic group combined with the imidazole ring through a carbon atom, nitrogen atom, oxygen atom or a sulfur atom thereof; and X represents a hydrogen atom or a group capable of being split off upon reaction with the oxidized product of a color developing agent.

Now, the invention will be detailed further.

In the silver halide color photographic light-sensitive materials of the invention, at least one silver halide emulsion layer contains silver halide grains. Such silver halide grains are highly chloride-containing silver halide grains each having a high chloride content of not less than 90 mol %. The silver halide grains capable of preferably displaying the effects of the invention contain silver chloride in an amount within the range of from 99.0 mol % to 99.9 mol %. Within the range, the effects of the invention and a rapid processability can be satisfied at the same time.

It is preferable that the silver halide grains used in the the light-sensitive materials of the invention contain silver chloride in a proportion of not less than 90 mol %, silver bromide not more than 10 mol % and silver iodide not more than 0.5mol %, respectively. It is more preferable that the grains are comprised of silver chlorobromide having a silver bromide content of from 0.1 to 1 mol %.

The silver halide grains relating to the invention may be used independently or in combination. Those grains may also be used upon mixing with any other silver halide grains having different compositions. Those grains may further be used upon mixing with silver halide grains having a silver chloride content of not more than 90 mol %.

In a silver halide emulsion layer containing silver halide grains of the invention having a silver chloride content of not less than 90 mol %, the proportion of the silver halide grains having a silver chloride content of not less than 90 mol % to the total silver halide grains contained in the emulsion layer is not less than 60% by weight and more preferably not less than 80% by weight.

The compositions of the above-mentioned silver halide grains of the invention may be either uniform all through from the inside to the outside or different in the grain compositions between the inside and the outside. When the grain compositions are different between the inside and the outside, the compositions between the both sides may be varied continuously or discontinuously.

There is no special limitation to the sizes of the above-mentioned silver halide grains. However, taking the rapid processability and other photographic characteristics such as sensitivity and so forth into consideration, the grain sizes should be within the range of, preferably, from 0.2 to 1.6μm and, more preferably, from 0.25 to 1.2 μm. Such grain sizes may be measured in various methods generally used in the technical fields concerned.

Typical examples of the above-mentioned methods are described in R. P. Loveland, 'A.S.T.M. Symposium on Light Microscopy', 1955, pp. 94–122, or, in James and Mees, 'The Theory of Photographic Process', 3rd Ed., Macmillan Co., 1966, Chap. 2.

The above-mentioned grain size may be measured by making use of the projective area of or approximate diametral value of the grain. When grains are substantially in the uniform shape, the considerably accurate grain-size distribution thereof may be expressed in terms of the diameter or projective area.

The grain-size distribution of the silver halide grains of the invention may be either of the polydisperse type or of the monodisperse type. A preferable grain-size distribution is of monodisperse type silver halide grains having a grainsize variation coefficient of not more than 0.22 and, more preferably, not more than 0.15.

The above-mentioned grain-size variation coefficient is a coefficient designating the spread size of a grain-size distribution, and it is defined by the following formulas:

$$\text{Variation coefficient } (S/r) = \frac{\text{Standard deviation of grain-size distribution}}{\text{Average grain-size}}$$

$$\text{Standard deviation of grain-size distribution } (S) = \sqrt{\frac{\Sigma (r - ri)^2 ni}{\Sigma ni}}$$

$$\text{Average grain-size } (r) = \frac{\Sigma niri}{\Sigma ni}$$

wherein ri represents a grain-size of individual grains, and ni represents the number of individual grains. The term, 'grain-size', stated herein, means the diameter of a grain in the case of globular shaped silver halide grains, or the diameter of a circular image having the same area as that of the projective image of a grain in the case that silver halide grains are in the cubic or other shapes than the globular shape.

Silver halide grains relating to the invention may be prepared in any of the processes such as an acidic, neutral or ammoniacal process. Such grains may be grown either at a time or after seed grains are prepared. It is also allowed that a process for preparing seed grains and a process for growing them are either the same with or the different from each other.

The methods for reacting a soluble silver salt with a soluble halide may include any of normal precipitation methods, reverse precipitation methods, double-jet precipitation methods, the combinations thereof, and so forth. It is, however, preferred that grains are prepared in any of the double-jet precipitation methods. It is also allowed to use a pAg-controlled double-jet precipitation method, that is one of the double-jet precipitation methods, described in, for example, Japanese Patent O.P.I. Publication No. 54-48521 (1979) and so forth.

If further required, it is allowed to use such a silver halide solvent as thioether or the like. It is further allowed to add such a compound as a mercapto group-containing compound, a nitrogen-containing heterocyclic compound or a sensitizing dye, when producing silver halide grains or after completing the grain production.

Silver halide grains relating to the invention can be used in any shapes. Cubic grains each having {100} faces as their crystal faces may be given as one of the preferable examples thereof. It is also allowed to use grains in the shape of octahedron, tetrahedron, dodecahedron or the like and, besides, the grains having twinned crystal faces.

Silver halide grains relating to the invention may be used either in one and the same shape or in the mixture of various shapes.

In the course of producing and/or growing silver halide grains relating to the invention, metal ions may be added and contained inside the grains and/or the grain surfaces by making use of a cadmium salt, zinc salt, lead salt, thallium salt, iridium salt or the complex salts thereof, rhodium salt or the complex salts thereof, or iron salt or the complex salts thereof. It is also allowed to provide a reduction sensitizing nucleus to the grains and/or the grain surfaces by putting the grains in a suitable reducible atmosphere.

After the silver halide grains are grown up, unnecessary soluble salts may be removed from an emulsion containing silver halide grains of the invention (hereinafter called the emulsion of the invention) or may remain contained therein as they are. The salts may be removed in the method described in, for example, Research Disclosure, NO. 17643.

The preferable silver halide grains of the invention are capable of forming a latent image mainly on the grain surfaces. However, those capable of forming a latent image thereinside may also be used.

Imidazole type cyan couplers relating to the invention may be represented by the following formula C-I.

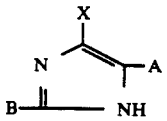

Formula C-I wherein A and B each represent an organic group capable of linking to an imidazole ring through a carbon, nitrogen, oxygen or sulfur atom; and X represents a hydrogen atom or a group capable of splitting off upon reaction with the oxidized product of a color developing agent.

The organic groups capable of linking to an imidazole ring through a carbon atom include, for example; alkyl groups such as a group of methyl, i-propyl, t-butyl, trifluoromethyl, benzyl, 3-(4-aminophenyl)propyl, allyl, 2-dodecyloxyethyl, 3-phenoxypropyl, 2-hexylsulfonylethyl, 3-[4-(4-dodecyloxybenzene)-sulfonamidophenyl]propyl, 1-methyl-2-[(2-octyloxy-5-t-octylphenyl)sulfonamidophenyl]ethyl, 1-methyl-2-[(2-octyloxy-5-(2-octyloxy-5-t-octylphenylsulfonamido)-phenylsulfonamido]ethyl, 2-(2-octyloxy-5-(2-octyloxy-5-t-octylphenylsulfonamido)-phenylsulfonamido]ethyl and so forth: aryl groups such as phenyl, naphthyl, 2,4-dichlorophenyl, 2-hydroxy-5-methylphenyl, 2-acetamidophenyl, 2-methanesulfonamidophenyl, 2-butanamidophenyl, 2-(N,N-dimethylsulfamoylamino)-phenyl, 2-(4-dodecyloxybenzenesulfonamido)phenyl, 2-[2-(2,4-di-t-amylphenoxy)hexanamido]phenyl, 2-(2-octyloxy-5-t-octylphenylsulfonamido)phenyl, 4-carbamoylphenyl, 4-cyanophenyl, 4-carboxyphenyl, 4-ethoxycarbonylphenyl, or the like; heterocyclic groups such as a group of 4-pyridyl, 2-benzoimadolyl or the like; cyano groups; carboxyl groups; acyl groups; carbamoyl groups; alkoxycarbonyl groups: aryloxycarbonyl groups; and so forth.

The organic groups capable of linking to an imidazole ring through a nitrogen atom include, for example; acylamino groups such as a group of acetamido, benzamido, 2,4-di-t-amylphenoxyacetamido, 2,4-dichlorobenzamido or the like; alkoxycarbonylamino groups such as a group of methoxycarbonylamino, propoxycarbonylamino, t-butoxycarbonylamino or the like; aryloxycarbonylamino groups such as a phenoxycarbonylamino group: sulfonamido groups such as a group of methanesulfonamido, octanesulfonamido, benzenesulfonamido, 4-dodecyloxybenzenesulfonamido or the like; anilino groups such as a group of phenylamino, 2-chloranilino, 2-chloro-4-tetradecanamidanilino or the like; ureido groups such as a group of N-methylureido, N-butylureido, N-phenylureido, N,N-dibutylureido or the like; sulfamoylamino groups such as a group of N,N-diethylsulfamoylamino, N-phenylsulfamoylamino or the like; amino groups such as a group of non-substituted amino, N-methylamino, N,N-diethylamino or the like: heterocyclic groups such as a group of 3,5-dimethyl-1-pyrazolyl, 2,6-dimethylmorpholino and so forth.

The organic groups capable of linking to an imidazole ring through an oxygen atom include for example; alkoxy groups such as a group of methoxy, ethoxy, i-propoxy, butoxy, 2,2,2-trifluoroethoxy, 3,3,3-trifluoropropoxy, 2-chloroethoxy, 2-cyanoethoxy, 2-butanesulfonylethoxy or the like: aryloxy groups such as a group of phenoxy, 4-methoxyphenoxy, 2,4-dichlorophenoxy, 4-(2-ethylhexaneamido)phenoxy or the like: silyloxy groups such as a group of trimethylsilyloxy, dimethylphenylsilyloxy, dimethyl-t-butylsilyloxy or the like; heterocyclic-oxy groups such as a group of tetrahydropyranyloxy, 3-pyridyloxy, 2-(1,3-benzoimidazolyl-)oxy or the like.

The organic groups capable of linking to an imidazole ring through a sulfur atom include for example; alkylthio groups such as a group of methylthio, ethylthio, butylthio, 3-[4-(4-dodecyloxybenzene)sulfonamidophenyl]propylthio, 4-(2-butoxy-5-t-octylphenylsulfonamido)benzylthio, or the like; arylthio groups such as a group of phenylthio, 2-naphthylthio, 2,5-dichlorophenylthio, 4-dodecylphenylthio, 2-butoxy-5-t-octylphenylthio, or the like; heterocyclic thio groups such as a group of 2-pyridylthio, 2-(1,3-benzoxazolyl)-thio, 1-hexadecyl-1,2,3,4-tetrazolyl-5-thio, 1-(3-N-octadecylcarbamoyl)phenyl-1,2,3,4-tetrazolyl-5-thio, or the like.

In Formula C-I, at least one of A and B should preferably be an aryl group.

X representing a group capable of splitting off upon reaction with the oxidized product of a color developing agent include, for example; halogen atoms such as an atom of chlorine, bromine, fluoriine or the like; and a group of hydroxyl, alkoxy, aryloxy, heterocyclic oxy, acyloxy, sulfonyloxy, alkoxycarbonyloxy, aryloxycarbonyl, alkyloxalyloxy, alkoxyoxalyloxy, alkylthio, mercapto, arylthio, heterocyclic-thio, alkoxythiocarbonylthio, acylamino, substituted amino, a nitrogen-containing heterocyclic group coupled with a nitrogen atom, sulfonamido, alkyloxycarbonylamino, aryloxycarbonylamino, carboxyl or the like. Among them, halogen atoms are preferable and chlorine atom is more preferable.

Among the compounds represented by Formula C-I, the typical ones may be represented by the following formulas C-II, C-III and C-IV.

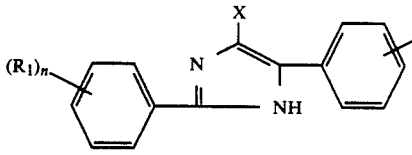

Formula C-II

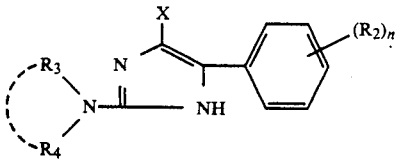

Formula C-III

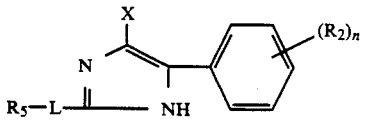

Formula C-IV

In Formulas C-II through C-IV, $R_1$, $R_2$, $R_3$, $R_4$ and $R_5$ each represent a Substituent; L represents an oxygen or sulfur atom; n is an integer of 0 to 5; and X is synonymous with X denoted in the aforegiven Formula C-I.

Next, the compounds represented by Formula C-II will be described in further details. In Formula C-II, the substituents represented by $R_1$ and $R_2$ shall not specially be limitative. They include, for example, a halogen atom or a group of cyano, nitro, carboxy, alkyl, alkoxy, carbamoyl, sulfamoyl, acyl, acyloxy, alkoxycarbonyl, —NHCOR$_6$, —NHSO2R$_6$,

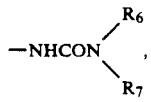

—NHCOOR$_6$, —NHSO$_2$R$_6$,

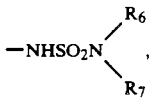

or the like, wherein R$_6$ and R$_7$ are each an alkyl group or an aryl group.

The alkyl groups represented by R$_1$ and R$_2$ include. preferably, a straight-chained or branched alkyl group having 1 to 22 carbon atoms, SuCh as a group of methyl, ethyl, butyl, dodecyl or the like. These alkyl groups also include such a cycloalkyl group as a cyclohexyl group, and they may further be substituted. The preferable substituents include, for example, a halogen atom, a group of hydroxy, carboxy, cyano or sulfo, an alkoxy group having 1 to 22 carbon atoms, or the like.

The preferable alkoxy groups include, for example, a straight-chained or branched alkoxy group having 1 to 22 carbon atoms, such as a group of methoxy, ethoxy, i-propyloxy, octyloxy, dodecyloxy or the like.

The carbamoyl groups include, for example, non-substituted alkylcarbamoyl groups such as a group of ethylcarbamoyl and dodecylcarbamoyl, substituted alkylcarbamoyl groups such as a group of diethylcarbamoyl, butyloxypropylcarbamoyl, dodecyloxypropylcarbamoyl or the like.

Similar to the above, the sulfamoyl groups include, for example, non-substituted alkylsulfamoyl groups such as a group of ethylsulfamoyl, diethylsulfamoyl, dodecylsulfamoyl or the like, and substituted alkylsulfamoyl groups such as a group of dodecyloxypropylsulfamoyl or the like.

The arylcarbamoyl groups include, for example, a phenylcarbamoyl group and a substituted phenylcarbamoyl group; and the arylsulfamoyl groups include phenylsulfamoyl groups and variously substituted phenylsulfamoyl groups, for example.

Besides the above, there also include acyl groups such as a group of acetyl, benzoyl, butanesulfonyl, benzene-sulfonyl or the like; acyloxy groups such as a group of acetoxy, lauroyloxy, butanesulfonyloxy or the like: and alkoxycarbonyl groups such as a group of ethoxycarbonyl, i-propyloxycarbonyl, 2-ethyl-hexyloxycarbonyl or the like.

—NHCOR$_6$ groups represent alkylamido groups having 1 to 22 carbon atoms. Typical examples of non-substituted alkylamido groups include a group of acetoamido, butaneamido, laurylamido, stearylamido or the like and, besides, an alicyclic type amido groups such as a cyclohexanecarbonamido group, those having a branched structure such as 2-ethylhexane amido group, and those containing an unsaturated bond.

The substituted alkylamido groups include, for example; halogen-substituted alkylamido groups such as a group of monochloroacetoamido, trichloroacetoamido, perfluorobutaneamido or the like; phenoxy-substituted alkylamido groups such as a group of m-pentadecylphenoxyacetoamido, α-(2,4-di-tamylphenoxy)pentaneamido, α-(2,4-di-t-acylphenoxy)acetoamido or o-chlorophenoxymyristic acid amido; or the like.

—NHCOR$_6$ group also represents arylamido groups which typically include non-substituted arylamido groups such as a group of benzamido, naphthoamido or the like. Substituted arylamido groups include, typically, alkyl-substituted benzamido groups such as a group of p-t-butylbenzamido, p-methylbenzamido or the like, alkoxy-substituted benzamido groups such as a group of p-methoxybenzamido, o-dodecyloxybenzamido or the like, amide-substituted benzamido groups such as a group of p-acetamidobenzamido, m-lauroylamidobenzamido, m-(2,4-di-t-amylphenoxyacetamido)benzamido or the like, sulfonamide-substituted benzamido groups such as a group of o-hexadecansulfonamidobenzamido, p-butanesulfonamidobenzamido or the like.

—NHCOOR$_6$ groups represent substituted or non-substituted alkoxycarbonylamino groups having 1 to 22 carbon atoms. They include typically a group of ethoxycarbonylamino, i-propoxycarbonylamino, octyloxycarbonylamino, decyloxycarbonyl, methoxyethoxycarbonylamino or the like. The —NHCOOR$_6$ groups also represent aryloxycarbonyl groups including typically a phenoxycarbonyl group.

The

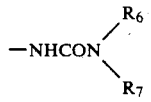

groups represent dialkylcarbamoylamino groups which include typically a group of dimethylcarbamoylamino, diethylcarbamoylamino or the like.

The —NHSO$_2$R$_6$ groups represent alkylsulfonamido or arylsulfonamido groups.

The alkylsulfonamido groups include, for example; non-substituted alkylsulfonamido groups having 1 to 22 carbon atoms, such as a methanesulfonamido, butanesulfonamido or dodecanesulfonamido group; substituted alkylsulfonamido groups such as a benzylsulfonamido group; or the like.

The arylsulfonamido groups include, for example, non-substituted arylsulfonamido groups such as a group of benzenesulfonamido, naphthalenesulfonamido or the like; alkyl-substituted benzenesulfonamido groups such as a group of p-toluenesulfonamido, 2,4,6-trimethylbenzenesulfonamido, p-dodecylbenzenesulfonamido or the like; and alkoxy-substituted benzenesulfonamido groups such as a group of p-dodecyloxybenzenesulfonamido, butyloxybenzenesulfonamido or the like.

The

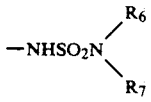

groups represent sulfamoylmino groups.

Typical examples thereof include, preferably, dialkylsulfamoylamino groups such as a group of dimethylsulfamoylamino, dibutylsulfamoylamino or the like.

Among the compounds represented by Formula C-II, those represented by the following Formulas C-V and C-VI may be given as the examples of preferable compounds.

Formula C-V

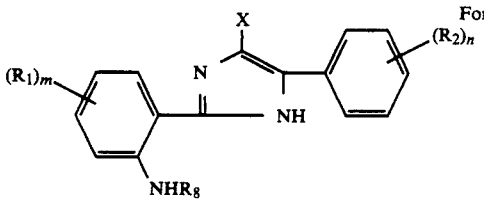

Formula C-VI

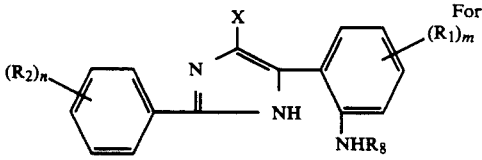

In the above-given Formulas C-V and C-VI, $R_1$, $R_2$, X and n are synonymous with $R_1$, $R_2$, X and n each denoted in the foregoing Formula C-II, respectively: m is an integer of 0 to 4; and $R_8$ represents a group of alkyl, aryl, —$COR_6$, —$COOR_6$, —$SO_2R_6$,

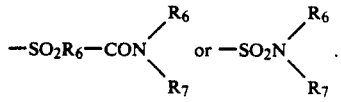

The alkyl groups represented by $R_8$ include, preferably, straight-chained or branched alkyl groups having 1 to 32 carbon atoms, as well as cycloalkyl groups such as a cyclohexyl group. The alkyl groups may also be substituted. The preferable substituents include, typically, a halogen atom, a group of hydroxyl, carboxyl, cyano or sulfo, an alkoxy group having 1 to 22 carbon atoms, and so forth.

The aryl groups represented by $R_8$ include, preferably, a phenyl group which may also be substituted with a group of nitro, amido, sulfonamido or the like.

When —$NHR_8$ is represented by a group of —NH-$COR_6$, —$NHCOOR_6$,

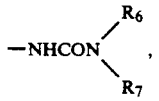

—$NHSO_2R_6$ or

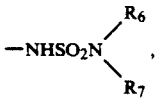

and, $R_6$ and $R_7$ are synonymous with $R_6$ and $R_7$ each represent an alkyl group or an aryl group such as denoted in the foregoing Formula C-II.

In the foregoing Formulas C-V and C-VI, more preferable compounds of those represented thereby include, for example, the compounds represented by the following Formula C-VII in which one of $R_2$s represents a group of —$NHR_9$ being present in the ortho position with respect to the imidazole ring.

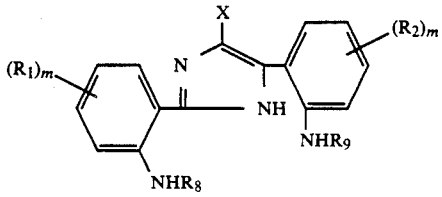

wherein $R_1$, $R_2$, $R_8$, X and m are synonymous with those denoted in the foregoing Formula C-V, respectively, and $R_9$ is also synonymous with $R_8$. Owing to the presence of the —$NHR_9$ group, not only the absorption of color forming dyes but also the heat resistance thereof can be more excellent.

Next, the compounds represented by Formula C-III will be further detailed. In Formula C-III, $R_2$, X and n are synonymous with those denoted in the foregoing Formula C-II, respectively, and $R_3$ and $R_4$ each represent a hydrogen atom, an alkyl group or an aryl group, provided that $R_3$ and $R_4$ may be bonded together so as to complete a heterocyclic ring.

The alkyl or aryl groups represented by $R_3$ or $R_4$ include, more concretely, those given in the foregoing Formulas C-V and C-VI.

The foregoing heterocyclic rings completed by bonding $R_3$ and $R_4$ together should preferably be 5- or 6-membered rings. Those may also have substituents. Further, those rings and carbon ring may be condensed together.

In Formula C-III, more preferable compounds among those represented thereby include, for example, the compounds represented by the following Formula C-VIII in which one of $R_2$s represents a group of —$NHR_8$ being present in the ortho position with respect to the imidazole ring.

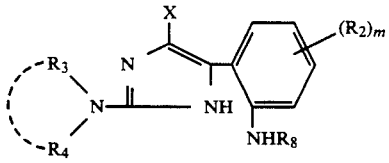

wherein $R_2$, $R_3$, $R_4$ and X are synonymous with those denoted in the foregoing Formula C-III and, $R_8$ and m are synonymous with those denoted in the foregoing Formulas C-V and C-VI, respectively.

Next, the compounds represented by Formula C-IV will further be detailed. In Formula C-IV, $R_2$, X and n are synonymous with those denoted in Formula C-II, respectively, and $R_5$ represents a hydrogen atom, an alkyl group, an aryl group or a heterocyclic group.

The alkyl and aryl groups represented by $R_5$ include, more concretely, those given in Formulas C-V and C-VI.

The heterocyclic groups represented by $R_5$ include, preferably, those having a 5- or 6-membered ring. To be more concrete, they include, for example, a group of 2-pyridyl, 4-pyridyl, 2-benzoimidazolyl, 3,5-dimethyl-1-pyrazolyl, 4-morpholino, 3,5-dimethyl-2-furyl, 2,4-dimethyl-5-thiazolyl, 2-acetamido-4-methyl-5-pyrimidinyl or the like.

In Formula C-IV, more preferable compounds among those represented thereby include, for example, the compounds represented by the following Formula C-IX in which one of $R_2$s represents a group of —$NHR_8$ being present in the ortho position with respect to the imidazole ring.

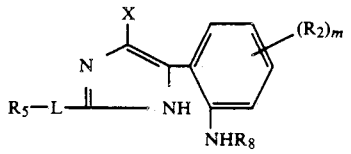

wherein $R_2$, $R_5$, L and X are synonymous with those denoted in the foregoing Formula C-IV and, $R_8$ and m are synonymous with those denoted in the foregoing Formulas C-V and C-VI, respectively.

Now, the typical examples of the cyan couplers applicable to the invention will be given below. It is, however, to be understood that the invention shall not be limited thereto.

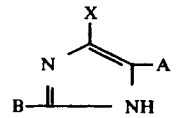
| Compound | X | A | B |
|---|---|---|---|
| 1 | H | 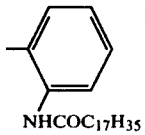  | 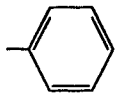 |
| 2 | —Cl | 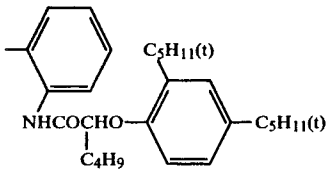  | 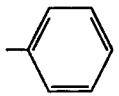 |
| 3 | H | 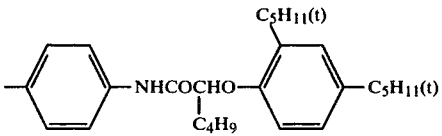  | 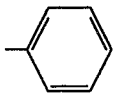 |
| 4 | —Cl | 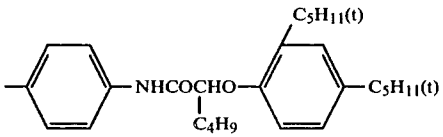  | 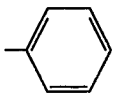 |
| 5 | H | 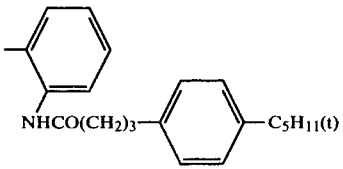  | 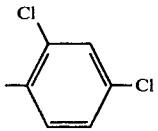  |

-continued
| | | | |
|---|---|---|---|
| 6 | 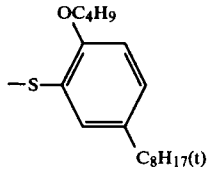 | 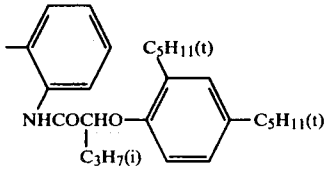 | 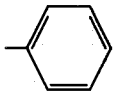 |
| 7 | —Cl | 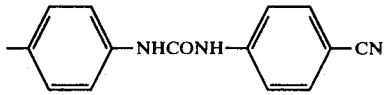 | 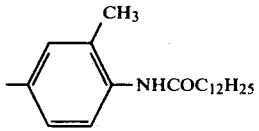 |
| 8 | —Cl | 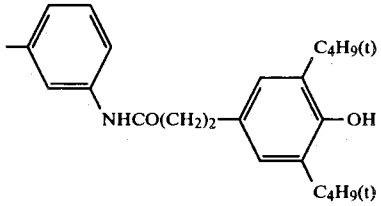 | 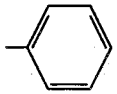 |
| 9 | —Cl | 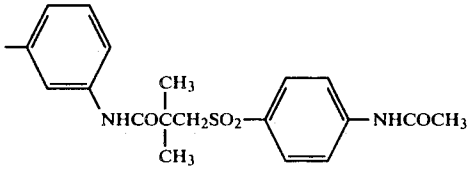 | 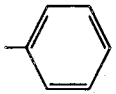 |
| 10 | —Cl | 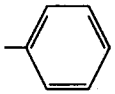 | 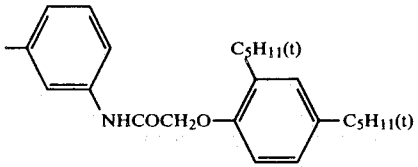 |
| 11 | —Cl | 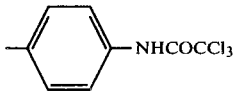 | 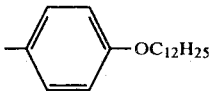 |

-continued
| | | | |
|---|---|---|---|
| 12 | H | 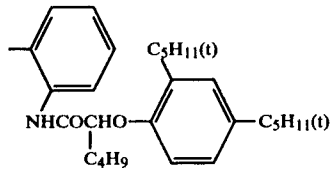 | 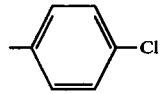 |
| 13 | —Cl | 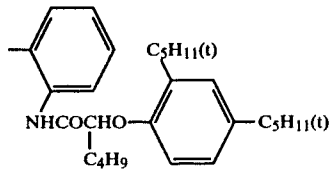 | 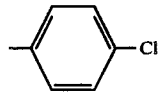 |
| 14 | —Cl | 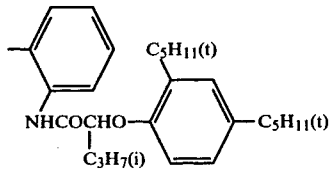 | 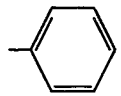 |
| 15 | —Cl | 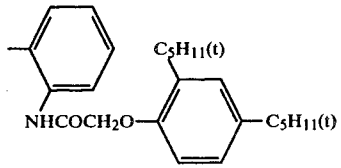 | 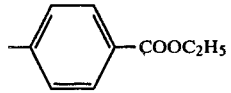 |
| 16 | —Cl | 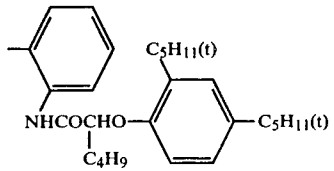 | 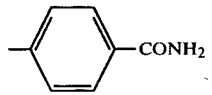 |

-continued
| | | | |
|---|---|---|---|
| 17 | —Cl | 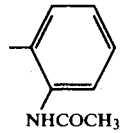 | 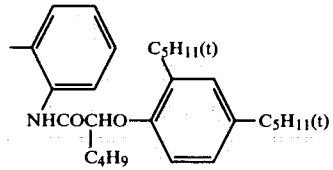 |
| 18 | —Cl | 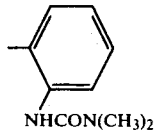 | 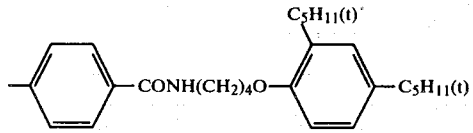 |
| 19 | —Cl | 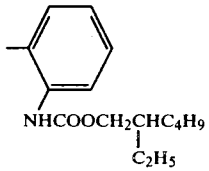 | 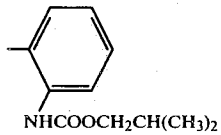 |
| 20 | —Cl | 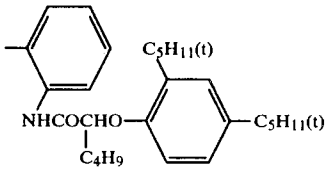 | 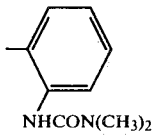 |
| 21 | H | 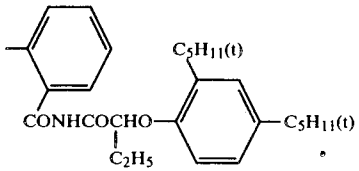 | 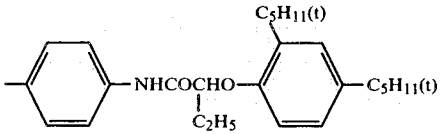 |

-continued
| | | | |
|---|---|---|---|
| 22 | —Cl | 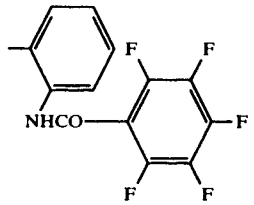 | 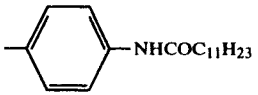 |
| 23 | —Cl | 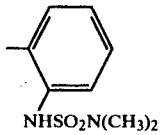 | 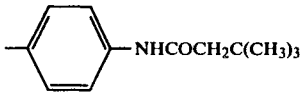 |
| 24 | —Cl | 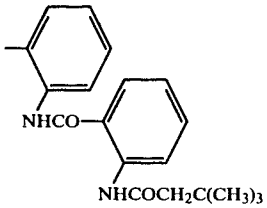 | 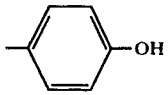 |
| 25 | H | 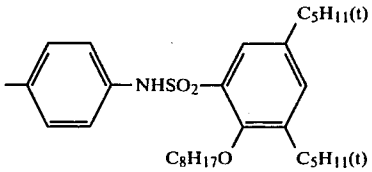 | 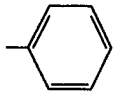 |
| 26 | H | 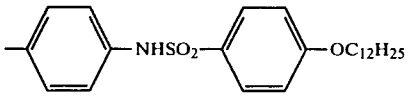 | 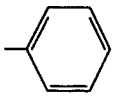 |

-continued
| | | | |
|---|---|---|---|
| 27 | H | 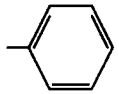 | 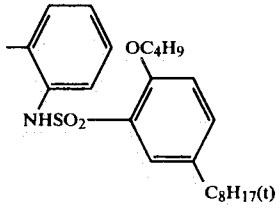  |
| 28 | —Cl | 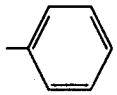 | 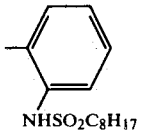  |
| 29 | —Cl | 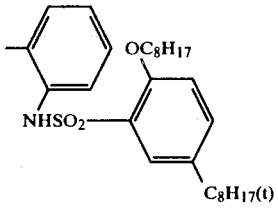  | 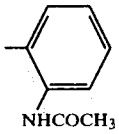  |
| 30 | —Cl | 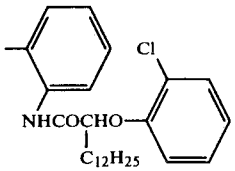  | 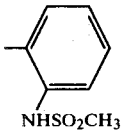  |
| 31 | —Cl | 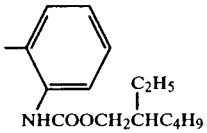  | 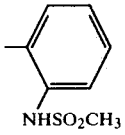  |

-continued
| | | | |
|---|---|---|---|
| 32 | —Cl | 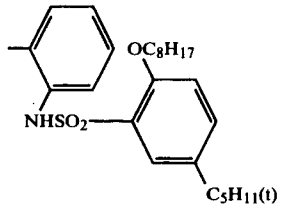 | 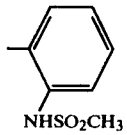 |
| 33 | —Cl | 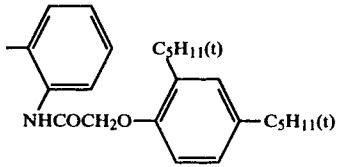 | 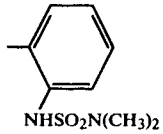 |
| 34 | —Cl | 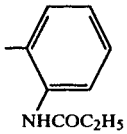 | 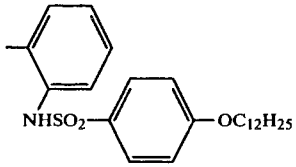 |
| 35 | —Cl | 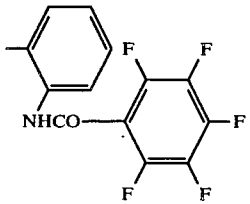 | 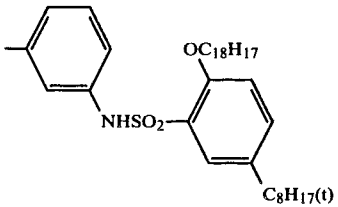 |
| 36 | —Cl | 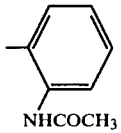 | 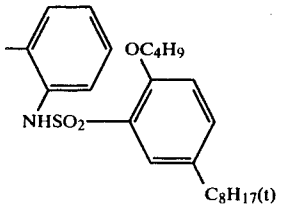 |

-continued
| | | | |
|---|---|---|---|
| 37 | —Cl | 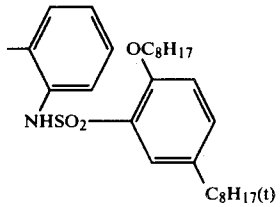 | 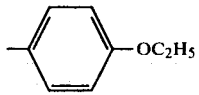 |
| 38 | —Cl | 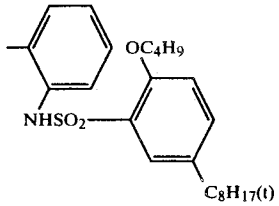 | 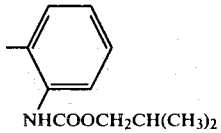 |
| 39 | —Cl | 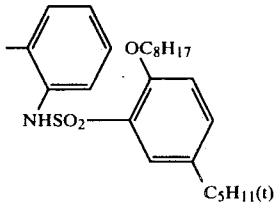 | 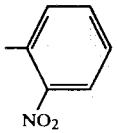 |
| 40 | —Cl | 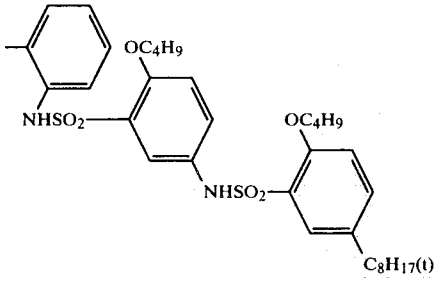 | 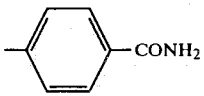 |

-continued
| | | | |
|---|---|---|---|
| 41 | —Cl | 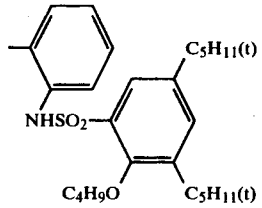 | 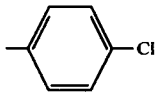 |
| 42 | H | 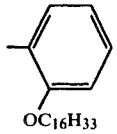 | 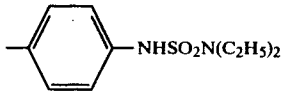 |
| 43 | —Cl | 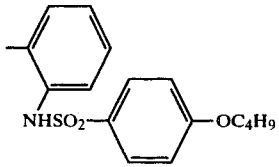 | 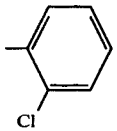 |
| 44 | —Cl | 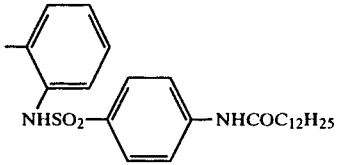 | 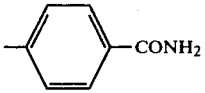 |
| 45 | —Cl | 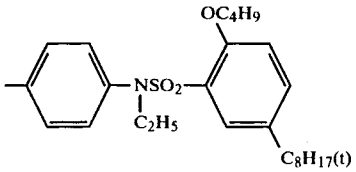 | 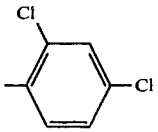 |

-continued
| | | | |
|---|---|---|---|
| 46 | —Cl | 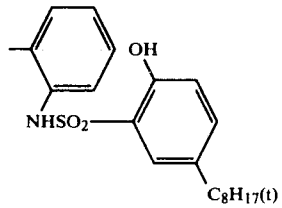 | 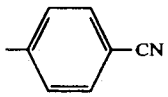 |
| 47 | —Cl | 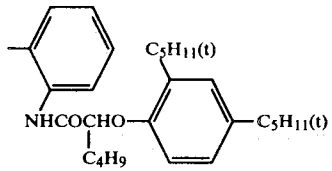 | 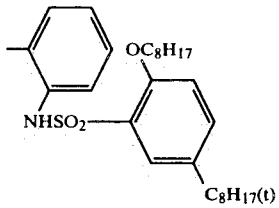 |
| 48 | —Cl | 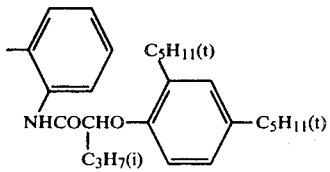 | 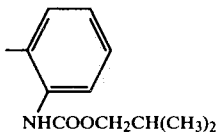 |
| 49 | —Cl | 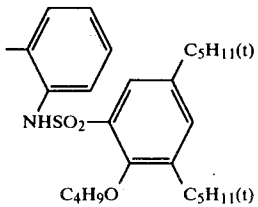 | 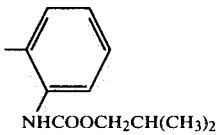 |

-continued
| | | | |
|---|---|---|---|
| 50 | —Cl | 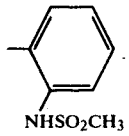  | 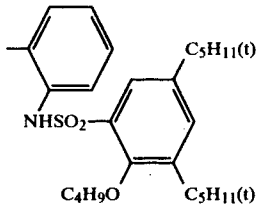  |
| 51 | —Cl | 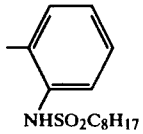  | 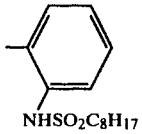  |
| 52 | —Cl | 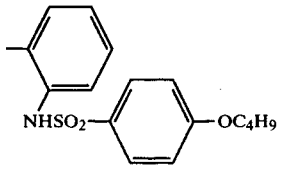  | 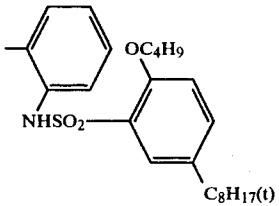  |

| | | | |
|---|---|---|---|
| 53 | —Cl | 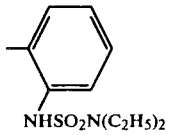 $NHSO_2N(C_2H_5)_2$ | 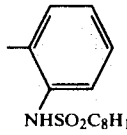 $NHSO_2C_8H_17$ |
| 54 | —Cl | 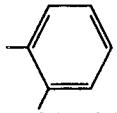 $NHSO_2N(CH_3)_2$ | 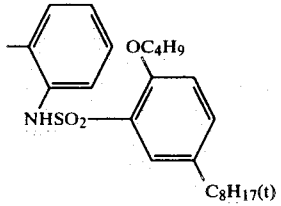 $OC_4H_9$ $NHSO_2$ $C_8H_17(t)$ |
| 55 | —Cl | 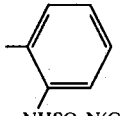 $NHSO_2N(C_2H_5)_2$ | 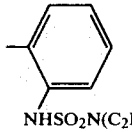 $NHSO_2N(C_2H_5)_2$ |
| 56 | —Cl | 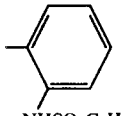 $NHSO_2C_8H_17$ | 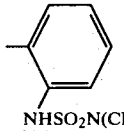 $NHSO_2N(CH_3)_2$ |
| 57 | —Cl | 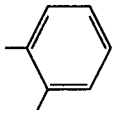 $NHCOC_{12}H_{25}$ | 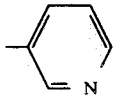 N |
| 58 | —Cl | 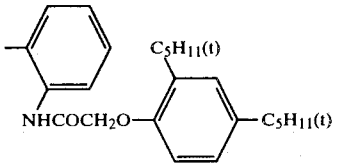 $C_5H_{11}(t)$ $NHCOCH_2O$ $C_5H_{11}(t)$ | 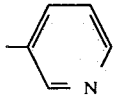 N |

-continued
| | | | |
|---|---|---|---|
| 59 | —Cl | 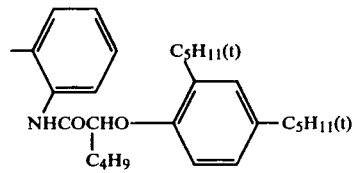 | 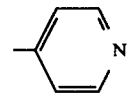 |
| 60 | —Cl | 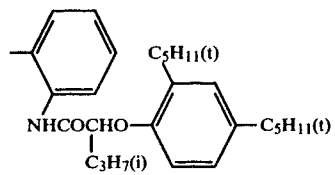 | 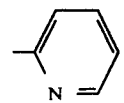 |
| 61 | —Cl | 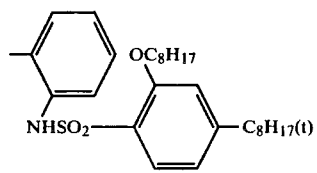 | 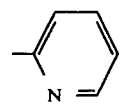 |
| 62 | 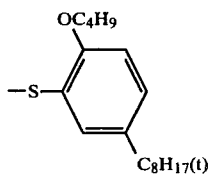 | 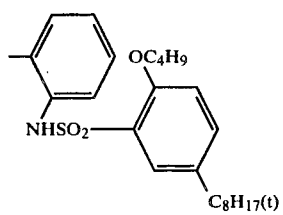 | 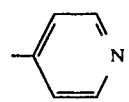 |
| 63 | —Cl | 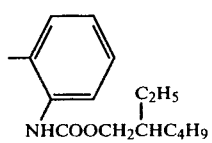 | 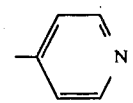 |

-continued
| | | | |
|---|---|---|---|
| 64 | —Cl | 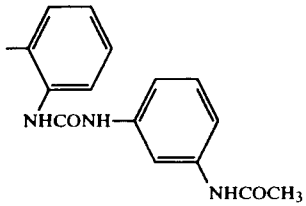 | 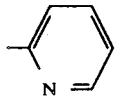 |
| 65 | —Cl | 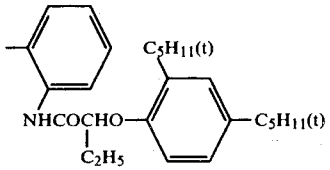 | 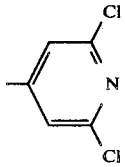 |
| 66 | —Cl | 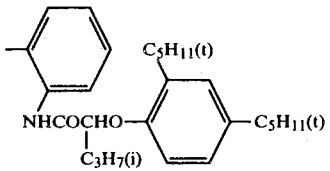 | 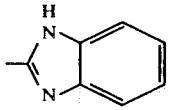 |
| 67 | —Cl | 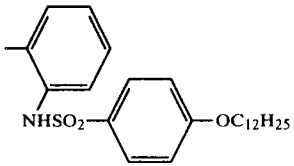 | 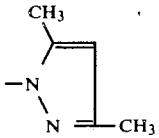 |
| 68 | —Cl | 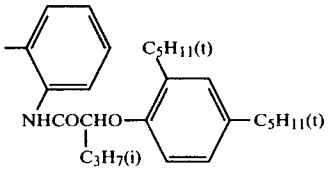 | 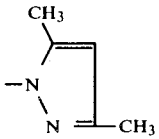 |

-continued
| | | | |
|---|---|---|---|
| 69 | —Cl | 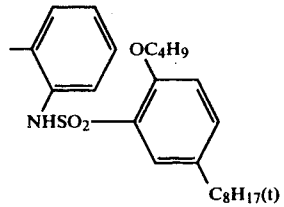 | 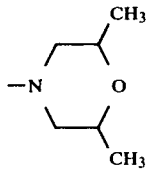 |
| 70 | —Cl | 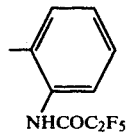 | 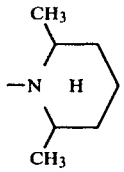 |
| 71 | —Cl | 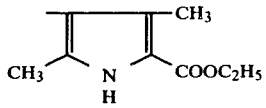 | 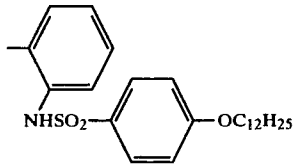 |
| 72 | —Cl | 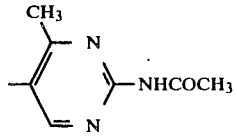 | 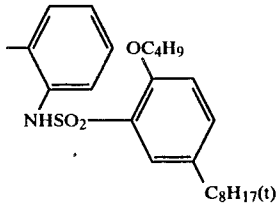 |
| 73 | —Cl | 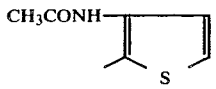 | 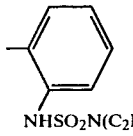 |

-continued
| | | | |
|---|---|---|---|
| 74 | —Cl | 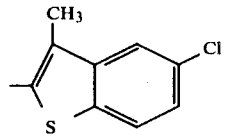 | 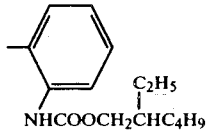 |
| 75 | —Cl | 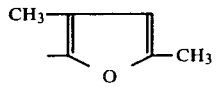 | 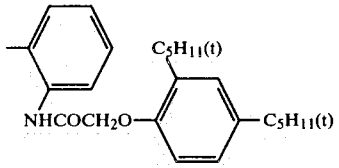 |
| 76 | —Cl | 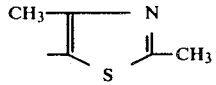 | 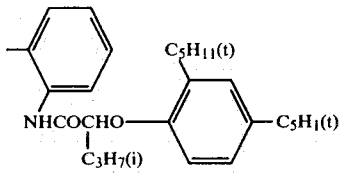 |
| 77 | —Cl | 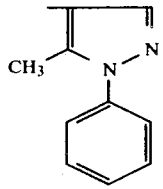 | 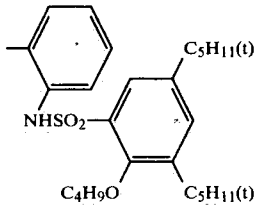 |
| 78 | —Cl | 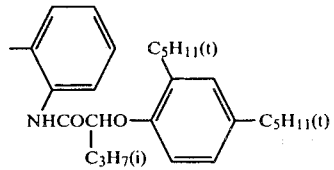 | 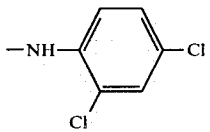 |

-continued
| | | | |
|---|---|---|---|
| 79 | —Cl | 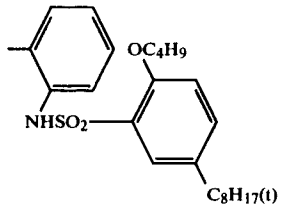 | —$NHCH_2CH(OC_2H_5)_2$ |
| 80 | —Cl | 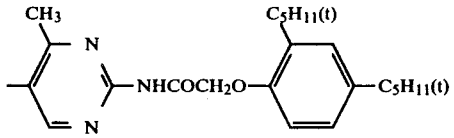 | 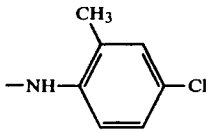 |
| 81 | —Cl | 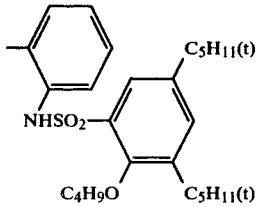 | 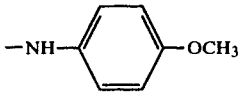 |
| 82 | —Cl | 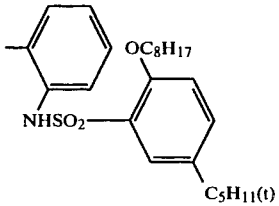 | 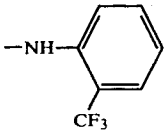 |
| 83 | 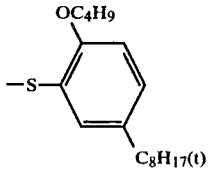 | 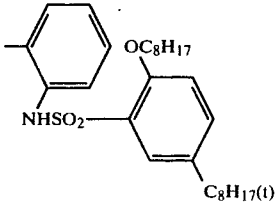 | 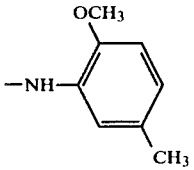 |

-continued
| | | | |
|---|---|---|---|
| 84 | —Cl | 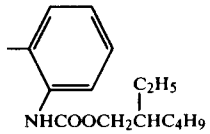 | 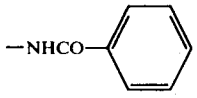 |
| 85 | —Cl | 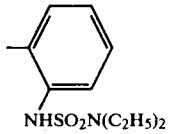 | $-NHC_8H_{17}(t)$ |
| 86 | —Cl | 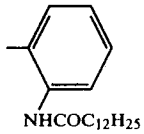 | 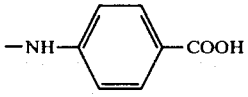 |
| 87 | —Cl | 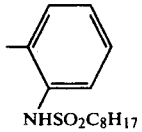 | 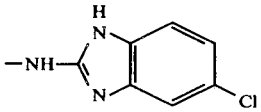 |
| 88 | —Cl | 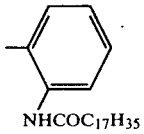 | $-SCH_3$ |
| 89 | —Cl | 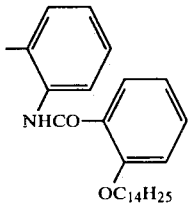 | 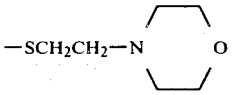 |

-continued
| | | | |
|---|---|---|---|
| 90 | —Cl | 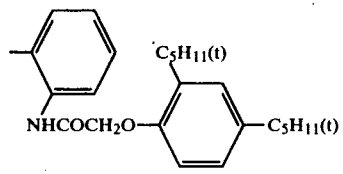 | —$SCH_2CH_2COOH$ |
| 91 | —Cl | 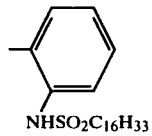 | —$SCH_2CO$— 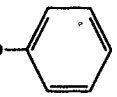 |
| 92 | —Cl | 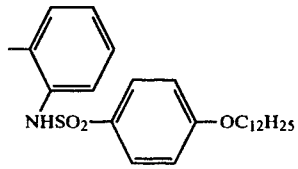 | —$SCH_2$— 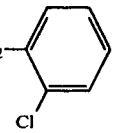 |
| 93 | H | 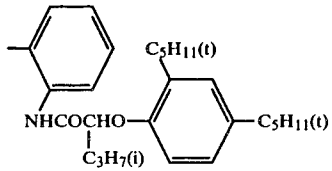 | —$SC_{16}H_{33}$ |
| 94 | —Cl | 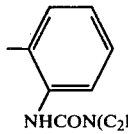 | —S— 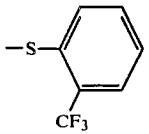 |
| 95 | —Cl | 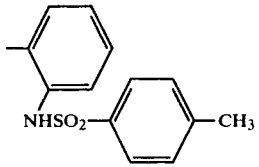 | —$SCH_2$— 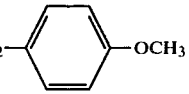 |

-continued
| | | | |
|---|---|---|---|
| 96 | —Cl | 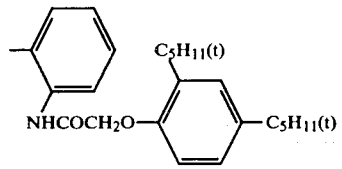 | 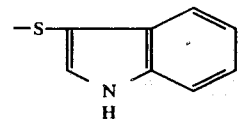 |
| 97 | —Cl | 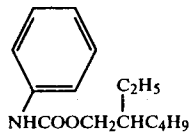 | 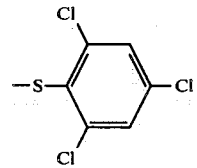 |
| 98 | —Cl | 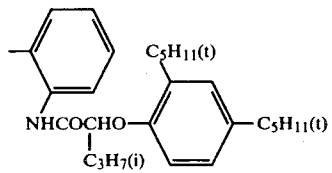 | 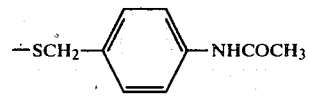 |
| 99 | —Cl | 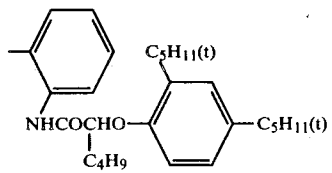 | $-SCH_2CH_2NHSO_2CH_3$ |
| 100 | —Cl | 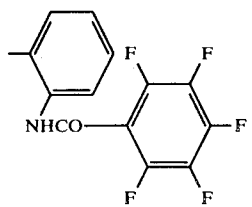 | 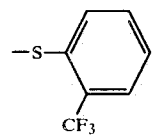 |

-continued
| | | | |
|---|---|---|---|
| 101 | —Cl | 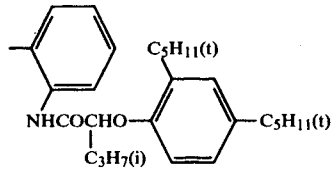 | 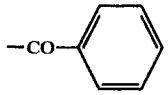 |
| 102 | —Cl | 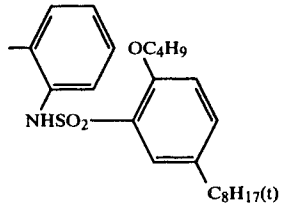 | 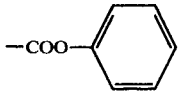 |
| 103 | —Cl | 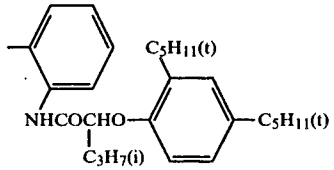 | —CN |
| 104 | —Cl | H | 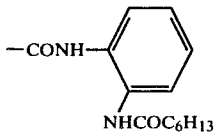 |
| 105 | —Cl | 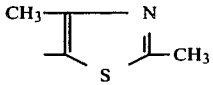 | $-SC_{16}H_{33}$ |
| 106 | —Cl | 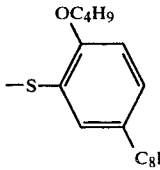 | 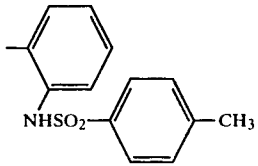 |

-continued
| | | | |
|---|---|---|---|
| 107 | —Cl | 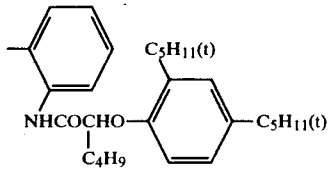 | —$CH_3$ |
| 108 | —Cl | 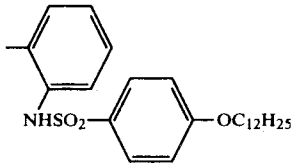 | —$CH_2Cl$ |
| 109 | —Cl | 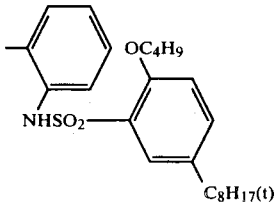 | 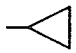 |
| 110 | —Cl | 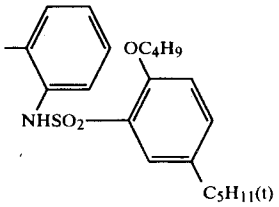 | 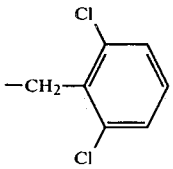 |
| 111 | —Cl | 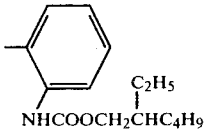 | —$CH(Cl)CH_2OCH_3$ |

-continued
| | | | |
|---|---|---|---|
| 112 | —Cl | 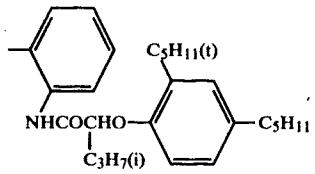 | 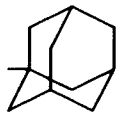 |
| 113 | —Cl | 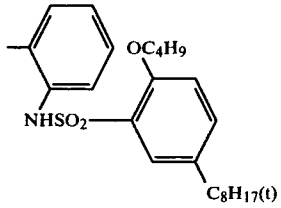 | —$OC_3H_7(i)$ |
| 114 | —Cl | 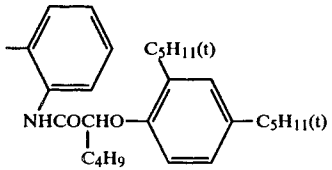 | —$OCH_3$ |
| 115 | H | 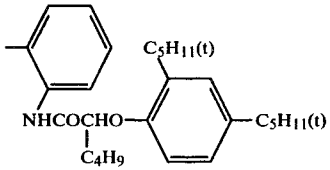 | 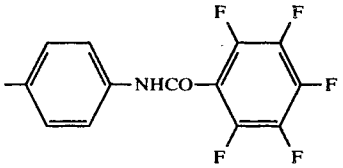 |
| 116 | H | 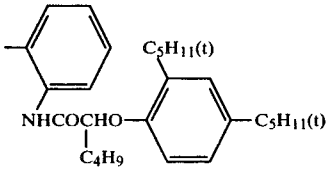 | —$NHCOOCH_2CH(CH_3)_2$ |

-continued
| | | | |
|---|---|---|---|
| 117 | H | 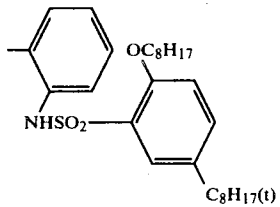 | 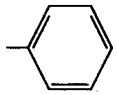 |
| 118 | H | 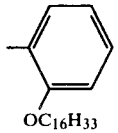 | 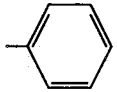 |
| 119 | —Cl | 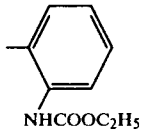 | —$SC_{16}H_{33}$ |
| 120 | H | 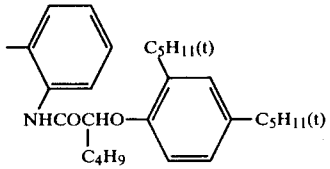 | 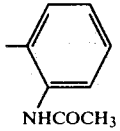 |
| 121 | H | 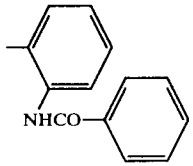 | 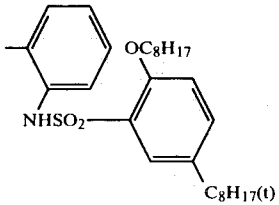 |

-continued
| | | | |
|---|---|---|---|
| 122 | —Cl | 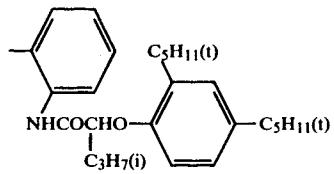 | 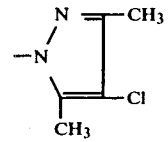 |
| 123 | —Cl | 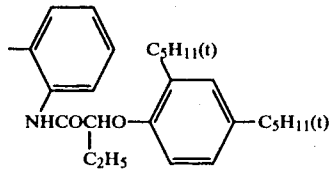 | 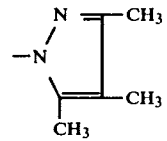 |
| 124 | —Cl | 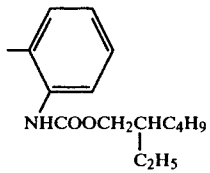 | 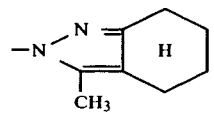 |
| 125 | —Cl | 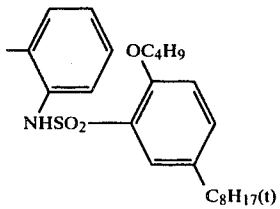 | 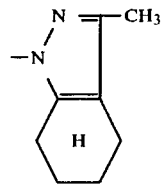 |
| 126 | —Cl | 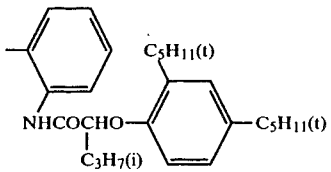 | 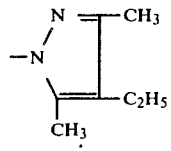 |

The cyan couplers of the invention can be synthesized in accordance with any of the methods described in, for example, 'Chemische Berichte', Vol. 34, pp. 639–642, 1901. Japanese patent application Nos. 61-261488, 62-134144, 62-211067 and 62-227476, and so forth.

Some typical examples of the syntheses will be given below.

SYNTHESIS EXAMPLE 1

Synthesis of Compound Example 1

2-phenyl-4-(o-stearylamidophenyl)imidazole

Benzamizine chloride of 4.0 g were dissolved in 20 ml of water. The resulted solution was added with a solution prepared by dissolving 3.3 g of potassium hydroxide and 7.5 ml of water and then with 15 ml of chloroform. The whole resulted solution was poured into a separating funnel. After shaking the funnel well, free benzamizine was extracted so as to put it into a chloroform layer. After separating the chloroform layer, 3.0 g of o-stearylamido-α-bromoacetophenone were added to the layer with stirring. The resulted matter was refluxed with boiling it for two hours, and cooled. Chloroform was then distilled off at reduced pressure. The resulted residue was washed several times with warm water and 100 ml of methanol were then added thereto so as to be crystallized.

The filtrated crystals were recrystallized with an ethyl acetate—methanol mixed solvent, so that 1.52 g of the objective compound were obtained. Yield: 48.5%. Melting point: 169° to 174° C.

SYNTHESIS EXAMPLE 2

Synthesis of Compound Example 3

2-phenyl-4-[p-(α-(2,4-di-t-amylphenoxy) hexaneamido)phenyl]imidazole p-(α-(2,4-di-t-amylphenoxy)hexaneamido)-α-bromoacetophenone of 5.44 g were dissolved in 30 ml of chloroform. The resulted solution was dropped therein with 40 ml of a 0.1 mol free-benzamizine-chloroform solution at room temperature. After stirring for one hour, chloroform was distilled off at reduced pressure. The resulted matter was dissolved in 200 ml of ethanol and was washed with 50 ml of an aqueous 5% potassium carbonate solution and then with 50 ml of water. The resulted matter was dried with magnesium sulfate so as to distill ethanol off and fractionated with a silica gel column using a mixture of ethanol:hexane=1:1, and the remaining solvents were distilled off. Thus. 4.2 g of the solid objective were thereby obtained. Yield: 74%

SYNTHESIS EXAMPLE 3

Synthesis of Compound Example 4

2-phenyl-4-[p-{α-(2,4-di-t-amylphenoxy) hexaneamido}phenyl]-5-chloroimidazole The solid of 1.13 g, i.e., 2 millimol, obtained in Synthesis Example 2 were dissolved in 10 ml of chloroform and 0.3 g of N-chlorosuccinimide (NCS), were added thereto. The resulted solution was stirred for 2 days at room temperature and was then washed. The remaining solvents were distilled off, so that a gluey lump matter was obtained. It was then crystallized in 10 ml of ethanol. Thus, 0.71 g of light green crystals were obtained. Yield: 59%. Melting point: 109° to 112° C.

SYNTHESIS EXAMPLE 4

Synthesis of Compound Example 36

2-phenyl-4-[{p-(p-dodecyloxybenzene) sulfonamido}phenyl]imidazole

Synthesis was carried out in the same manner as in Synthesis Example 2, except that 5.44 g of p-{α-(2,4-di-t-amylphenoxy)hexaneamido}-α-bromoacetophenone were replaced by 5.38 g of p-(p-dodecyloxybenzene)sulfonamido-α-bromoacetophenone, so that 3.5 g of white solid were obtained. Yield: 62%.

SYNTHESIS EXAMPLE 5

Synthesis of Compound Example 12

2-p-chlorophenyl-4-[o-{α-(2,4-di-t-amylphenoxy) hexaneamido}phenyl]imidazole p-chlorobenzamizine hydroiodide of 11.3 g were added with 20 ml of chloroform and 15 ml of dimethylformamide and further with an aqueous solution prepared by dissolving 2.24 g of potassium hydroxide and 10 ml of water together. The resulted solution was stirred for 10 minutes at room temperature. Into the resulted solution was dropped with a solution prepared by dissolving 5.44 g of o-{α-(2,4-di-t-amylphenoxy)hexaneamido}-α-bromoacetophenone in 20 ml of chloroform, with stirring and taking 10 minutes.

When the resulted solution was stirred vigorously for 3 hours and was then allowed to stand, the solution was separated into two layers. One of the layers, a water layer, was discarded and the other layer was washed with 20 ml of water twice and the remaining solvents were distilled off at reduced pressure. The resulted residue was crystallized with acetonitrile, so that 1.45 g of crystals were obtained. Yield: 24%, Melting point: 135° to 139° C.

SYNTHESIS EXAMPLE 6

Synthesis of Compound Example 93

2-hexadecylthio-4-[o-{α-(2,4-di-t-acylphenoxy) -β-methylbutaneamido}phenyl)imidazole o-{α-(2,4-di-t-amylphenoxy)-β-methylbutaneamido)-α-bromoacetophenone of 10.6 g Were suspended in 100 ml of acetonitrile and 12.9 g of s-hexadecylisothiourea were then added thereto. Next, the resulted solution was added with 30 ml of dimethylformamide and was then heated at 60° C. for 5 minutes. The resulted solution was poured into 500 ml of water and was then extracted in 200 ml of ethyl acetate. The resulted extractants were dried with magnesium sulfate and the remaining solvents were then distilled off at reduced pressure. When the resulted matter was refined by a silica gel column containing a developing solvent in a proportion of ethyl acetate : hexane=1:6, 3.0 g of a paste-like objective matter were obtained.

Usually, the couplers of the invention may be used in an amount within the range of from $2\times10^{-3}$ to $8\times10^{-1}$ mol per mol of silver halide and, more preferably, from $1\times10^{-2}$ to $5\times10^{-1}$ mol.

The couplers of the invention may also be used with other kinds of cyan couplers in combination.

The foregoing imidazole type cyan couplers of the invention may be added into an objective hydrophilic colloidal layer in such a usual manner that the couplers are dissolved in a high-boiling organic solvent having a boiling point of not lower than 150° C. and, if required, together with low-boiling and/or water-soluble organic solvents in combination and, the resulted solution is so dispersed, with a surface active agent, as to be emulsified in a hydrophilic binder such as an aqueous gelatin solution or the like, by means of such a dispersing means as a stirrer, homogenizer, colloid-mill, flow-jet mixer, supersonic homogenizer or the like, so that the resulted emulsion may be added in the hydrophilic colloidal layer. It is also allowed to supplement the process with a step for removing the low-boiling organic solvents from a dispersing solution either after or at the same time when the dispersion is made.

The high-boiling organic solvent and low-boiling organic solvent each relating to the invention are used in a proportion of from 1:0.1 to 1:50 and, more preferably, from 1:1 to 1:20.

In the invention, a high-boiling organic solvent having a permittivity of less than 6.0 may be used.

The high-boiling organic solvents applicable to the invention are those having a permittivity of not higher than 6.0. They include; for example, esters such as a phthalate, a phosphate and so forth, organic acid amides, ketones, hydrocarbon compounds and so forth each having a dielectric constant of not higher than 6.0; preferably, those having a dielectric constant of from not higher than 6.0 to not lower than 1.9 and a vapour pressure of not higher than 0.5 mmHg at 100° C.: and, more preferably, the phthalates or phosphates. The high-boiling organic solvents may further include a mixture of not less than two kinds of the above-given high-boiling organic solvents.

A dielectric constant stated herein indicates that obtained at 30° C.

Phthalates advantageously applicable to the invention include, for example, those represented by the following Formula HA:

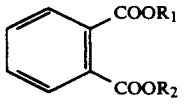

Formula HA wherein $R_1$ and $R_2$ each represent a group of alkyl, alkenyl or aryl, provided that a total number of carbon atoms of a group represented by $R_1$ and $R_2$ is from 12 to 32 and, preferably, from 16 to 24.

In the invention, the alkyl groups each represented by $R_1$and $R_2$ may be straight-chained or branched. They include, for example, a group of butyl, pentyl, hexyl, 2-ethylhexyl, 3,5,5-trimethylhexyl, octyl, nonyl, decyl, dodecyl, tetradecyl, hexadecyl, octadecyl or the like. The aryl groups each represented by $R_1$ and $R_2$ include, for example, a group of phenyl, naphthyl or the like. The alkenyl groups include, for example, a group of hexenyl, heptenyl, octadecenyl or the like. Those alkyl, alkenyl and aryl groups include those having a single of plural substituents. Such substituents of the alkyl and alkenyl groups include, for example, a halogen atom and a group of alkoxy, aryl, aryloxy, alkenyl, alkoxycarbonyl or the like. The substituents of the aryl groups include, for example, a halogen atom and a group of alkyl, alkoxy, aryl, aryloxy, alkenyl, alkoxycarbonyl or the like.

In the above-given phthalates, the groups represented by $R_1$ and $R_2$ should preferably be alkyl groups such as a group of 2-ethylhexyl, 3,5,5-trimethylhexyl, n-octyl, n-nonyl or the like.

Phosphates advantageously applicable to the invention include, for example, those represented by the following Formula HB:

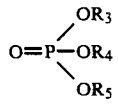

Formula HB wherein $R_3$, $R_4$ and $R_5$ each represent a group of alkyl, alkenyl or aryl, provided that a total number of carbon atoms of a group represented by $R_3$, $R_4$ and $R_5$ is from 24 to 25.

In the Formula HB, the alkyl groups represented by $R_3$, $R_4$ and $R_5$ include, for example, a group of butyl, pentyl, hexyl, 2-ethylhexyl, heptyl, nonyl, decyl, dodecyl, tetradecyl, hexadecyl, octadecyl, nonadecyl or the like. The aryl groups include, for example, a group of phenyl, naphthyl or the like. The alkenyl groups include, for example, a group of hexenyl, heptenyl, octadecenyl or the like.

Those alkyl, alkenyl and aryl groups include those having a single or plural substituents. $R_3$, $R_4$ and $R_5$ should preferably represent alkyl groups such as a group of 2-ethylhexyl, n-octyl, 3,5,5-trimethylhexyl, n-nonyl, n-decyl, sec-decyl, sec-dodecyl, t-octyl or the like.

Now, some typical examples of the high-boiling organic solvents applicable to the invention will be given below. It is, however, to be understood that the invention shall not be limited thereto.

Exemplified organic solvents

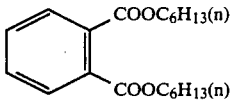

H-1

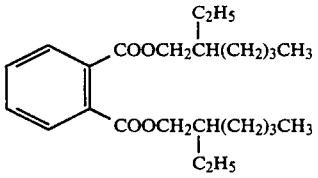

H-2

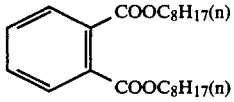

H-3

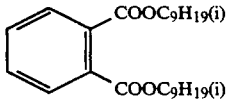

H-4

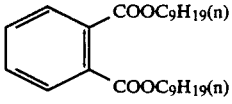

H-5

-continued

Exemplified organic solvents

H-6

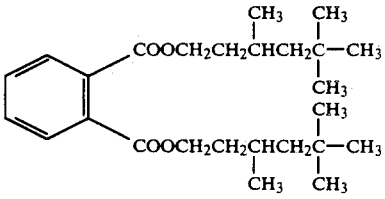

H-7

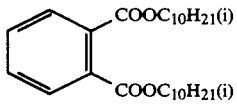

H-8

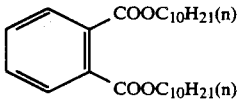

H-9

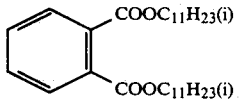

H-10

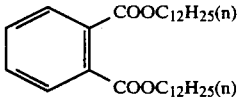

H-11

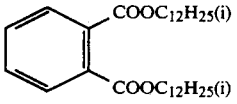

H-12

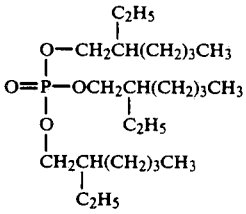

H-13

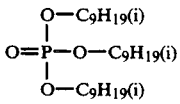

H-14

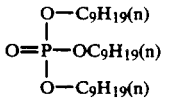

H-15

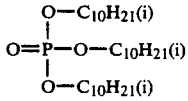

H-16

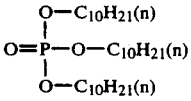

-continued

Exemplified organic solvents

H-17

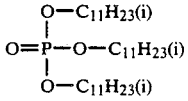

H-18

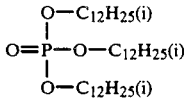

H-19

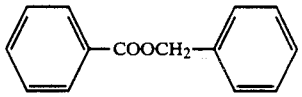

H-20

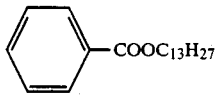

H-21

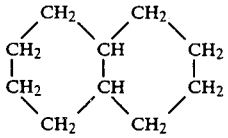

H-22

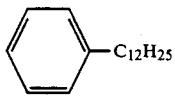

Those high-boiling organic solvents having a dielectric constant of not higher than 6.0 should be used in an amount of, preferably, from 0.1 to 10 ml per gram of couplers used and, more preferably, from 0.5 to 2 ml.

The methods for adding couplers and bis-type phenol derivatives include, preferably, an oil drop-in-water type emusification-dispersion method.

In such an oil drop-in-water type emusification-dispersion method, couplers and bis-type phenol derivatives may be added into an objective hydrophilic colloidal layer in such a manner that hydrophobic additives such as the couplers and derivatives are dissolved in a high-boiling organic solvent of the invention and, if required, together with low-boiling and/or water-soluble organic solvents in combination and the resulted solution is so dispersed together with a surface active agent as to be emulsified in a hydrophilic binder such as an aqueous gelatin solution or the like, by means of such a dispersing means as a stirrer, homogenizer, colloid-mill, flow-jet mixer, supersonic homogenizer or the like, so that the resulted emulsion may be added in the hydrophilic colloidal layer. It is also allowed to supplement the process with a step for removing the low-boiling organic solvents from a dispersing solution either after or at the same time when the dispersion is made.

The high-boiling organic solvents which may be used with the high-boiling organic solvents of the invention in combination include, for example, those having a boiling point of not lower than 150° C., such as phenol derivatives incapable of reacting with any oxidized products of a developing agent, phthalates, phosphates, citrates, benzoates, alkylamides, fatty acid esters, trimesic acid esters and so forth.

As described above, the cyan couplers relating to the invention are added into a hydrophilic colloidal layer constituting a light-sensitive material after the couplers are dissolved in a high-boiling solvent and are then so dispersed as to be emulsified in a hydrophilic binder. Thus, the couplers and high-boiling solvents are present in the form of fine oil drops in the hydrophilic colloidal layer.

In the meantime, a silver halide photographic light-sensitive material containing the foregoing imidazole type cyan couplers is liable to color reproducibility deterioration which likely causes from a color contamination produced by the diffusion of the oxidized products of a color developing agent into other layers. It is, therefore, found that the excellent spectral absorption characteristics, which are a special feature of the imidazole type cyan couplers, may not satisfactorily be displayed in some cases.

Also, if the foregoing imidazole type cyan couplers were used in an excessive amount, there found to be liable to the problems such as undesirable effects that image-formed cyan couplers are moved from their original position to anOther position during the storage of the image so as to cause the so-called 'bleeding' of a cyan image, and that a part of a solvent constituting oil drops is moved onto the surface of a photographic component layer and thereby a sweating phenomenon (hereinafter called 'sweat') is produced so as to deteriorate the gloss of the surface. The above-mentioned 'bleeding' and 'sweat' of an image will seriously affect the quality of printed images, so that it has been demanded to solve those problems.

Particularly in recent years, such a fog increase, color reproduction deterioration, or 'bleeding' and 'sweat' as mentioned above have become conspicuous in rapid processes.

From the above-mentioned point of view, it should be preferable that a ratio of a total weight Od of oil drops contained in a silver halide emulsion to a weight Hc of hydrophilic colloids, i.e., Od / Hc, is not higher than 0.8 and that a silver halide content by weight of the silver halide emulsion layer is not more than 2.0 mg/dm$^2$ in terms of metal silver by weight.

In the invention, a total weight Od of oil drops contained in a silver halide emulsion containing the cyan couplers relating to the invention, such a total weight Od is defined as follows.

Generally, the cyan couplers relating to the invention are contained in dissolved state into an organic solvent, and they are present in the so-called oil-drop state in a silver halide emulsion layer. Such oil-drops containing the cyan couplers may sometimes contain hydrophobic compounds such as an image stabilizer, a color contamination inhibitor, a UV absorbent and so forth, if required. In such a case, a total weight Od of oil drops stated herein means a total weight of organic solvents, cyan couplers and the foregoing hydrophobic compounds.

In the cases that other oil drops than those containing cyan couplers are present, such as that oil drops do not contain any cyan coupler relating to the invention but contain only an organic solvent, that oil drops whose organic solvent does not contain any cyan coupler relating to the invention but has such a hydrophobic compound as mentioned above dissolved therein, or that oil drops contain a hydrophobic compound such as an oily UV absorbing agent which is insoluble to an organic solvent at room temperature, a total weight Od of oil drops stated herein means an aggregate amount by weight of both of the oil drops containing the cyan couplers relating to the invention and the other oil drops than the above-mentioned oil drops relating to the invention.

In the invention, a proportion of a total weight Od of the foregoing oil drops to a total weight Hc of hydrophilic colloids is not more than 0.8 and, more preferably, from 0.2 to 0.6. The term, a weight Hc of hydrophilic colloid, stated herein means a weight of such a hydrophilic colloid as gelatin being present in a layer containing oil drops containing cyan couplers. Such a weight Hc does not include a weight of hydrophilic colloids such as gelatin being present in other layers such as a protective layer, an interlayer and other light-sensitive layers.

Also in the invention, a total weight of oil drops is preferably from 3 to 20 mg/dm$^2$. If it exceeds 20 mg/dm$^2$, an effective improvement may not satisfactorily be expected on cyan dye image 'bleeding'. Further in the invention, as described above, the hydrophilic colloids are those of a layer in which cyan coupler-containing oil drops are present. An amount of the colloids should preferably be from 5 to 30 mg/dm$^2$.

In the invention that a silver halide emulsion layer contains cyan couplers as mentioned above, a silver halide content by weight therein is preferably not more than 2.7 mg/dm$^2$ and, more preferably, from 0.5 to 2.5 mg/dm$^2$, in terms of metal silver.

In the invention, a silver halide emulsion containing silver halide grains relating to the invention further contains a nitrogen-containing heterocyclic compound having a mercapto group. Generally, those compounds have been known as an antifoggant and, it was amazing that a fog production can effectively be inhibited when these compounds and the cyan couplers represented by the foregoing Formula I are used in combination. Those compounds are mercapto compounds having a product Ksp of solubility with silver ions of not more than $1\times10^{-10}$ and, more preferably, not more than $1\times10^{-11}$. How to calculate a solubility product may be referred to, for example. 'A Course of New Experimental Chemistry', Vol 1, Published by Maruzen Co., pp. 233–250.

In the invention, the organic compounds having such a physical property value as the foregoing solubility product thereof with silver ions of not more than $1\times10^{-11}$ (hereinafter called an organic compound of the invention) are preferably the mercapto compounds represented by Formula S given below.

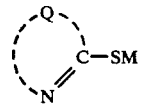

Formula S wherein Q represents the group consisting of atoms necessary to complete a 5- or 6-membered heterocyclic ring or a benzene ring-condensed 5- or 6-membered heterocyclic ring; and M represents a hydrogen atom or a cation.

Now, the mercapto compounds represented by the above-given Formula S, which may preferably be used as the organic compounds of the invention, will be detailed.

In Formula S, Q represents the group consisting of atoms necessary to complete a 5- or 6-membered heterocyclic ring or a benzene ring-condensed 5- or 6-membered heterocyclic ring. The heterocyclic rings completed by Q include, for example, a heterocyclic ring of imidazole, tetrazole, thiazole, oxazole, selenazole, benzoimidazole, naphthoimidazole, benzothiazole, naphthothiazole, benzoselenazole, naphthoselenazole, benzoxazole or the like.

The cations represented by M include, for example, alkali metal ions such as sodium ion, potassium ion and so forth, an ammonium group, and so forth.

Among the mercapto compounds each represented by Formula S, those represented by the following Formulas SA, SB, SC and SD should be more preferable.

Formula SA

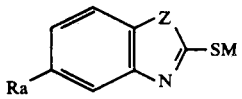

wherein Ra represents a hydrogen atom, an alkyl group, an alkoxy group, an aryl group, a halogen atom, a carboxyl group or the salts thereof, a sulfo group or the salts thereof, or an amino group; Z represents —NH—, —)— or —S—: and M is synonymous with that denoted in Formula S.

Formula SB

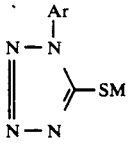

wherein Ar represents

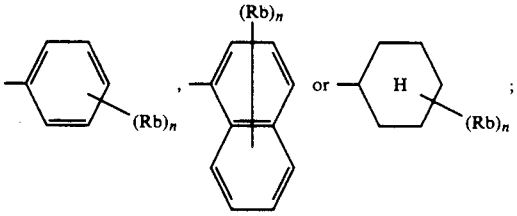

Rb represents an alkyl group, an alkoxy group, a carboxyl group or the salts thereof, a sulfo group or the salts thereof, a hydroxyl group, an amino group, an acylamino group, a carbamoyl group or a sulfonamido group: n is an integer of 0 to 2; and M is synonymous with that denoted in Formula S.

In Formulas SA and SB, the alkyl groups each represented by Ra or Rb include, for example, a group of methyl, ethyl, butyl or the like; the alkoxy groups include, for example, a group of methoxy, ethoxy or the like; and the salts of the carboxyl or sulfo groups include, for example, those of sodium, ammonium and so forth.

In Formula SA, the aryl groups represented by Ra include, for example, a group of phenyl, naphthyl or the like; and halogen atoms include, for example, an atom of chlorine, bromine or the like.

In Formula SB, the acylamino groups represented by Rb include, for example, a group of methylcarbonylamino, benzoylamino or the like; the carbamoyl groups include, for example, a group of ethylcarbamoyl, phenylcarbamoyl or the like; and the sulfonamido groups include, for example, a group of methylsulfonamido, phenylsulfonamido or the like.

The above-given alkyl, alkoxy, aryl, amino, acylamino, carbamoyl, sulfonamido and the like groups, each may include those further having substituents.

Formula SC

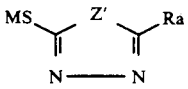

wherein Z' represents

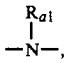

an oxygen atom or a sulfur atom; $R_a$ represents a hydrogen atom, or an group of alkyl, aryl, alkenyl, cycloalkyl, $—SR_{a1}$,

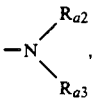

$—NHCOR_{14}$, $—NHSO_2R_{a5}$ or heterocyclic ring;

$Ra_1$ represents an hydrogen atom, or a group of alkyl, alkenyl, cycloalkyl, aryl, $—COR_{a4}$ or $—SO_2R_{a5}$; $R_{a2}$ and $R_{a3}$ each represent a hydrogen atom or a group of alkyl or aryl; $R_{a4}$ and $R_{a5}$ each represent a group of alkyl or aryl; and M is synonymous with that denoted in Formula S.

In Formula SC, the alkyl groups represented by Ra, $R_{a1}$, $R_{a2}$, $R_{a3}$, $R_{a4}$ and $R_{a5}$ include, for example, a group of methyl, benzyl, ethyl, propyl or the like; and the aryl groups include, for example, a group of phenyl, naphthyl or the like.

The alkenyl groups each represented by $R_a$ and $R_{a1}$ include, for example, a propenyl group and so forth; and the cycloalkyl groups include, for example, a cyclohexyl group and so forth. And, the heterocyclic groups represented by $R_a$ include, for example, a group of furyl, pyridinyl or the like.

The above-given alkyl and aryl groups each represented by $R_a$, $R_{a1}$, $R_{a2}$, $R_{a3}$, $R_{a4}$ and $R_{a5}$, the alkenyl and cycloalkyl groups each represented by $R_a$ and $R_{a1}$ and the heterocyclic groups represented by $R_a$, each groups include those having a substituent.

Formula SD

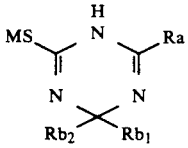

wherein $R_a$ and M each are synonymous with those denoted in Formula SC; and $R_{b1}$ and $R_{b2}$ each are synonymous with $R_{a1}$ and $R_{a2}$ each denoted in Formula SC, respectively.

It is also allowed that $R_{b1}$ and $R_{b2}$ may be bonded to each other to complete a ring.

The compounds represented by Formula S will typically be exemplified below. It is, however, to be understood that the invention shall not be limited thereto.

SA-1
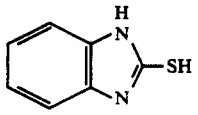
SA-2
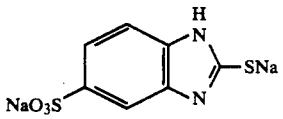
SA-3
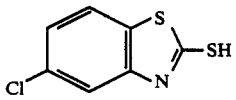
SA-4
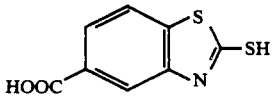
SA-5
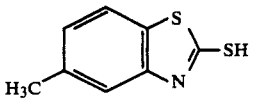
SA-6
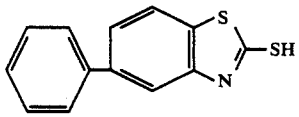
SA-7
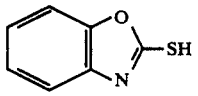
SA-8
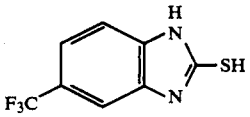
SB-1
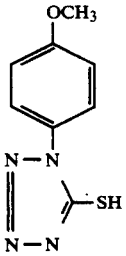
SB-2
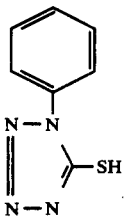
-continued
SB-3
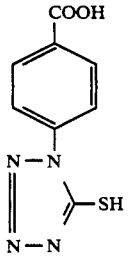
SB-4
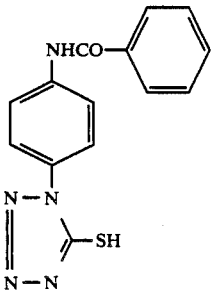
SB-5
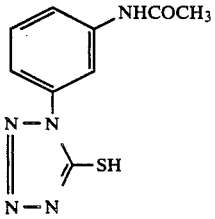
SB-6
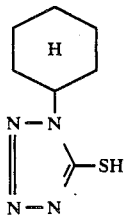
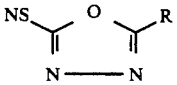
| Exemplified compound No. | R | M |
|---|---|---|
| SC-1 | $-C_2H_5$ | —H |
| SC-2 | $-CH_2-CH=CH_2$ | —H |
| SC-3 | $-CH=CH-CH_2-CH_3$ | —H |
| SC-4 | $-C_7H_{15}$ | —H |
| SC-5 | $-C_9H_{19}$ | —Na |
| SC-6 | 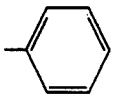 | —H |
| SC-7 | $-C_4H_9(t)$ | —H |
| SC-8 | 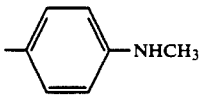 | —H |

-continued

| | | |
|---|---|---|
| SC-9 | 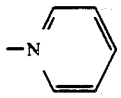 | —H |
| SC-10 | 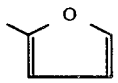 | —H |
| SC-11 | 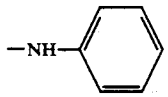 | —H |
| SC-12 | 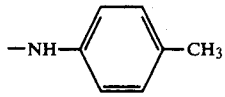 | —$NH_4$ |
| SC-13 | —$NHCOCH_3$ | —H |
| SC-14 | 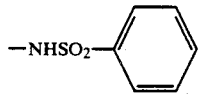 | —H |
| SC-15 | —$N(CH_3)_2$ | —H |
| SC-16 | 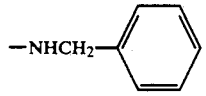 | —H |
| SC-17 | 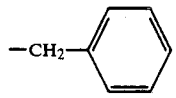 | —H |
| SC-18 | —S—$CH_3$ | —H |
| SC-19 | 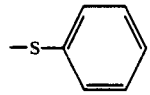 | —H |
| SC-20 | —SH | —H |

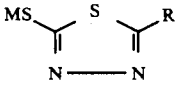

| Exemplified compound No. | R | M |
|---|---|---|
| SC-21 | —H | —H |
| SC-22 | —$C_2H_5$ | —H |
| SC-23 | —$C_4H_9$(t) | —H |
| SC-24 | —$C_6H_{13}$ | —H |
| SC-25 | 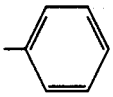 | —H |
| SC-26 | 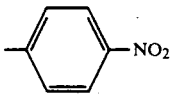 | —H |

-continued

| | | |
|---|---|---|
| SC-27 | 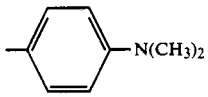 | —H |
| SC-28 | 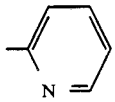 | —H |
| SC-29 | 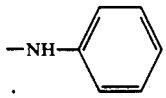 | —H |
| SC-30 | —$NH_2$ | —H |
| SC-31 | —$CH_2CH{=}CH_2$ | —H |
| SC-32 | —SH | —H |
| SC-33 | —$NHCOC_2H_5$ | —H |

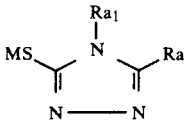

| Exemplified compound No. | Ra | $Ra_1$ | M |
|---|---|---|---|
| SC-34 | —$C_2H_5$ | —H | —H |
| SC-35 | —$CH_3$ | —$CH_3$ | —H |
| SC-36 | —$CH_3$ | 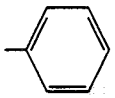 | —H |
| SC-37 | —$NHCOCH_3$ | —$CH_3$ | —H |
| SC-38 | 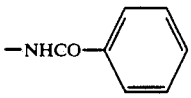 | 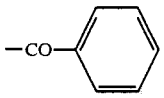 | —H |
| SC-39 | —$NHCOCH_3$ | —$COCH_3$ | —H |
| SC-40 | —$NHCOCH_3$ | 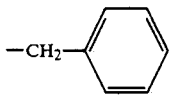 | —H |

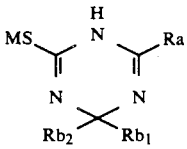

| Exemplified compound No. | Ra | $Rb_1$ | $Rb_2$ | M |
|---|---|---|---|---|
| SD-1 | —$C_2H_5$ | —$CH_3$ | —$CH_3$ | —H |
| SD-2 | 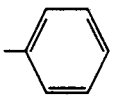 | —$CH_3$ | —$CH_3$ | —H |

-continued

| | | | | |
|---|---|---|---|---|
| SD-3 | $-NH_2$ | $-H$ | 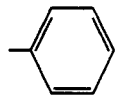 | $-H$ |
| SD-4 | 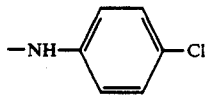 | $-H$ | $-C_4H_9$ | $-H$ |
| SD-5 | $-NHCOCH_3$ | $-CH_3$ | $-CH_3$ | $-H$ |
| SD-6 | 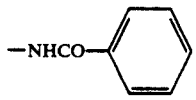 | $-CH_3$ | $-CH_3$ | $-H$ |
| SD-7 | 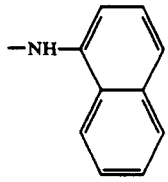 | $-CH_3$ | $-C_3H_7(i)$ | $-H$ |
| SD-8 | 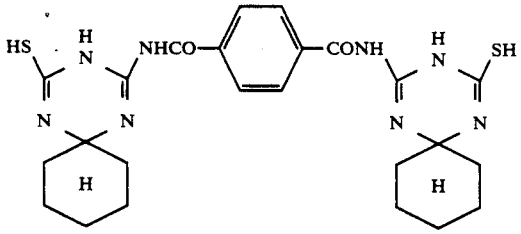 | | | |

The compounds represented by the abOVe-given Formula S include those described in, for example, Japanese Patent Examined Publication No. 40-28496, Japanese Patent O.P.I. Publication No. 50-89034, 'Journal of Chemical Society' 49, 1748, (1927), ibid., 42378, (1952), 'Journal of Organic Chemistry', 39, 2469, (1965). U.S. Pat. No. 2,824,001, 'Journal of Chemical Society', 1723, (1951), Japanese Patent O.P.I. Publication No. 56-111846, British Pat. No. 1,275,701, U.S. Pat. Nos. 3,266,897 and 2,403,927, and so forth, and those compounds may be synthesized in the methods also described in the above-given literatures.

The compounds represented by the Formula S relating to the invention (hereinafter referred to as 'Compounds S') may be contained in a silver halide emulsion layer containing silver halide grains relating to the invention in such a manner that Compound S is dissolved first in water or an organic solvent, such as methanol, ethanol or the like, which is freely miscible with water and then added into the layer. Compounds S may be used independently or in combination. They may further be used in combination with any stabilizers or antifoggant other than those containing mercapto group indicated in Formula S.

Compounds S may be added at any point of time between a time when silver halide grains are formed and a time when a chemical sensitization is completed. More preferably, the compounds are added partly at a point of time between a time when the grains are formed and a time when the chemical sensitization is progressed for a while and partly at a point of time when the chemical sensitization is completed.

A total amount of Compounds S may be added either at a time or in separate parts.

There is no special limitation to an amount added. They are usually added in an amount of from $1\times10^{-6}$ mol to $1\times10^{-1}$ mol per mol of silver halides used and, more preferably, from $1\times10^{31\ 5}$ mol to $1\times10^{31\ 2}$ mol.

The silver halide emulsions of the invention may also be treated in a reduction sensitizing method using a reducible substance, a noble metal sensitizing method using a noble metal compound or the like.

In the invention, a chalcogen sensitizer may be used. The chalcogen sensitizer is the generic name of sulfur sensitizers, selenium sensitizers and tellurium sensitizers. Among those sensitizers, the sulfur sensitizers and selenium sensitizers are preferablly used in the invention. Such sulfur senstizers include, for example, thiosulfate, allylthiocarbazide, thiourea, allylisothiocyanate, cystine, p-toluenethiosulfonate and rhodanine. Besides the above, it is also allowed to use the sulfur sensitizers described in, for example, U.S. Pat. Nos. 1,574,944, 2,410,689, 2,278,947, 2,728,668, 3,501,313 and 3,656,955; West German (OLS) Pat. No. 1,422,869; Japanese Pat. No. O.P.I. Publication Nos. 56-24937 and 55-45016; and so forth.

The above-mentioned silver halide grains relating to the invention are chemically sensitized in the presence of an unstable sulfur compound and a gold compound. Now, these two compounds applicable to the invention will be detailed below.

The unstable sulfur compounds applicable to the invention are sulfide-containing compounds characteristically capable of producing a silver salt when it reacts with silver halides and further capable of producing silver sulfide under the strongly alkalin conditions, for example. Those sulfide-containing compounds serving as sulfur-sensitizers include, for example, thiosulfide, allylthiocarbamide, thiourea, allylisothiocyanate, systine and so forth.

The above-given sulfide-containing compounds relating to the invention and serving as sulfur-sensitizers may be used in any amounts according to the various conditions required. However, they may be used in an amount of, preferably, from $1\times10^{-7}$ mol to $1\times10^{-1}$ mol per mol of silver halides used, more preferably, from $1\times10^{-7}$ mol to $1\times10^{-5}$ mol and, particularly, from $2\times10^{-6}$ mol to $8\times1O^{-6}$ mol. When the above-mentioned sulfur sensitizers are added in an emulsion, they may be added therein after dissolving it in water or in alcohol such as methanol, ethanol or the like.

The gold compounds applicable to the silver halide emulsion layers of the invention include, without limitation, chloroauric acid, sodium chloroaurate, potassium thiosulfoaurate and so forth, for example.

The gold compounds relating to the invention may be added in an amount of, preferably, from $5\times10^{-7}$ to $5\times10^{-3}$ mol per mol of silver halides used, more preferably, from $2\times10^{-6}$ to $1\times10^{-4}$ mol, further preferably, from $2.6\times10^{-6}$ to $4\times10^{-5}$ mol and, most preferably, from $2.6\times10^{-6}$ to $9\times10^{-6}$ mol.

The gold compounds relating to the invention may be so added as to make them present in the course between a point of time when the silver halide grains relating to the invention are formed and a point of time when a chemical sensitization is completed.

The unstable sulfur compounds and gold compounds both relating to the invention may be effective if they are present in the course of chemically sensitizing highly chloride-containing silver halide grains relating to the invention and, more concretely, they are so added as to be present in the course between a point of time when the above-mentioned grains are completely formed and a point of time when the chemical sensitization is completed.

Silver halide emulsions may also be optically sensitized to a desired wavelength region by making use of dyes which are well-known in photographic industry as sensitizing dyes. Such sensitizing dyes may be used either independently or in combination. Emulsions are also allowed to contain, as well as the sensitizing dyes, other dyes not having any spectral sensitizing function in themselves, or a supersensitizer that is a compound substantially not absorbing any visible rays of light, but enhancing the sensitizing the functions of the sensitizing dye.

Such sensitizing dyes include, for example, those of cyanine, merocyanine, conjugated cyanine, conjugated merocyanine, holopolar cyanine, hemicyanine, styryl, hemioxanol and so forth.

Among those dyes, the particularly useful dyes are those of cyanine, merocyanine and conjugated cyanine.

Silver halide emulsions are allowed to contain the compounds which have been well-known as an antifoggant or a stabilizer in photographic industry with the purposes of preventing fog or stabilizing photographic characteristics in the course of manufacturing, storing or photographically processing a light-sensitive material. Those compounds may be added in the course of chemically ripening, at a point of time when the chemical ripening is completed and/or in the course between the completion of the chemical ripening and the time of coating an silver halide emulsion on.

The silver halide photographic light-sensitive materials of the invention having the above-mentioned structure may be a color negative film, color positive film, color print paper or the like. The advantages of the invention can effectively be displayed especially when applying the invention to a color print paper for direct appreciation purpose.

The silver halide color photographic light-sensitive materials including color print paper may be for either monocolor or multicolor use. In the case of the multicolor silver halide photographic light-sensitive materials, they usually have such a structure that the support thereof is multilayered with silver halide emulsion layers containing magenta, yellow and cyan couplers to serve as the photographic color formers and non-light-sensitive layers, respectively in suitable number and layer arrangement, so that a subtractive color reproduction may be performed. The number of layers and the order of the layer arrangements may suitably be changed so as to display the aimed characteristics and to satisfy the purposes of use.

In the case of applying the invention to a multicolor light-sensitive material, a particularly preferable layer arrangement is that a support is arranged thereonto with a yellow dye image forming layer, an interlayer, a magenta dye image forming layer, an interlayer, a cyan dye image forming layer, an interlayer and a protective layer in order from the support side.

There is no special limitation to the dye image forming couplers applicable to the silver halide light-sensitive materials of the invention, and a variety of the cOuplers may be used. Those couplers include, typically, the compounds described in the following patent specifications.

The yellow dye image forming couplers include 4- or 2-equivalent couplers of acylacetoamide or benzoylmethane type, of which are detailed in, for example, U.S. Pat. Nos. 2,778,658, 2,875,057, 2,908,573, 2,908,513, 3,227,155, 3,227,550, 3,253,924, 3,265,506, 3,277,155, 3,341,331, 3,369,895, 3,384,657, 3,408,194, 3,415,652, 3,447,928, 3,551,155, 3,582,322 and 3,725,072; German Pat. Nos. 1,547,868, 2,057,941, 2,162,899, 2,163,812, 2,213,461, 2,219,917, 2,261,361 and 2,263,875; Japanese Patent Examined Publication No. 49-13576; and Japanese Patent O.P.I. Publication Nos. 48-29432, 48-66834, 49-10736, 49-122335, 50-28834, 50-132926, 55-144240 and 56-87041.

The magenta dye image forming couplers include 4- or 2-equivalent magenta dye image forming couplers of 5-pyrazolone type, pyrazolotriazole type, pyrazolinobenzoimidazole type, indazolone type or cyanoacetyl type. Those couplers are described in, for example, U.S. Pat. Nos. 2,600,788, 3,061,432, 3,062,653, 3,127,269, 3,311,476, 3,152,896, 3,419,391, 3,519,429, 3,555,318, 3,684,514, 3,705,896, 3,888,680, 3,907,571, 3,928,044, 3,930,861 and 3,933,500; Japanese Patent O.P.I. Publication Nos. 49-29639, 49-111631, 49-129538, 51-112341, 52-58922, 55-62454, 55-118034, 56-38643 and 56-135841; Japanese Patent Examined Publication Nos. 46-60479, 52-34937, 55-29421 and 55-35696; British Pat. No. 1,247,493; Belgian Pat. No.769,116; West German Pat. No. 2,156,111; Japanese Patent Examined Publication No. 46-60479: Japanese Patent O.P.I. Publication Nos. 59-125732, 59-228252, 59-162548, 59-171956, 60-33552 and 59-43659; West German Patent No. 1,070,030; U.S. Pat. No. 3,725,067; and so forth.

The cyan dye image forming couplers capable of using with the cyan couplers of the invention in combination include, typically 4- or 2-equivalent type cyan dye image forming couplers of phenol type or naphthol type. Those couplers are described in, for example, U.S. Pat. Nos. 2,306,410, 2,356,475, 2,362,598, 2,367,531, 2,369,929, 2,423,730, 2,474,293, 2,476,008, 2,498,466, 2,545,687, 2,728,660, 2,772,162, 2,895,826, 2,976,146, 3,002,836, 3,419,390, 3,446,622, 3,476,563, 3,737,316, 3,758,308 and 3,839,044; British Pat. Nos. 478,991, 945,542, 1,084,480, 1,377,233, 1,388,024 and 1,543,040; Japanese Patent O.P.I. Publication Nos. 47-37425, 50-10135, 50-25228, 50-112038, 50-117422, 50-130441, 51-6551, 51-37647, 51-51828, 51-108841, 53-109630, 54-48237, 54-66129, 54-131931, 55-32071, 59-146050, 59-31953 and 60-117249; and so forth.

It is desirable that those dye image forming couplers are to have a group having not less than 8 carbon atoms in the molecule thereof so as to make non-diffusible the coupler so called a ballast group. Those dye image forming couplers may be of the 4-equivalent type in which 4 silver ions are to be so reduced as to form one molecular dye, or may be of the 2-equivalent type in which only two silver ions are to be reduced, either.

The cyan couplers, which may be used in combination with the cyan couplers of the invention, include those represented by the following Formulas PC-I and PC-II.

Formula PC-I

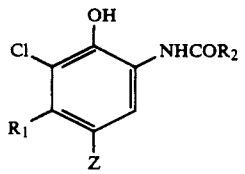

wherein $R_1$ represents an alkyl group having 2 to 6 carbon atoms; $R_2$ represents a ballast group; and Z represents a hydrogen atom or either an atom or a group capable of splitting off upon reaction with the oxidized product of a color developing agent.

The alkyl groups represented by $R_1$ may be straight-chained or branched and they include those each having a substituent.

The ballst groups reprsented by $R_2$ each are an organic group having such size and shape as are capable of providing coupler molecules with a satisfactory bulk so as not to make the couplers substantially diffusible from a layer applied with the coupler into the other layers. The preferable ballast groups include those having the following Formula.

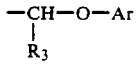

wherein $R_3$ represents an alkyl group having 1 to 12 carbon atoms, and Ar represents an aryl group such as a phenyl group and so forth, which also includes those having substituents.

Next, some typical examples of the couplers represented by Formula PC-I, to which the invention shall not be limited.

Formula PC-I

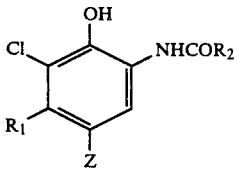

| Exemplified compound No. | $R_1$ | Z | $R_2$ |
|---|---|---|---|
| PC-I-1 | $-C_2H_5$ | $-Cl$ | 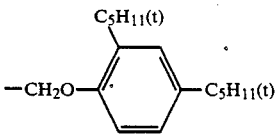 |
| PC-I-2 | $-C_2H_5$ | 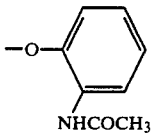 | 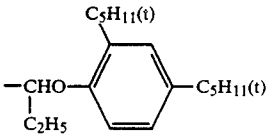 |
| PC-I-3 | $-C_3H_7(i)$ | $-Cl$ | 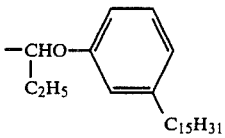 |
| PC-I-4 | $-C_2H_5$ | $-Cl$ | 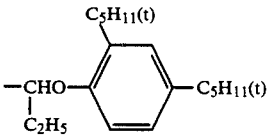 |
| PC-I-5 | $-C_4H_9$ | $-F$ | 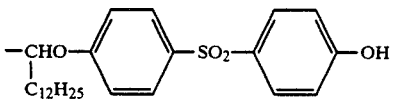 |
| PC-I-6 | $-C_2H_5$ | $-F$ | 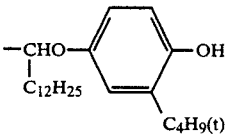 |

-continued
Formula PC-I
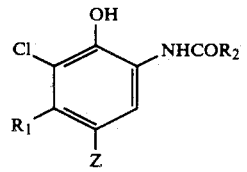
| Exemplified compound No. | $R_1$ | Z | $R_2$ |
|---|---|---|---|
| PC-I-7 | $-C_2H_5$ | $-Cl$ | 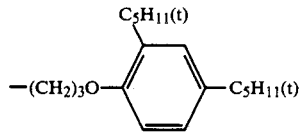 |
| PC-I-8 | $-C_2H_5$ | $-Cl$ | 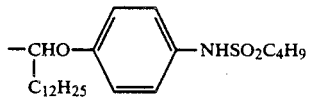 |
| PC-I-9 | $-C_2H_5$ | $-Cl$ | 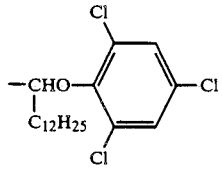 |
| PC-I-10 | $-C_3H_7(i)$ | $-Cl$ | $-C_{18}H_{37}$ |
| PC-I-11 | $-C_6H_{13}$ | $-Cl$ | 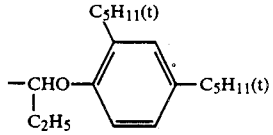 |
| PC-I-12 | $-C_3H_7$ | $-Cl$ | 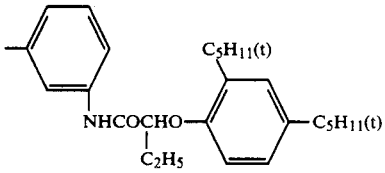 |
| PC-I-13 | $-(CH_2)_2NHCOCH_3$ | $-Cl$ | 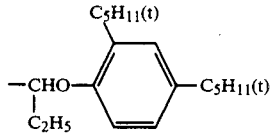 |
| PC-I-14 | $-(CH_2)_2OCH_3$ | $-Cl$ | 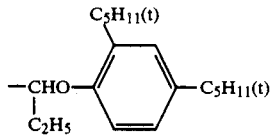 |
| PC-I-15 | $-C_2H_5$ | $-Cl$ | 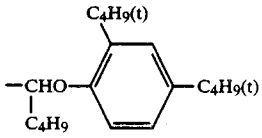 |
| PC-I-16 | $-C_4H_9(t)$ | $-O(CH_2)_2-SO_2CH_3$ | 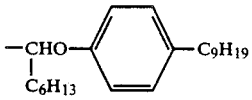 |

-continued

Formula PC-I

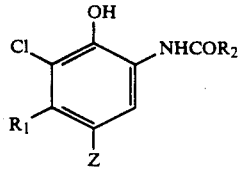

| Exemplified compound No. | $R_1$ | Z | $R_2$ |
|---|---|---|---|
| PC-I-17 | $-C_2H_5$ | $-Cl$ | 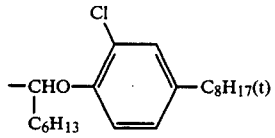 |
| PC-I-18 | $-C_2H_5$ | $-Cl$ | 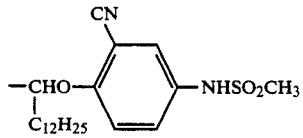 |
| PC-I-19 | $-C_2H_5$ | $-Cl$ | 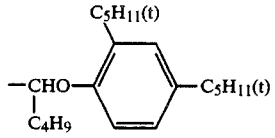 |

The cyan couplers including the aboVe-given couplers applicable to the invention are exemplified in, for example. Japanese Patent Examined Publication No. 49-11572, Japanese Patent O.P.I. Publication Nos. 61-3242, 61-9562, 61-9653, 61-39045, 61-50136, 61-99141 and 61-105545, and so forth.

The cyan dye forming couplers represented by the foregoing Formula PC-I may be used in an amount of, usually, from $1\times10^{-3}$ mol to 1 mol and, more preferably, from $1\times10^{-2}$ mol to $8\times10^{-1}$ mol per mol of silver halides used.

Formula PC-II

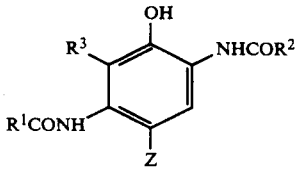

wherein $R^1$ represents a group of alkyl or aryl: $R^2$ represents a group of alkyl, cycloalkyl, aryl or heterocyclic; $R^3$ represents an atom of hydrogen or halogen, or a group of alkyl or alkoxy, provided that $R^3$ and $R^1$ are allowed to associate with each other so as to complete a ring; and Z represents a hydrogen atom or a group capable of splitting off upon reaction with the oxidized product of an aromatic primary amine type color developing agent.

In the cyan couplers represented by the above-given formula, the alkyl groups represented by $R^1$ are preferable to have 1 to 32 carbon atoms, and they may be straight-chained or branched. They also include those having substituents.

The aryl groups represented by $R^1$ are preferably a phenyl group. The aryl groups also include those having substituents.

The alkyl groups represented by $R^2$ are preferable to have 1 to 32 carbon atoms and they may be straight-chained or branched. They also include those having substituents.

The cycloalkyl groups represented by $R^2$, are preferable to have 3 to 12 carbon atoms. They also include those having substituents.

For the aryl groups represented by $R^2$, a phenyl group is preferable. The aryl groups also include those having substituents.

For the heterocyclic groups represented by $R^2$, those having 5 to 7 membered ring may preferably be used. They also include those having substituents and they are further allowed to be condensed.

$R^3$ represents an atom of hydrogen or halogen, or a group of alkyl or alkoxy, provided that the alkyl and alkoxy groups include those having substituents. $R^3$ is preferably a hydrogen atom.

For the rings formed by $R^1$ and $R^3$ in combination, a 5- or 6-membered rings is preferable to be used and the following examples may be given.

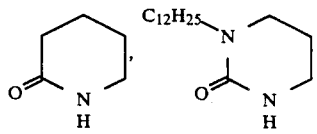

In Formula PC-II, the groups represented by Z, which are capable of splitting off upon reaction with the oxidized product of a color developing agent, include, for example, a halogen atom, a group of alkoxy, aryloxy, acyloxy, sulfonyloxy, acylamino, sulfonylamino, alkoxycarbonyloxy, aryloxycarbonyloxy or imido, or the like, each also including those having substituents. Among the groups, the preferable ones are a halogen atom and a group of aryloxy or alkoxy.

Among the above-given cyan couplers, the particularly preferable ones are those represented by the following Formula PC-II-A.

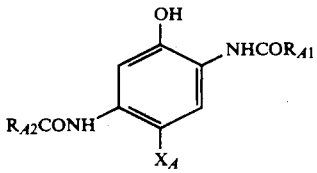

Formula PC-II-A wherein $R_{A1}$ represents a phenyl group substituted with at least one halogen atom, provided that the phenyl groups include those further having other substituents than the halogen atoms: $R_{A2}$ is synonymous with $R^1$ denoted in the foregoing Formula PC-II: and $X_A$ represents an aryloxy or alkoxy group, provided that the groups also include those having substituents.

Now, some typical examples of the cyan couplers represented by Formula PC-II will be give below.

Formula PC-II

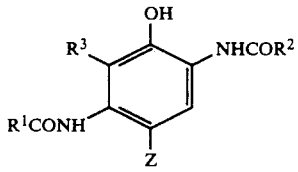

| Exemplified compound No. | $R^2$ | $R^1$ | $R^3$ | Z |
|---|---|---|---|---|
| PC-II-1 | $-(CF_2)_4H$ | 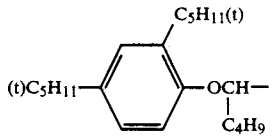 | H | —Cl |
| PC-II-2 | 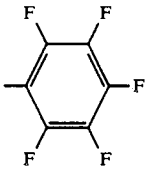 | 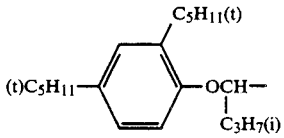 | H | —Cl |
| PC-II-3 | 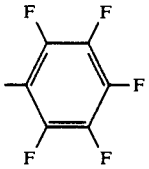 | 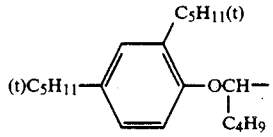 | H | —Cl |
| PC-II-4 | 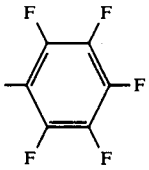 | $C_{16}H_{33}$— | —Cl | —Cl |
| PC-II-5 | 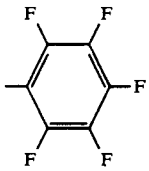 | 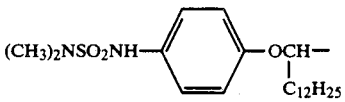 | H | 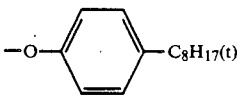 |
| PC-II-6 | 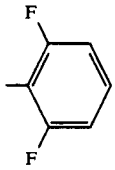 | 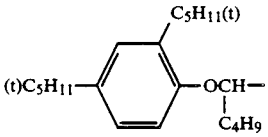 | H | H |

-continued
Formula PC-II
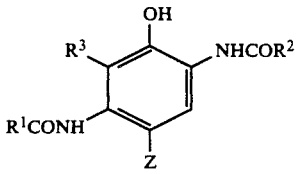
| Exemplified compound No. | $R^2$ | $R^1$ | $R^3$ | Z |
|---|---|---|---|---|
| PC-II-7 | 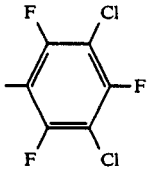 | 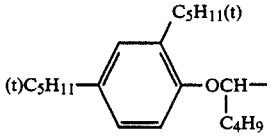 | H | —Cl |
| PC-II-8 | 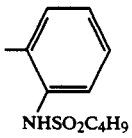 | 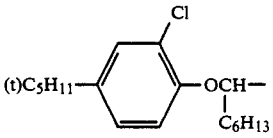 | H | —Cl |
| PC-II-9 | 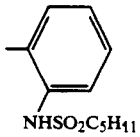 | 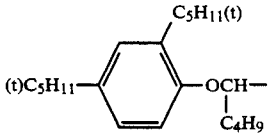 | H | 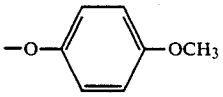 |
| PC-II-10 | 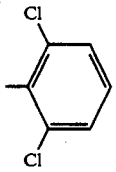 | 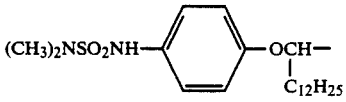 | H | —Cl |
| PC-II-11 | 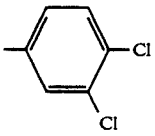 | 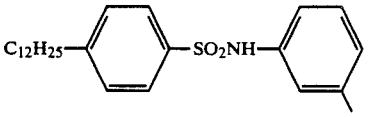 | H | —Cl |
| PC-II-12 | 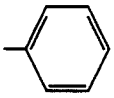 | 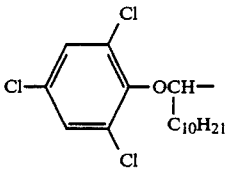 | H | $-OCH_2CONHC_3H_7$ |
| PC-II-13 | 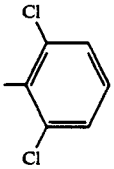 | 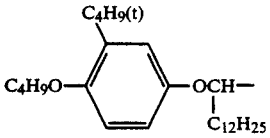 | H | —Cl |
| PC-II-14 | 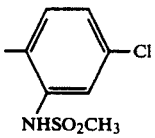 | 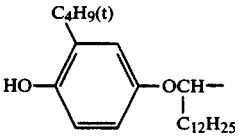 | H | —Cl |

-continued
Formula PC-II
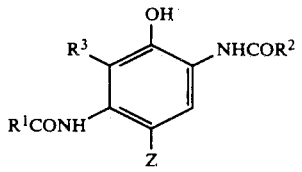
| Exemplified compound No. | $R^2$ | $R^1$ | $R^3$ | Z |
|---|---|---|---|---|
| PC-II-15 | 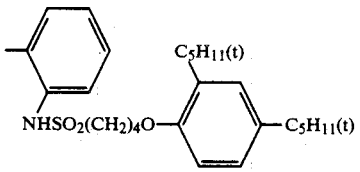 | 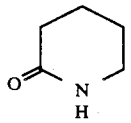 | | —Cl |
| PC-II-16 | 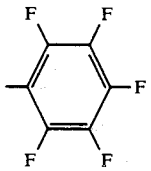 | 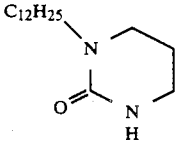 | | —Cl |
| PC-II-17 | 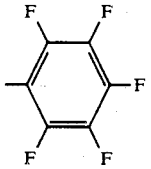 | 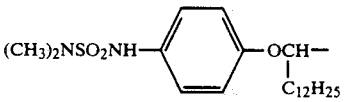 | H | —Cl |
| PC-II-18 | 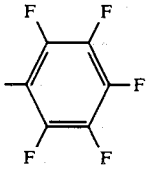 | 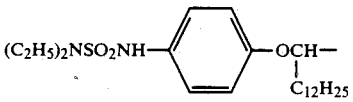 | H | —Cl |
| PC-II-19 | 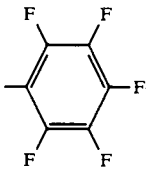 | 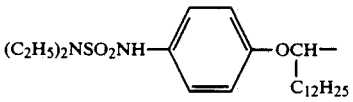 | H | 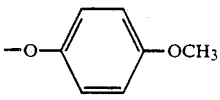 |
| PC-II-20 | 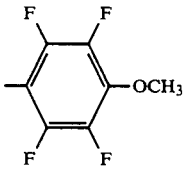 | 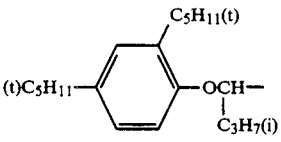 | H | —Cl |
| PC-II-21 | 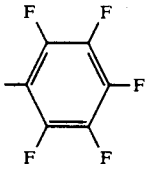 | 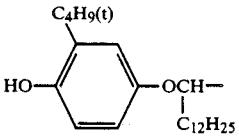 | H | —Cl |

-continued
Formula PC-II
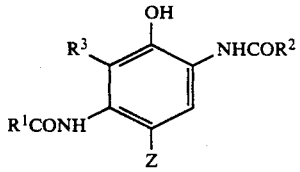
| Exemplified compound No. | $R^2$ | $R^1$ | $R^3$ | Z |
|---|---|---|---|---|
| PC-II-22 | 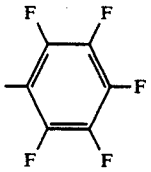 | 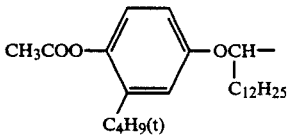 | H | —Cl |
| PC-II-23 | 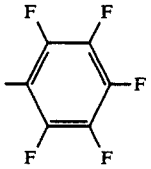 | 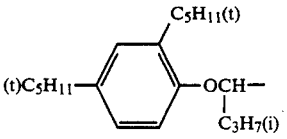 | H | 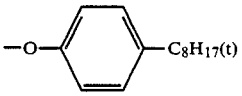 |
| PC-II-24 | 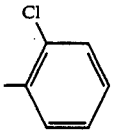 | 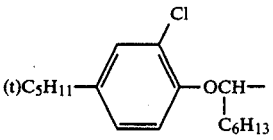 | H | —Cl |
| PC-II-25 | 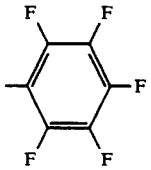 | 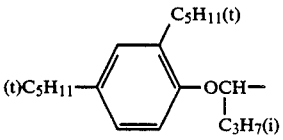 | H | $-OCH_2CONH(CH_2)_2OCH_3$ |
| PC-II-26 | 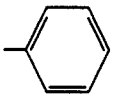 | 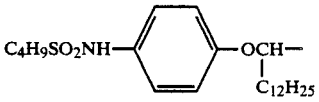 | H | —Cl |
| PC-II-27 | $-C_3F_7$ | 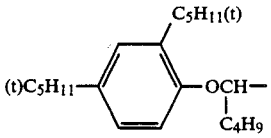 | H | H |
| PC-II-28 | $-C_3F_7$ | 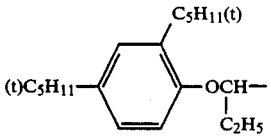 | H | H |
| PC-II-29 | 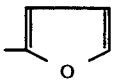 | 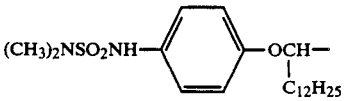 | H | Cl |
| PC-II-30 | 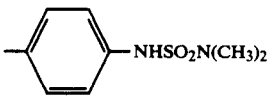 | 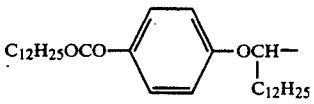 | $CH_3O$ | Cl |

-continued

Formula PC-II

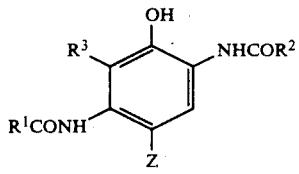

| Exemplified compound No. | $R^2$ | $R^1$ | $R^3$ | Z |
|---|---|---|---|---|
| PC-II-31 | 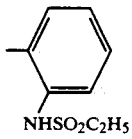 | 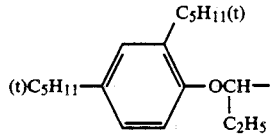 | H | Cl |

Further examples of the above-given cyan couplers include 2,5-diacylamino type cyan couplers described in, for example, Japanese Patent O.P.I. Publication No. 62-178962, pp. 26–35; Japanese Patent O.P.I. publication No. 60-225155, in the lower left column on p.7 through the lower right columnin p. 10; Japanese Patent O.P.I. Publication No. 60-222853, in the upper left column on p.6 through the lower right column on p. 8; and Japanese Patent O.P.I. Publication No. 59-185335, in the upper left column on p. 6 through the lower righr column on p. 8; and Japanese Patent O.P.I, Publication No. 59-185335, in the upper left column on p. 6 through the upper left column on p. 9. The couplers may be synthesized in the methods described in the above-given patent specifications.

The cyan couplers are added into a red light-sensitive silver halide emulsion layer. An amount of the cyan couplers added thereto is, preferably, from $2\times10^{-3}$ to $8\times10^{-1}$ mol per mol of silver halides used and, more preferably, from $1\times10^{-2}$ to $5\times10^{-1}$ mol.

The yellow couplers applicable to the color photographic light-sensitive materials of the invention include, preferably, a high-speed reaction type yellow couplers each having a relative coupling reaction rate of not less than 0.3 and, more preferably, yellow couplers each having a relative coupling reaction rate of not less than 0.5.

A coupling reaction rate of a yellow coupler may be determined in terms of relative values, in the following manner. Two kinds of couplers M and N each capable of forming the different dyes which may clearly be separated from each other are added into a silver halide emulsion, and a color development is so carried out as to obtain a colored image. The contents of the dyes in the image are measured, so that the relative values may be determined.

When denoting a maximum rate of coupler M and a color density thereof in an intermediate stage by DMmax and DM, and those of coupler N by DNmax and DN, respectively, a ratio of reaction activities of the both couplers, RM/RN, may be expressed by the following formula.

$$RM/RN = \frac{\log\left(1 - \frac{DM}{DM\text{max}}\right)}{\log\left(1 - \frac{DN}{DN\text{max}}\right)}$$

In other words, a silver halide emulsion containing mixed couplers is exposed stepwise to light and color-developed so as to obtain several DMs and DNs, respectively. Some combinations of the DMs and DNs are plotted in terms of $$\log\left(1 - \frac{DM}{DM\text{max}}\right) \text{and} \log\left(1 - \frac{DN}{DN\text{max}}\right)$$

on a rectangular-coordinate graph to obtain a straight gradient from which a coupling activity ratio RM/RN may be obtained.

With using a certain coupler N, when a variety of couplers are treated as mentioned above to obtain the values of RM/Rn, respectively, the relative coupling reaction rates may then be obtained.

In the invention, the RM/RN values may be obtained when using the following coupler as the above-mentioned coupler N.

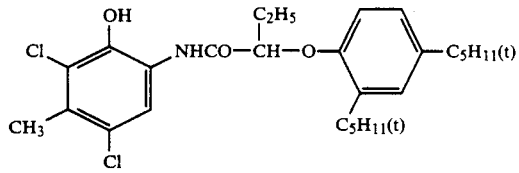

About the high-speed reaction type yellow couplers preferably applicable to the invention, the amount added shall not be limitative, but it should be preferable from $2\times10^{-3}$ $5\times10^{-1}$ mol per mol of silver contained in a blue-sensitive silver halide emulsion layer and, more preferably, from $1\times10^{-2}$ to $5\times10^{-1}$.

High-speed reaction type yellow couplers preferably applicable to the invention are represented by the following Formula Y.

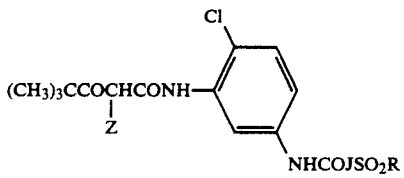

Formula Y wherein Z represents a substituent capable of splitting off upon reaction with the oxidized product of a color developing agent; J represents an alkylene group: and R represents an alkyl or aryl group.

Now, some typical examples of the high-speed reaction type yellow couplers preferably applicable to the invention will be given below, and to which, however, the invention shall not be limited.

Exemplified Compound (Y-1)

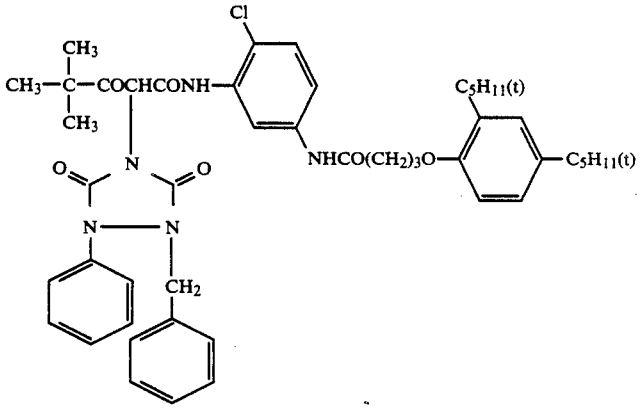

(RM/RN = 0.80)

(Y-2)

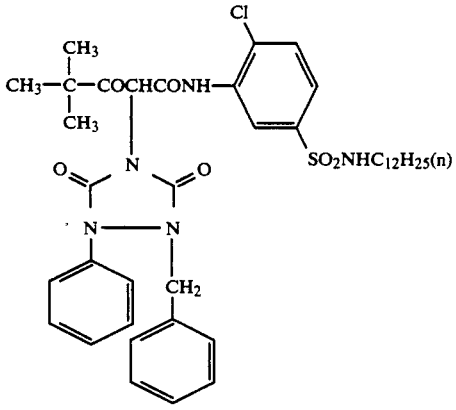

(RM/RN = 1.01)

(Y-3)

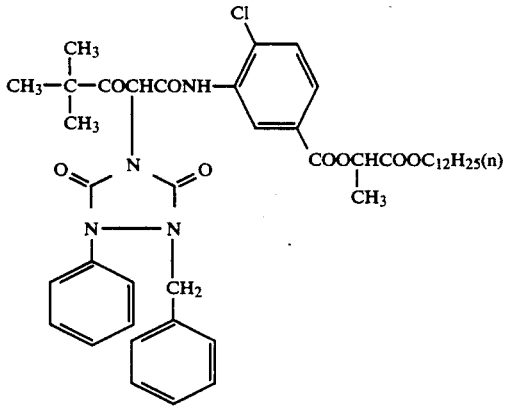

(RM/RN = 1.45)

-continued
Exemplified Compound
(Y-4)
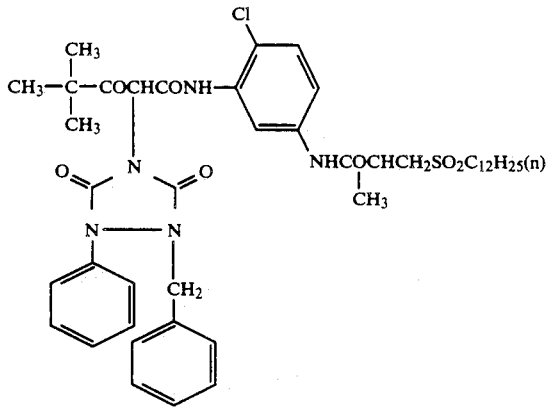
(RM/RN = 0.95)
(Y-5)
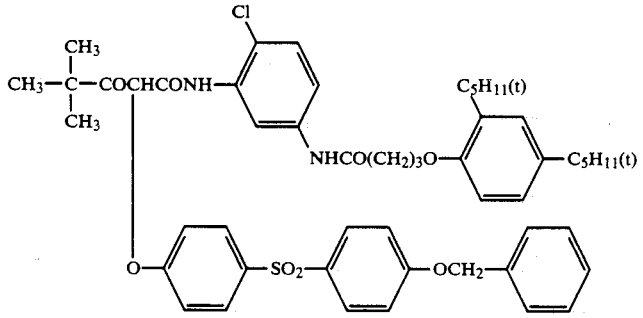
(RM/RN = 0.65)
(Y-6)
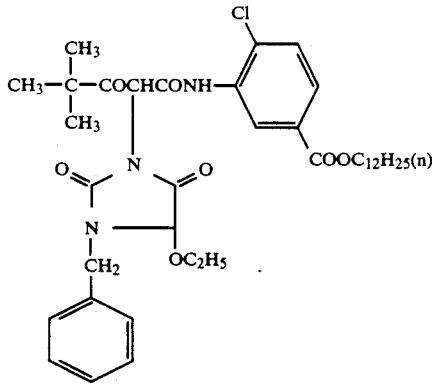
(RM/RN = 1.48)

-continued
Exemplified Compound
(Y-7)
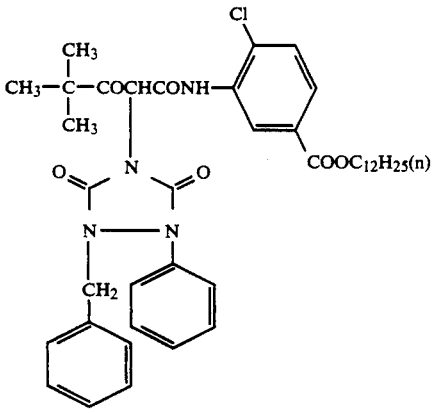
(RM/RN = 1.32)
(Y-8)
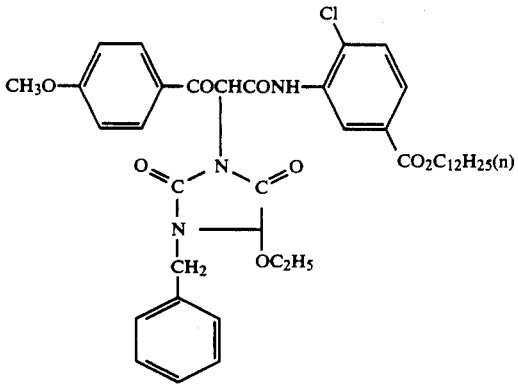
(RM/RN = 1.48)
(Y-9)
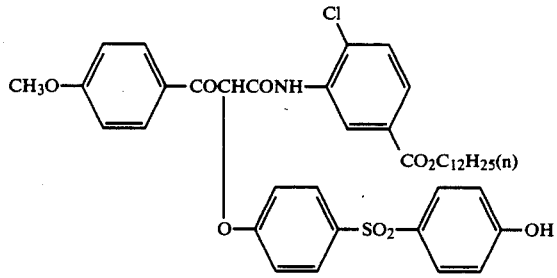
(RM/RN = 1.27)
(Y-10)
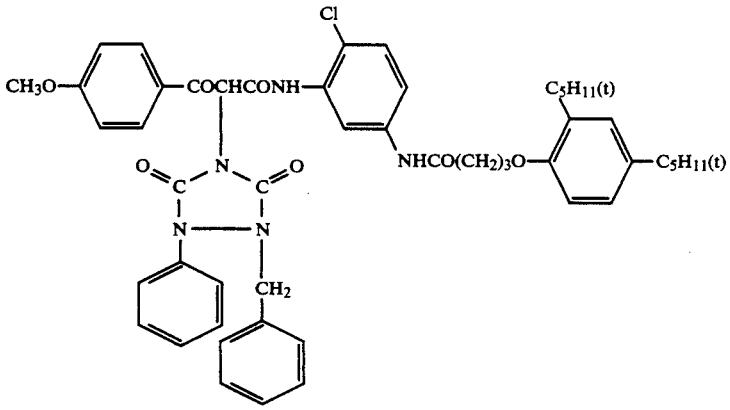
(RM/RN = 0.99)

-continued
Exemplified Compound
(Y-11)
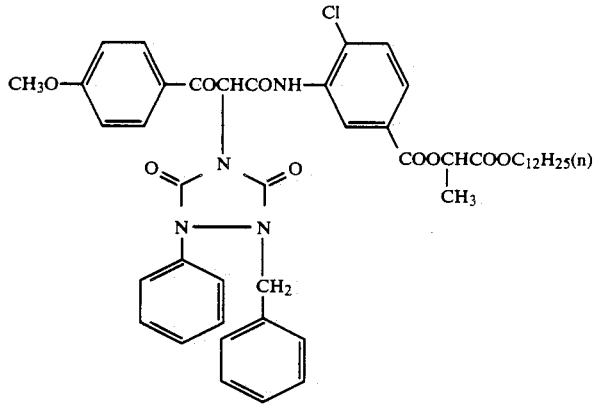
(RM/RN = 1.40)
(Y-12)
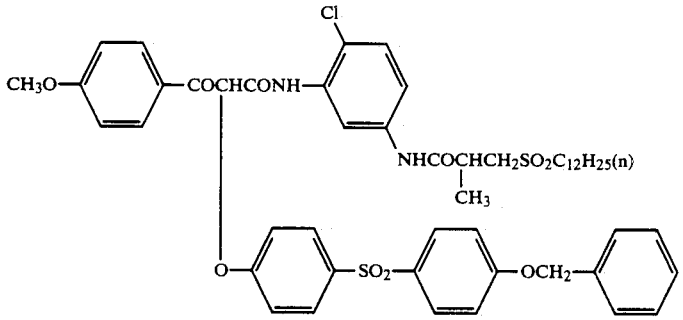
(RM/RN = 0.88)
(Y-13)
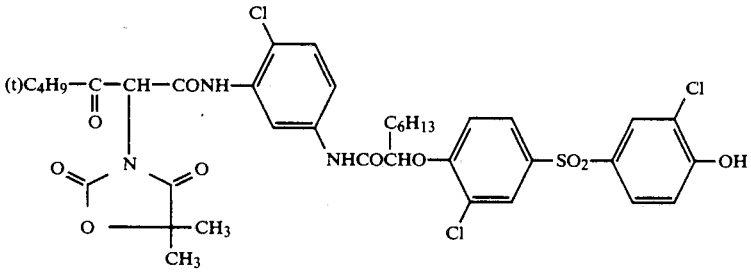
(RM/RN = 0.66)
(Y-14)
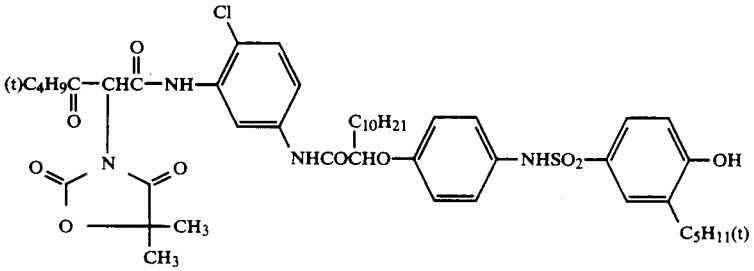
(RM/RN = 0.71)

-continued
Exemplified Compound
(Y-15)
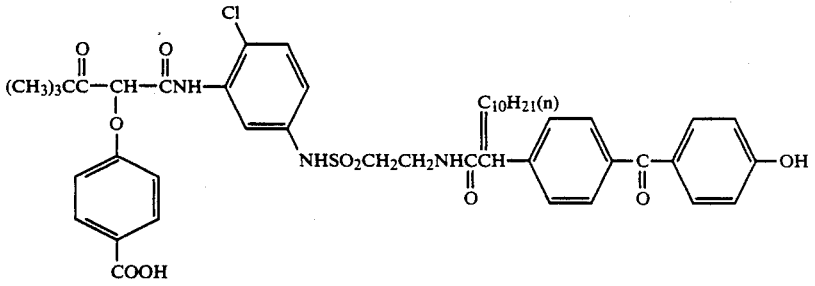
(RM/RN = 0.92)
(Y-16)
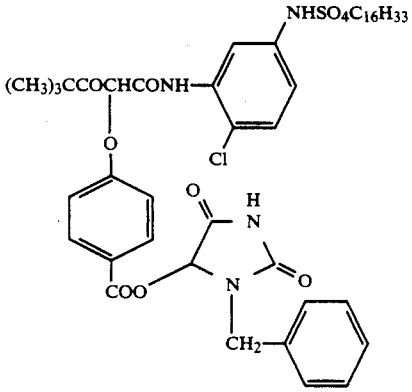
(RM/RN = 0.80)
(Y-17)
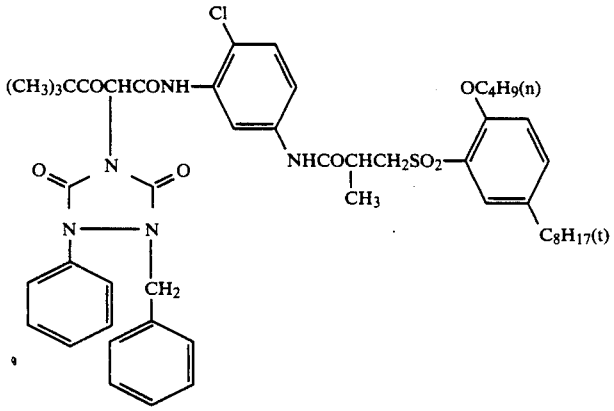
(RM/RN = 0.93)
(Y-18)
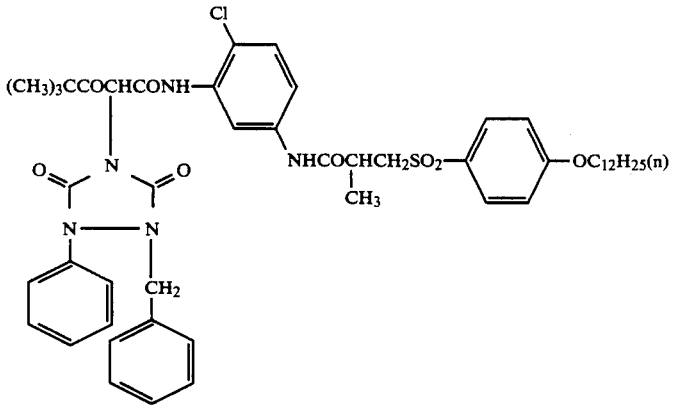
(RM/RN = 0.90)

-continued
Exemplified Compound
(Y-19)
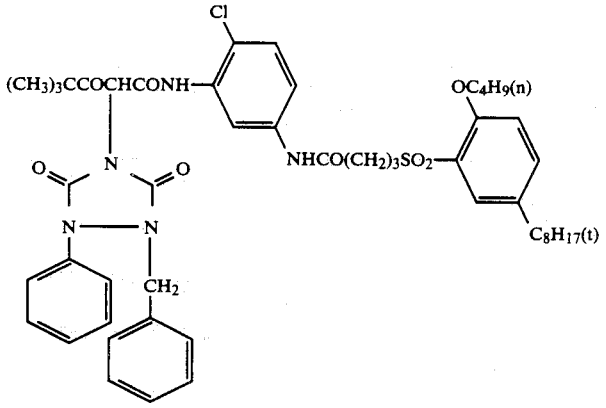
(RM/RN = 0.95)
(Y-20)
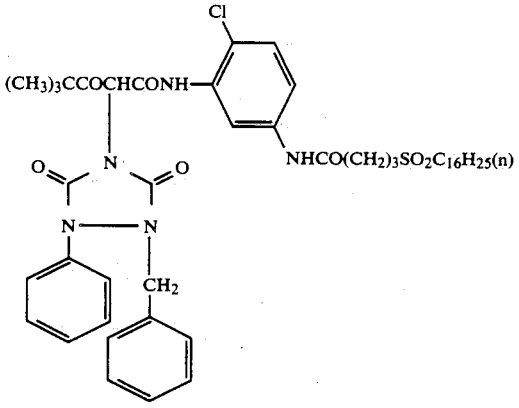
(RM/RN = 1.03)
(Y-21)
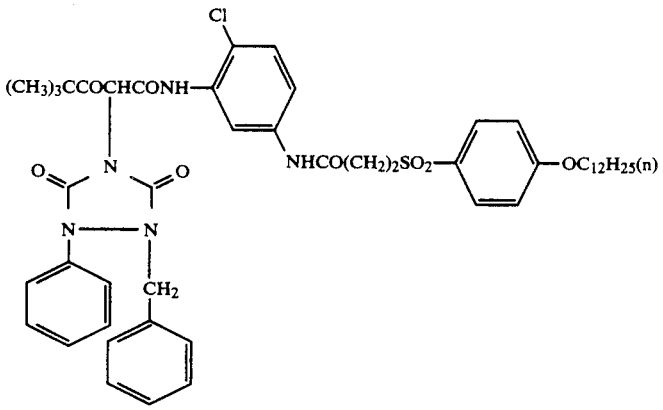
(RM/RN = 0.97)

-continued

Exemplified Compound (Y-22)

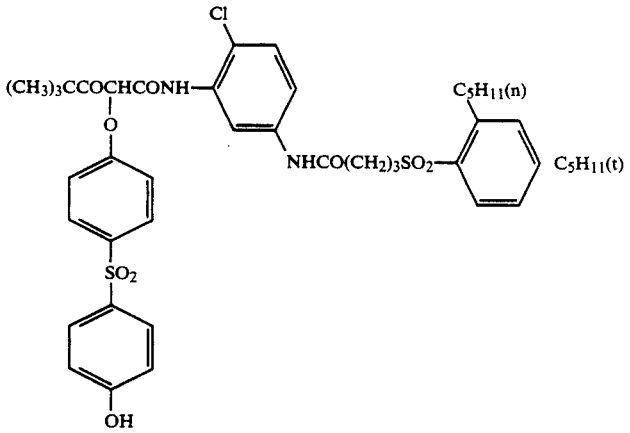

(RM/RN = 1.08)

(Y-23)

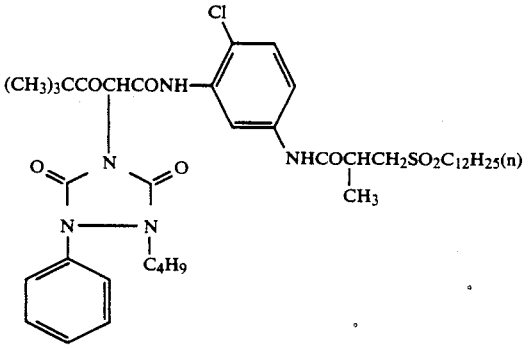

(RM/RN = 0.95)

(Y-24)

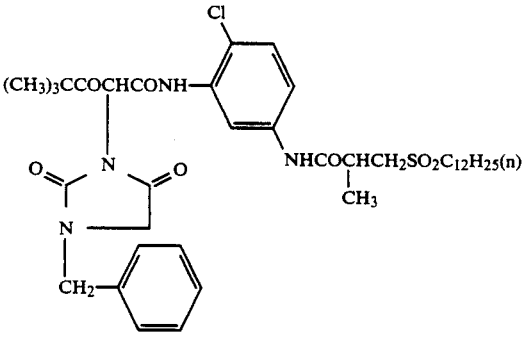

(RM/RN = 1.02)

The magenta couplers preferably applicable to the invention include, for example, those represented by the following Formula M-I.

Formula M-I

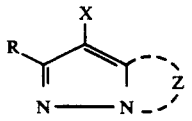

wherein Z represents a group consisting of non-metal atoms necessary to complete a nitrogen-containing heterocyclic ring, provided that the rings completed by the Z are allowed to have substituents;

X represents a hydrogen atom or a group capable of splitting off upon reaction with the oxidized product of a color developing agent; and R represents a hydrogen atom or a substituent.

There is no special limitation to the substituents represented by R, however, they include, typically, a group of alkyl, aryl, anilino, acylamino, sulfonamido, alkylthio, arylthio, alkenyl, cycloalkyl or the like and, besides the above, a halogen atom and a group of cycloalkenyl, alkinyl, heterocyclic, sulfonyl, sulfinyl, phosphonyl, acyl, carbamoyl, sulfamoyl, cyano, alkoxy, aryloxy, heterocyclic oxy, siloxy, acyloxy, carbamoyloxy, amino, alkylamino, imido, ureido, sulfamoylamino, alkoxycarbonylamino, aryloxycarbonylamino, alkoxycarbonyl, aryloxycarbonyl or heterocyclic thio, and, further, a spiro-compound residual group, a bridged hydrocarbon compound residual group and so forth.

The alkyl groups represented by R include, preferably, those having 1 tO 32 carbon atoms, and they may be straight-chained or branched.

The aryl groups represented by R include, preferably, a phenyl group.

The acylamino groups represented by R include, for example, a group of alkylcarbonylamino, arylcarbonylamino or the like.

The sulfonamido groups represented by R include, for example, a group of alkylsulfonylamino, arylsulfonylamino or the like.

The alkyl and aryl components of the alkylthio and arylthio groups each represented by R include the alkyl and aryl groups each represented by the R.

The alkenyl groups represented by R include, for example, those having 2 to 32 carbon atoms; the cycloalkyl groups include those having 3 to 12 carbon atoms and, preferably, those having 5 to 7 carbon atoms. The alkenyl groups may further be straight-chained or branched.

The cycloalkenyl groups represented by R include, for example, those having 3 to 12 carbon atoms and, preferably, those having 5 to 7 carbon atoms.

The sulfonyl groups represented by R include, for example, a group of alkylsulfonyl, arylsulfonyl or the like;

The sulfinyl groups include, for example, a group of alkylsulfinyl, arylsulfinyl or the like;

The Phosphonyl groups include, for example, a group of alkylphosphonyl, alkoxyphosphonyl, aryloxyphosphonyl, arylphosphonyl or the like;

The acyl groups include, for example, a group of alkylcarbonyl, arylcarbonyl or the like;

The carbamoyl groups include, for example, a group of alkylcarbamoyl, arylcarbamoyl or the like;

The sulfamoyl groups include, for example, a group of alkylsulfamoyl, arylsulfamoyl or the like;

The acyloxy groups include, for example, a group of alkylcarbonyloxy, arylcarbonyloxy or the like;

The carbamoyloxy groups include, for example, a group of alkylcarbamoyloxy, arylcarbamoyloxy or the like;

The ureido groups include, for example, a group of alkylureido, arylureido or the like;

The sulfamoylamino groups include, for example, a group of alkylsulfamoylamino, arylsulfamoylamino or the like;

The heterocyclic groups include, preferably, those having a 5- to 7-membered ring, such as a group of 2-furyl, 2-thienyl, 2-pyrimidinyl, 2-benzothiazolyl or the like;

The heterocyclic-oxy groups include, preferably, those having a 5- to 7-membered heterocyclic ring, such as a group of 3,4,5,6-tetrahydropyranyl-2-oxy, 1-phenyltetrazole-5-oxy or the like;

The heterocyclic-thio groups include, preferably, 5- to 7-membered heterocyclic thio groups such as a group of 2-pyridylthio, 2-benzothiazolylthio, 2,4-diphenoxy-1,3,5-triazole-6-thio or the like;

The siloxy groups include, for example, a group of trimethylsiloxy, triethylsiloxy, dimethylbutylsiloxy or the like;

The imido groups include, for example, a group of succinimido, 3-heptadecylsuccinimido, phthalimido, glutarimido or the like;

The spiro-compound residual groups include, for example, a spito[3.3]heptane-1-yl group and so forth;

The bridged hydrocarbon compound residual groups include, for example, bicyclo[2.2.1]heptane-1-yl, tricyclo[3.3.1.1$^{3,7}$]decane-1-yl, 7,7-dimethyl-bicyclo[2.2.1.-]heptane-1-yl and so forth;

The groups represented by X, which are capable of splitting off upon reaction with the oxidized product of a color developing agent, include, for example, halogen atoms such as that of chlorine, bromine, fluorine or the like, and a group of alkoxy, aryloxy, heterocyclic-oxy, acyloxy, sulfonyloxy, alkoxycarbonyloxy, aryloxycarbonyl, alkyloxalyloxy, alkoxyoxalyloxy, alkylthio, arylthio, heterocyclic-thio, alkyloxythiocarbonylthio, acylamino, sulfonamido, nitrogen-containing heterocyclic ring to which an N atom bonds, alkyloxycarbonylamino, aryloxycarbonylamino, carboxyl,

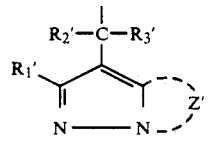

wherein $R'_1$ is synonymous with the foregoing R; Z' is synonymous with the foregoing Z; and $R'_2$ and $R'_3$ each represent a hydrogen atom, a group of aryl, alkyl or heterocyclic or the like. Among those groups, a halogen atom is rather preferable and chlorine atom is particularly preferable; and The nitrogen-containing heterocyclic rings completed by Z or Z' include, for example, a ring of pyrazole, imidazole, triazole, tetrazole or the like, and the substituents which the above-mentioned rings are allowed to have include, for example, those given for the foregoing R.

The magenta couplers represented by the foregoing Formula M-I may further concretely be represented by the following Formulas M-Ia through M-If, for example.

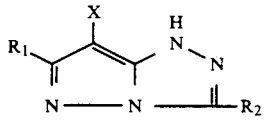

Formula M-Ia

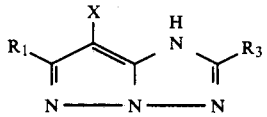

Formula M-Ib

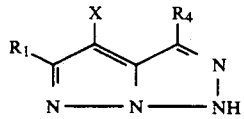

Formula M-Ic

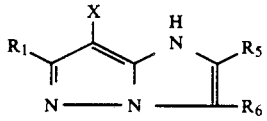

Formula M-Id

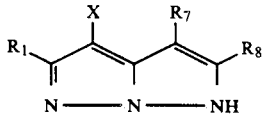

Formula M-Ie

-continued

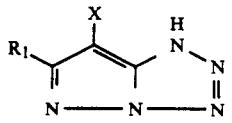

Formula M-If

In the above-given Formulas M-Ia through M-If, $R_1$ through $R_8$ and X are synonymous with The foregoing R and X, respectively.

Among the magenta couplers represented by Formula M-I, those represented by the following Formula M-Ig are more preferable.

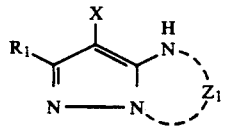

Formula M-Ig wherein $R_1$, X and $Z_1$ are synonymous with the R, X and Z each denoted in the foregoing Formula M-I, respectively.

Among the magenta couplers represented by Formulas M-Ia through M-If, those represented by the Formula M-Ia are particularly preferable.

For the substituents represented by R and $R_1$ on the foregoing heterocyclic rings, those represented by the following Formula M-Ih are most preferable.

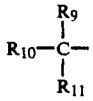

Formula M-Ih wherein $R_9$, $R_{10}$ and $R_{11}$ are synonymous with the foregoing R.

Two out of the $R_9$, $R_{10}$ and $R_{11}$, $R_9$ and $R_{10}$ for example, are allowed to bond together so as to complete a saturated or unsaturated ring such as a cycloalkane, cycloalkene or heterocyclic ring and to which $R_{11}$ is further allowed to bond so as to constitute a bridged hydrocarbon compound residual group.

In Formula M-Ih, the preferable cases are as follows: i. A case where at least two out of $R_9$ through $R_{11}$ are alkyl groups; and ii. Another case where one out of $R_9$ through $R_{11}$, $R_{11}$ for example, is a hydrogen atom, and the other two, $R_9$ and $R_{10}$, bond to each other so as to complete a cycloalkyl together with a root carbon atom.

In the above case i, it is more preferable that two out of $R_9$ through $R_{11}$ are alkyl groups and another one is a hydrogen atom or an alkyl group.

For the substituents which the rings completed by Z in Formula M-I and the rings completed by $Z_1$ in Formula M-Ig are allowed to have and for the $R_2$ through $R_8$ denoted in Formulas M-Ia through M-Ie, those represented by the following Formula M-Ii are preferable.

Formula M-Ii $$-R^1-SO_2-R^2$$

wherein $R^1$ represents an alkylene group; and $R^2$ represents an alkyl, cycloalkyl or aryl group.

The alkylene groups represented by $R^1$ are those having preferably not less than 2 carbon atoms in the straight-chained portion and, more preferably 3 to 6 carbon atoms therein. Those alkylene groups are regardless of the straight-chained or branched.

The cycloalkyl groups represented by $R^2$ are preferably those having a 5- or 6-membered ring.

Now, the typical examples of the magenta couplers represented by Formula M-I, which are preferably applicable to the invention, will be given below. However, the invention shall not be limited thereto.

1

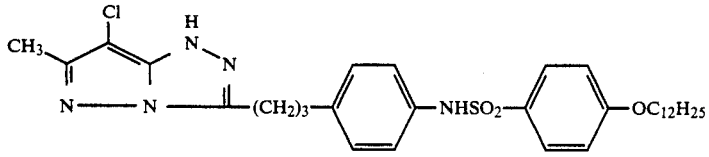

2

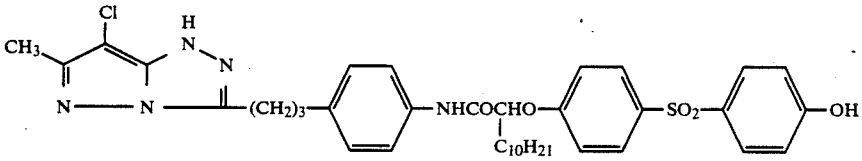

3

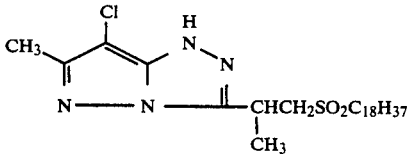

4

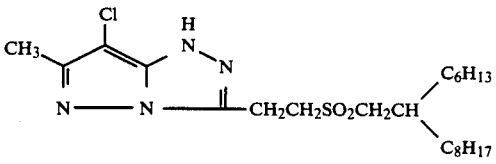

-continued
5
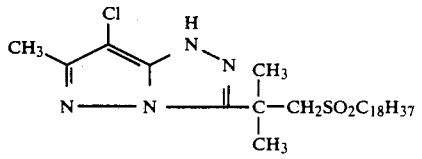
6
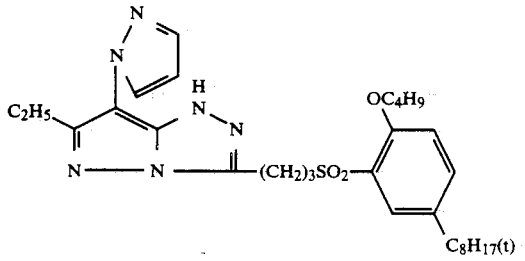
7
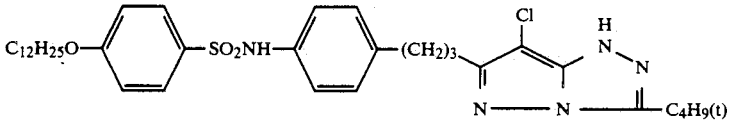
8
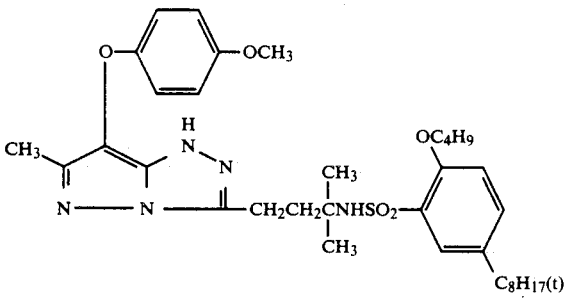
9
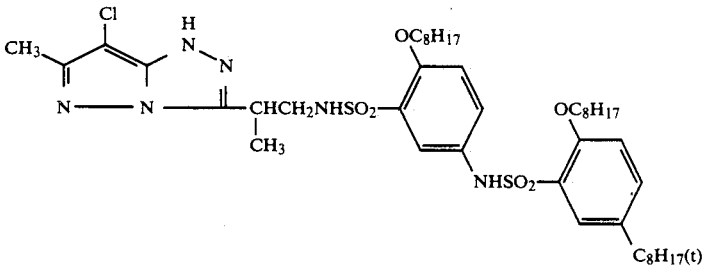
10
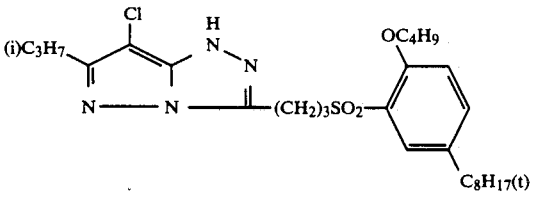
11
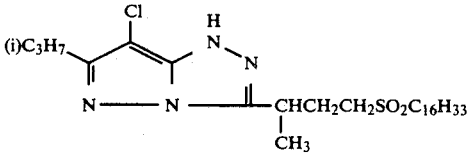

-continued

12

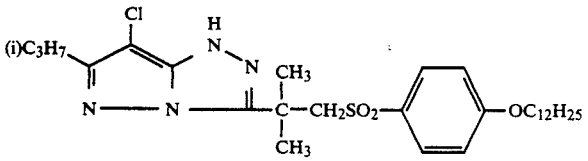

10

The magenta couplers represented by the following Formula M-II may preferably be used independently or in combination with the couplers represented by the foregoing Formula M-I.

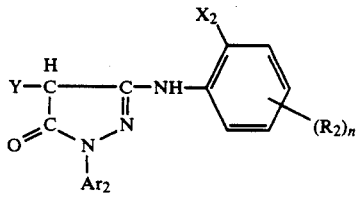

Formula M-II wherein $Ar_2$ represents an aryl group: $X_2$ represents a halogen atom, an alkoxy group or an alkyl group: $R_2$ represents a group substitutable to a benzene ring: n is an integer of 1 or 2, provided that each of $R_2$ may be the same with or the different from each other when n is 2: and Y represents a group capable of being split off upon coupling reaction with the oxidized products of an aromatic primary amine type color developing agent.

In Formula M-II, the groups represented by Y capable of being split off upon coupling reaction with the oxidized products of an aromatic primary amine type color developing agent include, for example, a halogen atom or a group of alkoxy, aryloxy, acyloxy, arylthio, alkylthio or

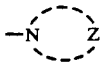

in which Z represents a group consisting of the atoms necessary to complete a 5- or 6-member ring containing an atom selected from a group consisting of carbon atom, oxygen atom, nitrogen atom and sulfur atom, together with a nitrogen atom, and so forth; provided, however, that Y does not represent a hydrogen atom therein.

The concrete samples of the groups represented by Y will be given below.

Halogen atoms: An atom of chlorine, bromine, fluorine or the like;

Alkoxy groups: a group of ethoxy, benzyloxy, methoxyethylcarbamoylmethoxy, tetradecylcarbamoylmethoxy or the like:

Aryloxy groups: a group of phenoxy, 4-methoxyphenoxy, 4-nitrophenoxy or the like;

Acyloxy groups: a group of acetoxy, myristoyloxy, benzoyloxy or the like;

Arylthio groups: a group of phenylthio, 2-butoxy-5-octylphenylthio, 2,5-dihexyloxyphenylthio or the like;

Alkylthio groups: a group of methylthio, octylthio, hexadecylthio benzylthio 2-(diethylamino)ethylthio, ethoxycarbonylmethylthio, ethoxydiethylthio, phenoxyethylthio or the like; and

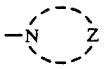

groups: a group of pyrazolyl, imidazolyl, triazolyl, tetrazolyl or the like;

Now, the typical examples of the magenta couplers represented by the foregoing Formula M-II. However, the invention shall not be limited thereto.

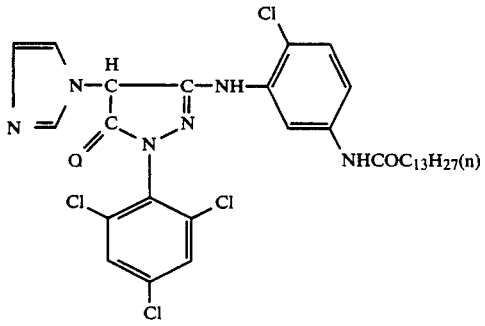

-continued
(b-2)
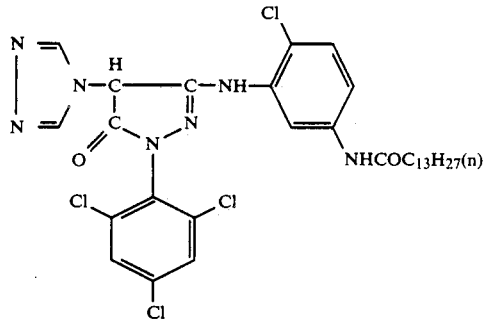
(b-3)
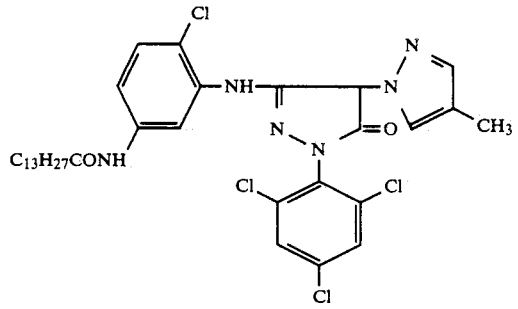
(b-4)
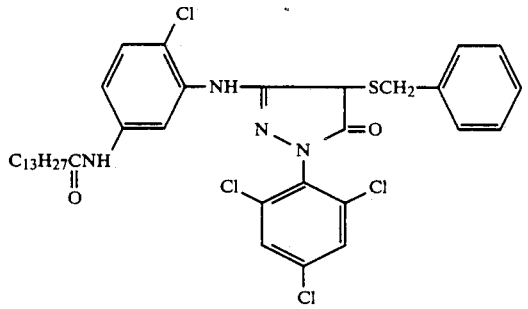
(b-5)
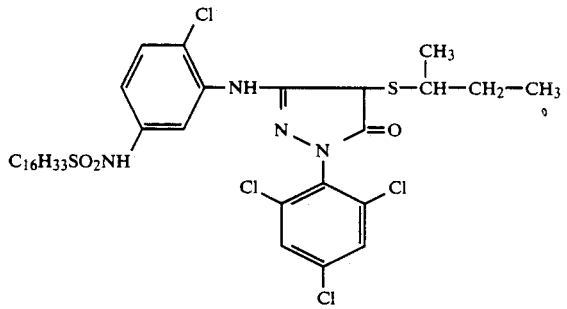
(b-6)
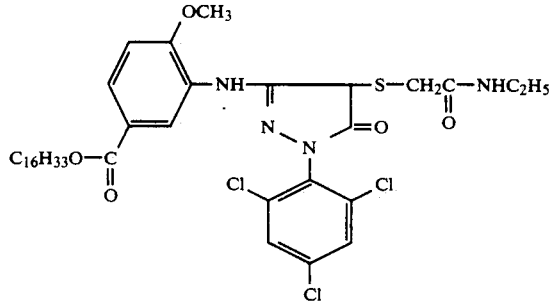

-continued
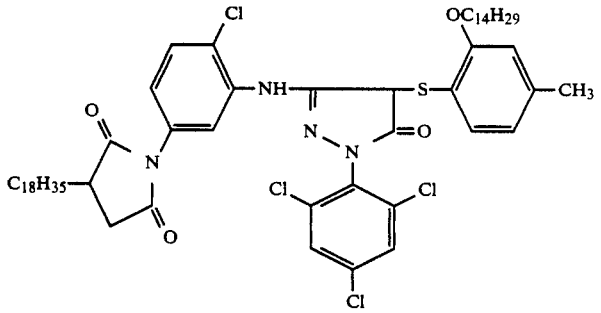
(b-7)
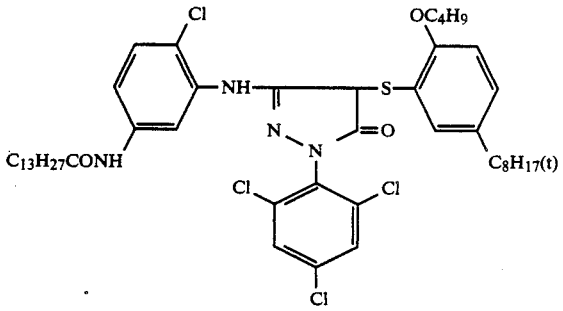
(b-8)
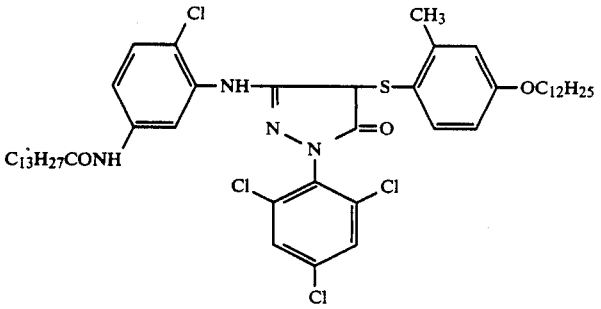
(b-9)
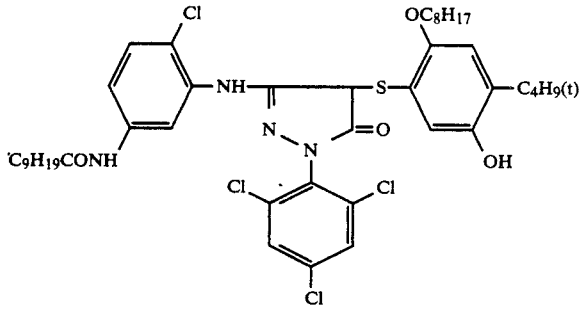
(b-10)
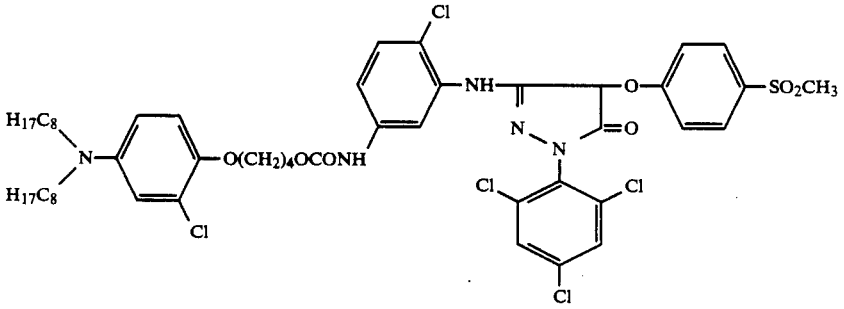
(b-11)

-continued
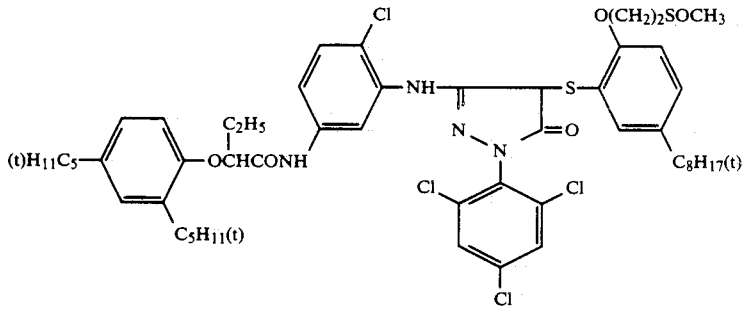
(b-12)
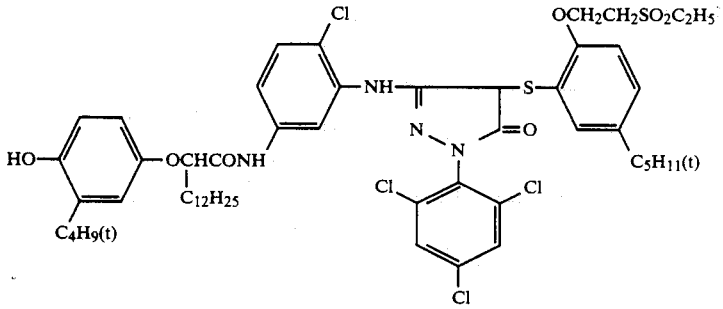
(b-13)
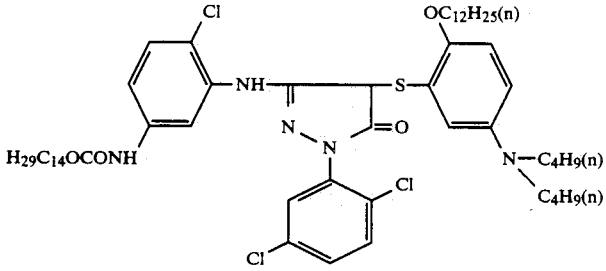
(b-14)
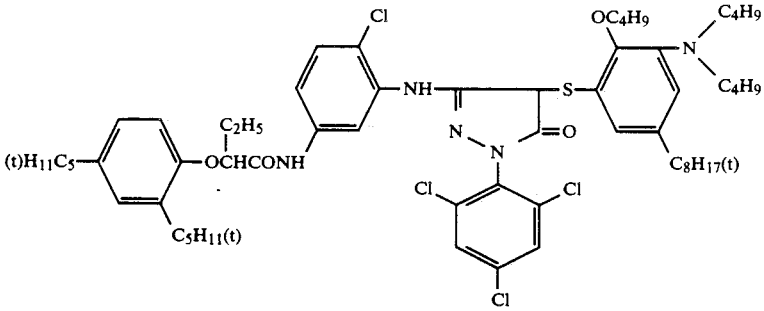
(b-15)
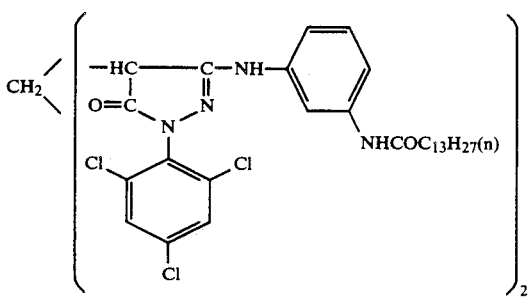
(b-16)

-continued (b-17)

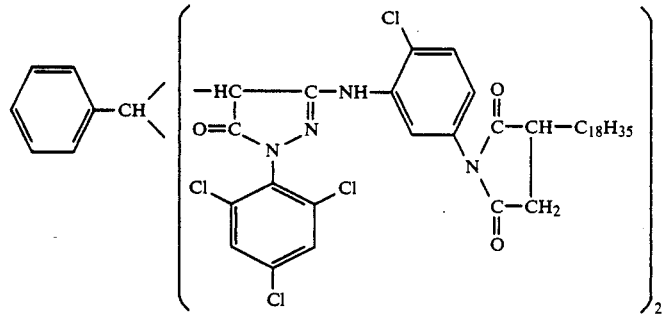

The above-given magenta couplers are described in, for example, U.S. Pat. Nos. 2,600,788, 3,061,432, 3,062,653, 3,127,269, 3,311,476, 3,152,896, 3,419,391, 3,519,429, 3,555,318, 3,684,514, 3,888,680, 3,907,571, 3,928,044, 3,930,861, 3,930,866 and 3,933,500; Japanese Patent O.P.I. Publication Nos. 49-29639, 49-111631, 49-129538, 50-13041, 52-58922, 55-62454, 55-118034, 56-38043, 57-35858, 60-2953, 60-23855 and 60-60644; British Pat. No.. 1,247,493; Belgian Pat. Nos. 789,116 and 792,525; West German Pat. No. 2,156,111; Japanese Patent Examined Publication Nos. 46-60479 and 57-36577; and so forth.

For the binders or protective colloids of a silver halide emulsion, gelatin may advantageously be used. Besides the gelatin, it is also allowed to use hydrophilic colloids including, for example, a gelatin derivative, a graft-polymer of gelatin and other macromolecular substances, other proteins than the above, a sugar derivative, a cellulose derivative, a synthesized hydrophilic macromolecular substance such as a hydrophilic homo- or co-polymer.

The photographic emulsion layers and other hydrophilic colloidal layers of the light-sensitive materials of the invention may be hardened by making use of one or not less than two kinds of hardeners capable of cross-linking the molecules of a binder or a protective colloid to each other so as to enhance the layer strength.

Such a layer as mentioned above are allowed to contain hardeners in such an amount as is not necessary to add a further hardener into a processing solution, and yet a hardener may further be added in a processing solution.

The silver halide emulsion layers and/or other hydrophilic colloidal layers of a light-sensitive material may be added with a plasticizer for the purpose of enhancing the softness of the light-sensitive material. The preferable plasticizers include, for example, a compound described in ReSearCh Disclosure, No 17643, Article XII, Paragraph A.

The silver halide photographic light-sensitive materials of the invention may further arbitrarily be applied with additives including, for example, a color contamination inhibitor, an image stabilizer, a UV absorbent, a plasticizer, a latex, a surface active agent, a matting agent, a lubricant, an antistatic agent and so forth.

Now, the development processes preferably applicable to the silver halide photographic light-sensitive materials of the invention will be detailed below.

Heretofore, for the purpose of accelerating a development or improving the reactivity of photographic couplers with quinone diimine, the color developers for color printing light-sensitive material, for example, have been added with benzyl alcohol to be used for the color developments. When adding benzyl alcohol into a color developer, it has been known that the permeating rate of the color developing agent thereof is made faster so as to increase the development speed of a silver halide emulsion.

The above-mentioned benzyl alcohol has generally been used in an amount of from 10 to 15 ml per liter of a color developer so that current type color printing light-sensitive materials may be color-developed. When it is used in such an amount, the dissolbility of benzyl alcohol to a color developer is seriously deteriorated. For improving the deterioration, it is required that benzyl alcohol should be dissolved by adding a considerable amount of such an auxiliary solvent as ethylene glycol, diethylene glycol, triethylene glycol, triethanol amine or the like.

The use of such a lot of both benzyl alcohol and the auxiliary solvent will give a contradiction to the photographic usefulness and that is unfavorable seriously to environmental pollution prevention.

In recent years, it has been strongly demanded to make more rapid a color development process which has usually been carried out in the steps in the following order; color developing—bleaching—fixing—washing, or, color developing—bleach/fixing—washing. Color printing papers have most popularly been processes in the following steps. i.e., color developing—bleach/fixing—washing or stabilizing. It has been required to carry out each step rapidly.

From the above-mentioned point of view, it is desirable that the color photographic light-sensitive materials of the invention should be developed within a period of time of not longer than 2 minutes 30 seconds by making use of a color developer not substantially containing benzyl alcohol.

The color developing step preferably applicable to the color light-sensitive materials of the invention is to be performed for a short color developing time of not longer than 2 minutes 30 seconds. The particularly preferable developing time is not longer than 2 minutes. The term, a developing time stated herein means a period of time from a point of time when a light-sensitive material comes into contact with a color developer used to a point of time when the light-sensitive material comes into contact with the following processing bath, including a cross-over time between baths.

In the color developing step, it is usually required to add a color developing agent into a color developer. This requirement includes that a color developing agent is incorporated into a color photographic light-sensitive material and the light-sensitive material is then processed with a color developer of an alkaline solution such as an activator solution, each containing a color developing agent.

Such a color developing agent being contained in a color developer is of the aromatic primary amine type, including those containing an aminophenol or p-phenylenediamine derivative. Among them, those containing a p-phenylenediamine derivative are preferably be used. Those color developing agents may be used in the form of either an organic acid salt or an inorganic acid salt, such as hydrochlorides, sulfates, p-toluenesulfonates, sulfites, oxalates, benzenesulfonates and so forth.

Those compounds may be used in a concentration of, ordinarily, from about 0.1 to about 30 grams per liter of a color developer used and, more preferably, from about 1 gram to about 15 grams per liter of a color developer used.

In a color developing tank, the developer is used at a temperature of from 10° C. to 65° C. and, more preferably, from 25° C. to 44° C.

The above-mentioned aminophenol type developing agents include, for example, those of o-aminophenol, p-aminophenol, 5-amino-2-oxy-toluene, 2-amino-3-oxy-toluene, 2-oxy-3-amino-1,4-dimethyl-benzene or the like.

The aromatic primary amine type color developing agents which are particularly useful include, for example, N,N-dialkyl-p-phenylenediamine type compounds whose alkyl and phenyl groups may be either substituted or not. Among them, the more particularly useful ones include, for example, N,N-diethyl-p-phenylenediamine hydrochloride, N-methyl-p-phenylenediamine hydrochloride, N,N-dimethyl-p-phenylenediamine diamine hydrochloride, 2-amino-5-(N-ethyl-N-dodecylamino)toluene, N-ethyl-N-β-methanesulfonamidoethyl-3-methyl-4-aminoaniline sulfate. N-ethyl-N-β-hydroxyethylaminoaniline, 4-amino-3-methyl-N,N-diethylaniline, 4-amino-N-(2-methoxyethyl)-N-ethyl-3-methylaniline-p-toluene sulfonate and so forth.

The above-given color developing agents may be used independently or in combination. They may also be incorporated into a color photographic light-sensitive material. The methods of incorporating the above-given color developing agent into color light-sensitive materials include, for example, a method of incorporating a color developing agent in the form of a metal salt as described in, for example, U.S. Pat. No. 3,719,492; a method of incorporating a color developing agent in the form of a Schiff salt as described in, for example, U.S. Pat. No. 3,342,559 and Research Disclosure, No. 15159, 1976; a method of incorporating a color developing agent in the form of the precursor of a dye as described in, for example, Japanese Patent O.P.I. publication Nos. 58-65429 and 58-24137; a method of incorporating a color developing agent in the form of the precursor thereof as described in, for example, U.S. Pat. No. 3,342,597; and so forth. When using those methods, it is also allowed to process a silver halide color photographic light-sensitive material by making use of an alkaline solution such as an activator SOlution in place Of a color developer, wherein the light-sensitive material is bleach/fixed immediately after treating it with the alkaline solution. The color developers applicable to the invention are allowed to contain alkalis including, for example, sodium hydroxide, potassium hydroxide, ammonium hydroxide, sodium carbonate, potassium carbonate, sodium phosphate, sodium metaborate, borax and so forth, each of which is usually used in developers, except that no benzyl alcohol is substantially contained therein. Besides the above, the color developers of the invention may contain various additives including, for example, halogenated alkali metals such as potassium bromide, potassium chloride and so forth; and preservatives such as hydroxylamine, polyethyleneimine, grape sugar, sulfites, citrazinic acid and so forth. In addition, the color developers of the invention are also allowed to contain various types of defoaming agents, surface active agents, organic solvents such as methanol. N,N-dimethylformamide, ethylene glycol, diethylene glycol, dimethyl sulfoxide and so forth, if required.

A p value of such color developers is usually not lower than 7 and, more preferably, from about 9 to 13.

After s silver halide color light-sensitive material is color-developed, it is then usually bleached. The bleaching and fixing steps may be carried out either at the same time or separately. It is, however, preferable to carry out both bleaching and fixing steps together in a monobath type bleach/fixing solution. A pH value of such a bleach/fixing solution applicable to the invention is, preferably, within the range of from 4.5 to 6.8.

The bleaching agents applicable to the above-mentioned bleach/fixing solution include, for example, the metal complex salts of an organic acid, each having such a function that a metal silver produced by a development is oxidized to change it into the original silver halide and, at the same time, the undeveloped color areas of color couplers are developed. The metal complex salts are constituted by coordinating the ions of such a metal as iron, cobalt, copper or the like with such an organic acid as aminopolycarboxylic acid, oxalic acid, citric acid or the like. The organic acids most preferably applicable to produce the metal complex salts of such an organic acid include, for example, polycarboxylic acid and aminopolycarboxylic acid. Those polycarboxylic acid or aminopolycarboxylic acid may be the alkali metal salts, ammonium salts or water-soluble amine salts thereof.

Those typical examples may be given as follows

1. Ethylenediamine tetraacetic acid.
2. Nitrilotriacetic acid.
3. Iminodiacetic acid,
4. Disodium ethylenediaminetetraacetate,
5. Tetra(tri)methylammonium ethylenediaminetetraacetate,
6. Tetrasodium ethylenediaminetetraacetate, and
7. Sodium nitrilotriacetate The bleaching solution applicable to the invention are allowed to contain various additives, as well as the metal complex salts of organic acids such as those given above. It is desirable to add the following additives, namely, rehalogenizers including, particularly, alkali halides or ammonium halides for serving as a rehalogenizer and, more typically, potassium bromide, sodium bromide, sodium chloride, ammonium bromide and so forth; metal salts; and chelating agent. It is also allowed to suitably add a pH buffer such as borates, oxalates, acetates, carbonates, phosphates or the like; an alkylamine; a polyethylene oxide; and so forth, which have been well-known as the ordinary type additives applicable to bleaching solutions.

Fixing solutions and bleach/fixing solutions each are allowed to contain a pH buffer comprising, such a sulfite as ammonium sulfite, potassium sulfite, ammoniumbisulfite, potassium bisulfite, sodium bisulfite, ammonmium metabisulfite, potassium metabisulfite, sodium hydroxide, potassium hydroxide, sodium carbonate, potassium carbonate, sodium bisulfite, sodium bicarbonate, potassium bicarbonate, acetic acid, sodium acetate, ammonium hydroxide or the like. Such ph buffers as mentioned above may be used independently or in combination.

When a process of the invention is carried out with replenishing a bleach/fixing replenisher into a bleach-/fixing solution or bath, the bleach/fixing colution or bath are allowed to contain a thiosulfate, thiocyanate, sulfite or the like, or, the bleach/fixing replenisher is allowed to contain the above-given salts and then to replenish it into a processing solution or bath.

For the purpose of enhancing the activity of a bleach-/fixing replenisher in the invention, the air or oxygen may be blown into the bleach/fixing solution or bath or a bleach/fixing replenisher reservoir tank, if required. Further, a suitable oxidant such as hydrogen peroxide, a bromate, a persulfate or the like may suitably be added thereinto.

The processing steps of the invention substantially comprises a color developing step, a bleach/fixing step, a washing step or a stabilizing step in place thereof that is a washless stabilizing step, and so forth.

A replenishing amount of the washless stabilizing solution relating to the invention per unit area of a color photographic light-sensitive material subject to treatment should preferably be from double to 50 times more than an amount of the solution carried-in from the preceding bath.

In the invention, a concentration of the components of the preceding bath, i.e., that of a bleach/fixing solution carried into a washless stabilizing solution, should be preferably not more than 1/50 of the concentration of the solution in the last-stage tank of the tanks of the washless stabilizing solution and, more preferably, not more than 1/100 thereof. From the viewpoints of environmental pollution protection and solution preservability, the stabilizing tank should preferably be constructed as that the concentration of a solution carried from the preceding bath into the processing tank of the washless stabilizing tanks should be so arranged as to be from 1/50 to 1/100,000 preferably and from 1/100 to 1/50,000 more preferably.

A processing tank system is comprised of a plurality of tanks and, more preferably. 2 to 6 tanks.

An amount of a solution carried in may be varied depending on the kinds of light-sensitive materials, film transport speeds and systems of automatic processors, how to squeeze the surfaces of light-sensitive materials, and so forth. However, in the case of color light-sensitive materials for photographic use, i.e., ordinary type color roll films, an amount of solution carried in is usually from 50 ml/m$^2$ to 150 ml/m$^2$. To enable the effects of the invention to be remarkable, the replenishing amount to the above-mentioned amount carried in is within the range of from 100 ml/m$^2$ to 4.0 liters/m$^2$ and, a particularly effective replenishing amount is within the range of from 200 ml/m$^2$ to 1500 ml/m$^2$.

In the case of color printing papers, the amount carried in is usually from 10 ml/m$^2$ to 100 ml/m$^2$ and the replenishing amount more effective in the invention is within the range of from 20 ml/m$^2$ to 1.5 liters/m$^2$.

When using a washless stabilizer solution, its temperature is to be from 15° to 60° C. and, more preferably, from 20° to 45° C.

EXAMPLE-1

An aqueous silver nitrate solution and an aqueous solution of a halide-mixture consisting of potassium bromide and sodium chloride were added into an aqueous gelatin solution being violently stirred, so as to prepare silver chlorobromide emulsions having silver chloride contents of 50 mol %, 99.5 mol % and 100 mol %, respectively, hereinafter called EM-1, EM-2 and EM-3 in which only sodium chloride was used. Each of the emulsions was a cubic system monodisperse type emulsion having an average grain size of 0.4 μm.

The resulted emulsions were added with sodium thiosulfate in an amount of $2\times10^{-4}$ mol per mol of silver halide, aurochloric acid in an amount of $1\times10^{-5}$ mol per mol of silver halide and a red-sensitive sensitizing dye RSD-1 in an amount of $2\times10^{-4}$ mol per mol of silver halide, and an optimum ripening was then applied to each emulsion. The ripened emulsions were added with a stabilizer that is a comparative compound Z-1 or Z-2 or one of the mercapto compounds of the invention. each indicated in Table-1, in an amount of $2\times10^{-4}$ mol per mol of silver halide, so that the red-sensitive emulsions were prepared, respectively.

Next, the following layers were coated over a polyethylene-coated paper support in the following coating order, so that silver halide color photographic light-sensitive materials were prepared, respectively. Wherein, the amount of each compound coated is indicated by an amount coated per sq. meter.

Layer 1

A blue-sensitive emulsion layer

A blue-sensitive emulsion containing AgBrCl having a silver chloride content of 99.7 mol %, having a cubic system of 0.67 μm, having been chemically sensitized with sodium thiosulfate and aurochloric acid, containing a blue-sensitive sensitizing dye BSD-1, and containing a stabilizer that is Exemplified Compound SB-1;

A silver salt in an amount equivalent to 0.35 g of silver;

A dinonyl phthalate dispersion of 0.3 g dissolved therein with 0.9 g of yellow coupler Y-1 and 0.02 g of 2,5-di-tert-octyl hydroquinone HQ-1; and Gelatin in an amount of 2.0 g.

Layer 2

The first interlayer comprising:

An emulsification-dispersion prepared by dissolving 0.015 g of HQ-1 into 0.04 g of diisodecyl phthalate; and Gelatin in an amount of 1.5 g.

Layer 3

A green-sensitive emulsion layer comprising:

A green-sensitive emulsion containing AgBrCl having a silver chloride content of 99.5 mol %, having a cubic system of 0.36 μm, having been chemically sensitized with sodium thiosulfate and aurochloric acid, containing a green-sensitive sensitizing dye GSD-1, and containing a stabilizer that is Exemplified Compound SB-2;

A silver salt in an amount equivalent to 0.3 g of silver;

A dibutyl phthalate dispersion of 0.28 g dissolved therein with 0.4 g of magenta coupler M-1 and 0.015 g of HQ-1; and Gelatin in an amount of 1.5 g.

Layer 4

The 2nd interlayer comprising:

A dibutyl phthalate dispersion of 0.2 g in which 0.8 g of a UV absorbent UV-1 and 0.04 g of HQ-1 were dissolved; and Gelatin in an amount of 1.5 g.

Layer 5

A red-sensitive emulsion layer comprising:

The foregoing prepared red-sensitive emulsion shown in Table-1;

A silver salt in an amount equivalent to a silver amount of 0.25 g; A dibutyl phthalate dispersion of 0.2 g dissolved therein with Comparative cyan couplers C-1 and C-2, 0.45 g of Exemplified cyan coupler shown in Table-1 and 0.01 g of HQ-1; and Gelatin in an amount of 2.0 g.

Layer 6

The 3rd interlayer comprising:

A dibutyl phthalate dispersion of 0.2 g in which 0.4 g of a UV absorbent UV-1 and 0.02 g of HQ-1 were dissolved:

The following filter dyestuffs AI-1 and AI-2; and

Gelatin in an amount of 0.7 g.

Layer 7

A protective layer comprising:

Gelatin in an amount of 1.0 g; and sodium 2,4-dichloro-6-hydroxytriazine in an amount of 0.05 g.

BSD-1

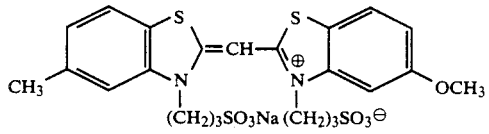

GSD-1

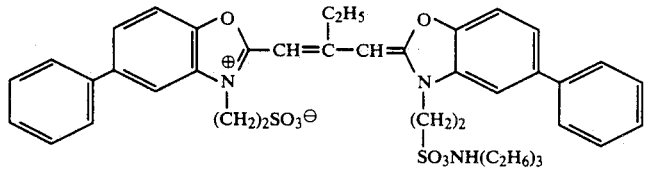

RSD-1

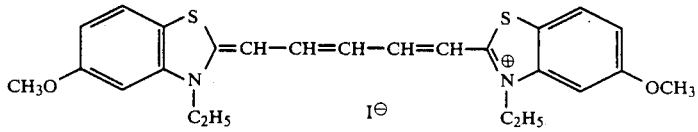

Z-1

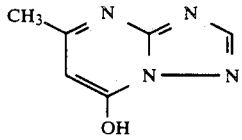

Z-2

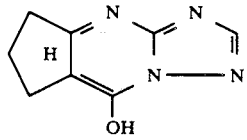

Y-1

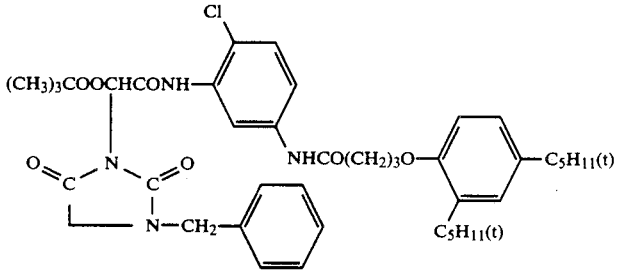

-continued

M-1

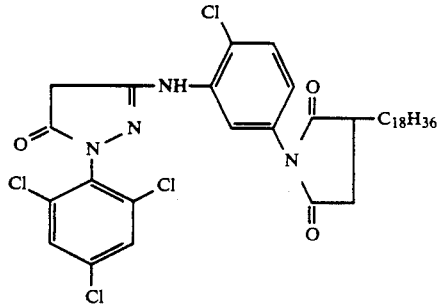

C-1

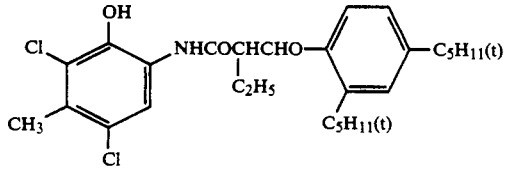

C-2

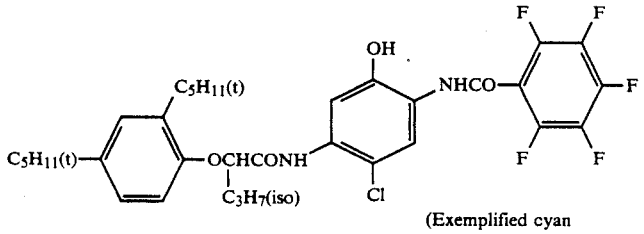

(Exemplified cyan coupler PC-II-3)

UV-1

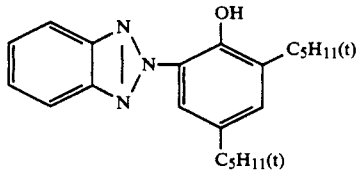

AI-1

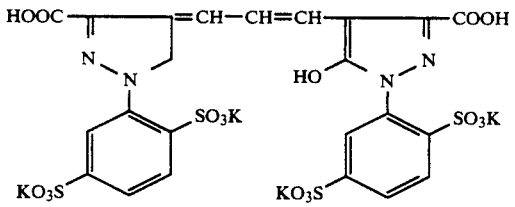

AI-2

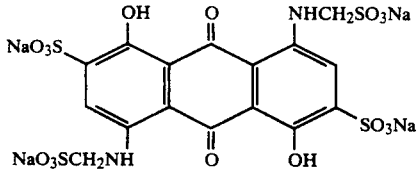

With respect to the resulted samples, a series of the samples were processed, immediately after prepared, in such a manner that they were exposed wedgewise to white light by means of a photosensitometer. Model KS-7 manufactured by Konica Co., Ltd., and color-developed in the following steps and then the sensitometries of sensitivity, fogginess and maximum density Dmax of the red light-sensitive emulsion layers thereof were tried. On the other hand, another series of incubated samples which had been allowed to stand for 6 days at 50° C. and at 40% relative humidity were processed in the same manner. The results of the sensitometries are shown in Table-1, respectively.

In the results thereof, the sensitivity of each sample is expressed in a reciprocal logarithm of an exposure necessary for obtaining a density of 0.8, and in terms of the relative values to the sensitivity of Sample 15 which is regarded as a value of 100.

| Processing steps | Temperature | Time |
|---|---|---|
| Developing* | 34.7 ± 0.3° C. | 45 sec. |
| Bleach-Fixing | 34.7 ± 0.5° C. | 50 sec. |
| Stabilizing | 30 to 34° C. | 90 sec. |

-continued

| Drying | 60 to 80° C. | 60 sec. |
|---|---|---|
| COLOR DEVELOPER | | |
| Pure water | | 800 ml |
| Triethanolamine | | 8 g |
| N,N-diethylhydroxylamine | | 5 g |
| Potassium chloride | | 2 g |
| N-ethyl-N-β-methanesulfonamidoethyl-3-methyl-4-aminoaniline sulfate | | 5 g |
| Sodium tetrapolyphosphate | | 2 g |
| Potassium carbonate | | 30 g |
| Potassium sulfite | | 0.2 g |
| Optical brightening agent, 4,4'-diaminostilbene sulfonic acid derivative | | 1 g |
| Add pure water to make | | 1 liter |
| Adjust pH to | | pH 10.2 |
| BLEACH-FIXER | | |
| Ferric ammonium ethylenediamine-tetraacetate, dihydrate | | 60 g |
| Ethylenediaminetetraacetate | | 3 g |
| Ammonium thiosulfate in a 70% solution | | 100 ml |
| Ammonium sulfite in a 40% solution | | 27.5 ml |
| Adjust pH with potassium carbonate or glacial acetic acid to | | pH 5.7 |
| Add water to make | | 1 liter |
| STABILIZER | | |
| 5-chloro-2-methyl-4-isothiazoline-3-one | | 1 g |
| 1-hydroxyethylidene-1,1-diphosphonic acid | | 2 g |
| Add water to make | | 1 liter |
| Adjust pH with sulfuric acid or potassium hydroxide to | | pH 7.0 |

*Fog density was measured upon color-developing of an unexposed sample for 90 seconds.

The following facts were found from Table-1.

1. Samples No. 1 through No. 8 each applied with EM-1 containing 50 mol % of silver chloride had a low maximum density and a poor rapid processability even when the cyan couplers of the invention were used, while they showed a relatively good storage stability of un-exposed samples. In contrast to the above, Samples having used EM-2 or EM-3 had a high maximum density and a suitable rapid processability.

2. Samples No. 9 through No. 12 each applied with the other cyan couplers than those of the invention had a rather slightly lower maximum density and a poorer color developability, in comparison with Samples No. 13 through No. 22 each applied with the cyan couplers of the invention.

3. In comparison with Samples applied with the stabilizers of the invention. Samples Nos. 13, 14, 18 and 19 each applied with the other stabilizers than those of the invention had a seriously higher fogginess and more serious post-incubation variations such as desensitization, fog increase and Dmax lowering, while the maximum densities were almost the same. In contrast with the above, Samples each applied with the stabilizers of the invention were so excellent that the fogginess was low, the Dmax was high and the post-incubation variations were very small.

4. The same as the above fact 3 may be said of Samples No. 23 through No. 32 each applied with EM-3. It was found that a good reproduction can be obtained even when emulsions are changed. However, EM-2 was better in fog level produced in an immediate process.

TABLE 1

| | | | | Immediately processed sample | | | 6-day incubated sample | | | |
|---|---|---|---|---|---|---|---|---|---|---|
| Sample No. | Emulsion No. | Cyan coupler | Stabilizer | Sensitivity | Fog | Dmax | Sensitivity | Fog | Dmax | Remark |
| 1 | EM-1 | C-1 | Z-1 | 89 | 0.09 | 2.00 | 84 | 0.11 | 2.00 | Comp. |
| 2 | " | " | SB-2 | 91 | 0.07 | 2.01 | 85 | 0.09 | 1.99 | " |
| 3 | " | C-2 | Z-1 | 88 | 0.10 | 2.06 | 80 | 0.11 | 2.07 | " |
| 4 | " | " | SB-2 | 90 | 0.07 | 2.04 | 85 | 0.08 | 2.04 | " |
| 5 | " | No. 47 | Z-1 | 99 | 0.11 | 2.20 | 92 | 0.13 | 2.19 | " |
| 6 | " | " | SB-2 | 98 | 0.08 | 2.21 | 95 | 0.10 | 2.22 | " |
| 7 | " | No. 121 | Z-1 | 100 | 0.10 | 2.25 | 95 | 0.13 | 2.20 | " |
| 8 | " | " | SB-2 | 102 | 0.07 | 2.23 | 97 | 0.09 | 2.25 | " |
| 9 | EM-2 | C-1 | Z-1 | 92 | 0.15 | 2.32 | 87 | 0.18 | 2.30 | Comp. |
| 10 | " | " | SB-2 | 91 | 0.08 | 2.33 | 86 | 0.10 | 2.31 | " |
| 11 | " | C-2 | Z-1 | 97 | 0.13 | 2.34 | 90 | 0.17 | 2.30 | " |
| 12 | " | " | SB-2 | 98 | 0.07 | 2.37 | 94 | 0.10 | 2.35 | " |
| 13 | " | No. 47 | Z-1 | 95 | 0.13 | 2.54 | 83 | 0.21 | 2.44 | " |
| 14 | " | " | Z-2 | 97 | 0.12 | 2.52 | 85 | 0.19 | 2.40 | " |
| 15 | " | " | SB-1 | 100 | 0.05 | 2.58 | 96 | 0.07 | 2.57 | Inv. |
| 16 | " | " | SB-2 | 101 | 0.06 | 2.56 | 96 | 0.07 | 2.56 | " |
| 17 | " | " | SB-6 | 98 | 0.05 | 2.56 | 94 | 0.07 | 2.57 | " |
| 18 | " | No. 121 | Z-1 | 99 | 0.16 | 2.49 | 97 | 0.23 | 2.38 | Comp. |
| 19 | " | " | Z-2 | 97 | 0.14 | 2.52 | 94 | 0.22 | 2.41 | " |
| 20 | " | " | SB-1 | 104 | 0.06 | 2.51 | 100 | 0.08 | 2.52 | Inv. |
| 21 | " | " | SB-2 | 106 | 0.06 | 2.57 | 101 | 0.07 | 2.55 | " |
| 22 | " | " | SB-6 | 103 | 0.06 | 2.56 | 100 | 0.08 | 2.57 | " |
| 23 | EM-3 | C-1 | Z-1 | 93 | 0.18 | 2.31 | 88 | 0.22 | 2.30 | Comp. |
| 24 | " | " | SB-2 | 90 | 0.08 | 2.33 | 85 | 0.11 | 2.30 | " |
| 25 | " | C-2 | Z-1 | 95 | 0.17 | 2.30 | 91 | 0.20 | 2.29 | " |
| 26 | " | " | SB-2 | 92 | 0.07 | 2.35 | 87 | 0.11 | 2.31 | " |
| 27 | " | No. 47 | SB-1 | 96 | 0.07 | 2.49 | 92 | 0.08 | 2.50 | Inv. |
| 28 | " | " | SB-2 | 94 | 0.08 | 2.54 | 92 | 0.09 | 2.50 | " |
| 29 | " | " | SB-6 | 97 | 0.08 | 2.51 | 93 | 0.10 | 2.52 | " |
| 30 | " | No. 121 | SB-1 | 99 | 0.07 | 2.50 | 95 | 0.09 | 2.50 | " |
| 31 | " | " | SB-2 | 96 | 0.07 | 2.50 | 93 | 0.10 | 2.47 | " |
| 32 | " | " | SB-6 | 95 | 0.08 | 2.52 | 91 | 0.10 | 2.50 | " |

Note: Comp. . . . Comparative, Inv. . . . Invention

It was found from the above-mentioned facts that the samples prepared in the invention were color photographic light-sensitive materials excellent in rapid processability, high in density, low in fogginess and excellent in raw stock storage stability.

EXAMPLE-2

The same tests were tried as in Example-1 in such a manner that, in the same layer arrangements as those in Example-1, the cyan couplers, high boiling organic solvents and stabilizers each of the invention were variously changed as shown in Table-2, so that the effects were examined.

TABLE 2

| Sample No. | Emulsion No. | Cyan coupler | High boiling Organic solvent | Stabilizer | Immediately processed sample Sensitivity | Fog | Dmax | 6-day incubated sample Sensitivity | Fog | Dmax | Remark |
|---|---|---|---|---|---|---|---|---|---|---|---|
| 33 | Em-2 | No. 116 | Dibutyl phthalate | Z-1 | 92 | 0.16 | 2.43 | 81 | 0.25 | 2.31 | Comp. |
| 34 | " | " | " | SA-4 | 93 | 0.09 | 2.47 | 88 | 0.12 | 2.40 | Inv. |
| 35 | " | " | " | SB-5 | 99 | 0.06 | 2.49 | 92 | 0.09 | 2.43 | " |
| 36 | " | " | Exemplified H-3 | SC-11 | 90 | 0.07 | 2.52 | 87 | 0.09 | 2.50 | " |
| 37 | " | " | " | SC-30 | 91 | 0.08 | 2.56 | 88 | 0.10 | 2.55 | " |
| 38 | " | " | " | SC-39 | 94 | 0.09 | 2.48 | 92 | 0.09 | 2.47 | " |
| 39 | " | " | " | SD-1 | 93 | 0.09 | 2.51 | 90 | 0.10 | 2.52 | " |
| 40 | " | " | " | SB-5 | 100 | 0.06 | 2.54 | 98 | 0.07 | 2.53 | " |
| 41 | " | " | Exemplified H-4 | SB-5 | 99 | 0.05 | 2.57 | 97 | 0.06 | 2.54 | " |
| 42 | " | " | Exemplified H-13 | SB-5 | 103 | 0.07 | 2.55 | 99 | 0.08 | 2.52 | " |
| 43 | " | No. 122 | Dibutyl phthalate | Z-1 | 93 | 0.18 | 2.42 | 80 | 0.27 | 2.29 | Comp. |
| 44 | " | " | " | SA-4 | 94 | 0.10 | 2.47 | 90 | 0.14 | 2.40 | Inv. |
| 45 | " | " | " | SB-5 | 93 | 0.08 | 2.48 | 90 | 0.09 | 2.41 | " |
| 46 | " | " | Exemplified H-3 | SC-11 | 95 | 0.09 | 2.53 | 93 | 0.10 | 2.50 | " |
| 47 | " | " | " | SC-30 | 92 | 0.07 | 2.55 | 90 | 0.09 | 2.52 | " |
| 48 | " | " | " | SC-39 | 90 | 0.08 | 2.54 | 87 | 0.09 | 2.52 | " |
| 49 | " | " | " | SD-1 | 91 | 0.09 | 2.51 | 90 | 0.10 | 2.50 | " |
| 50 | " | " | " | SB-5 | 98 | 0.05 | 2.53 | 97 | 0.06 | 2.50 | " |
| 51 | " | " | Exemplified H-4 | SB-5 | 103 | 0.06 | 2.57 | 100 | 0.07 | 2.54 | " |
| 52 | " | " | Exemplified H-13 | SB-5 | 104 | 0.07 | 2.58 | 101 | 0.08 | 2.55 | " |

Note: Comp. . . . Comparative, Inv. . . . Invention

It is obvious that the same effects as in Example-1 can be obtained even if cyan couplers and stabilizers are variously changed. It is also found to be more advantageous to use a high boiling organic solvent, Exemplified H-3, H-4 or H-13, rather than using phthalate, because Dmax can also be higher to some extent.

EXAMPLE-3

In the same manner as in Example-1, silver chlorobromide emulsions each having a silver chloride content of 99.7 mol % was prepared. The resulted emulsions were cubic system dispersion type emulsions each having an average grain size of 0.42 μm, which are hereinafter called EM-4. These emulsions each were added with sodium thiosulfate in an amount of $1.7\times10^{-4}$ mol per mol of silver halide, aurochloric acid in an amount of $1.2\times10^{-5}$ mol per mol of silver halide and the following red-sensitive sensitizing dye RSD-2 in an amount of $2.5\times10^{-4}$ mol per mol of silver halide. In the course of most suitably ripening the emulsions, stabilizers were added by portioning them out in the various amounts shown in Table-3, when starting and completing the ripening in the various amounts, respectively, so that the red-sensitive emulsions were prepared. The resulted emulsions were coated on in the order of the same layer arrangements as in Example-1, and the same tests were tried.

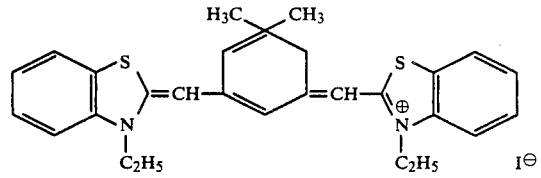

TABLE 3

| Sample No. | Emulsion No. | Stabilizer added before starting ripening (Amount added per mol of AgXI | | Stabilizer added when completing ripening (Amount added per mol of AgXI | | Cyan coupler | Immediately processed sample Sensitivity | Fog | Dmax | 6-day incubated sample Sensitivity | Fog | Dmax | Remark |
|---|---|---|---|---|---|---|---|---|---|---|---|---|---|
| 53 | EH-4 | — | — | Z-1 | $2\times10^{-4}$ | No. 119 | 90 | 0.17 | 2.43 | 75 | 0.24 | 2.40 | Comp. |
| 54 | " | Z-1 | $5\times10^{-5}$ | " | $2\times10^{-4}$ | " | 93 | 0.16 | 2.47 | 82 | 0.22 | 2.41 | " |
| 55 | " | " | " | " | $5\times10^{-4}$ | " | 92 | 0.15 | 2.44 | 80 | 0.21 | 2.40 | " |
| 56 | " | — | — | SB-1 | $1\times10^{-7}$ | " | 104 | 0.13 | 2.47 | 92 | 0.19 | 2.44 | " |
| 57 | " | — | — | " | $1\times10^{-6}$ | " | 103 | 0.10 | 2.49 | 96 | 0.13 | 2.48 | Inv. |
| 58 | " | — | — | " | $1\times10^{-5}$ | " | 101 | 0.08 | 2.51 | 97 | 0.09 | 2.51 | " |
| 59 | " | — | — | " | $1\times10^{-4}$ | " | 100 | 0.08 | 2.48 | 95 | 0.08 | 2.49 | " |
| 60 | " | — | — | " | $2\times10^{-4}$ | " | 100 | 0.07 | 2.50 | 96 | 0.09 | 2.47 | " |
| 61 | " | — | — | " | $1\times10^{-3}$ | " | 97 | 0.06 | 2.50 | 94 | 0.07 | 2.50 | " |
| 62 | " | SB-5 | $5\times10^{-5}$ | " | $1\times10^{-5}$ | " | 110 | 0.07 | 2.51 | 103 | 0.08 | 2.50 | " |
| 63 | " | " | " | " | $1\times10^{-4}$ | " | 114 | 0.06 | 2.53 | 110 | 0.07 | 2.52 | " |
| 64 | " | " | " | " | $2\times10^{-4}$ | " | 115 | 0.05 | 2.53 | 113 | 0.05 | 2.52 | " |
| 65 | " | " | " | " | $1\times10^{-3}$ | " | 111 | 0.05 | 2.55 | 109 | 0.05 | 2.53 | " |
| 67 | " | — | — | SB-5 | $2\times10^{-4}$ | " | 103 | 0.07 | 2.51 | 100 | 0.08 | 2.50 | " |
| 68 | " | SB-5 | $5\times10^{-5}$ | " | $1\times10^{-5}$ | " | 118 | 0.06 | 2.54 | 114 | 0.07 | 2.53 | " |
| 69 | " | " | " | " | $1\times10^{-4}$ | " | 122 | 0.05 | 2.53 | 120 | 0.05 | 2.54 | " |

TABLE 3-continued

| Sample No. | Emulsion No. | Stabilizer added before starting ripening (Amount added per mol of AgXI | | Stabilizer added when completing ripening (Amount added per mol of AgXI | | Cyan coupler | Immediately processed sample Sensitivity | Fog | Dmax | 6-day incubated sample Sensitivity | Fog | Dmax | Remark |
|---|---|---|---|---|---|---|---|---|---|---|---|---|---|
| 70 | " | " | " | " | $2 \times 10^{-4}$ | " | 125 | 0.05 | 2.53 | 123 | 0.05 | 2.53 | " |
| 71 | " | " | " | " | $1 \times 10^{-3}$ | " | 120 | 0.05 | 2.51 | 119 | 0.05 | 2.50 | " |

Note: Comp. . . . Comparative. Inv. . . . Invention

It is obvious from the above table that the samples applied with the other stabilizers than those of the invention are liable to a high fogging and the post-incubation characteristics even if the stabilizer is added when starting and completing a ripening process by portioning out; that the samples applied with the stabilizer of the invention can provide distinguished effects even when the stabilizer is added when completing a ripening as in the case of Samples No. 57 through No. 61 and No. 67; and that, when further adding the stabilizer before starting the ripening process, other excellent effects can additionally be displayed such as that a sensitivity can be increased and fogginess can also be inhibited, as well as the effects of the invention.

It was also found that the effects was little when adding the stabilizer in an amount outside the range of the invention such as in the case of Sample No. 56 and, therefore, there should be a specific amount of the stabilizer to be added.

EXAMPLE 4

Based on Sample No. 16 of Example-1, color light-sensitive materials were prepared in the same manner as in Example-1, except that yellow coupler Y-1 of Layer 1 was replaced by the following yellow coupler Y-2. and magenta coupler M-1 of Layer 3 by the following magenta coupler M-3, respectively, the silver content of the green-sensitive silver halide emulsion was changed to 0.15 g, and the cyan coupler was replaced by cyan coupler No. 30. The resulted samples were called Sample Nos. 72 and 73, out of which Sample No. 72 used magenta coupler M-2 and Sample No. 73 used magenta coupler M-3. The sensitometries of both of the samples immediately processed and the samples incubated for 6 days were tried to measure sensitivity, fog and Dmx, in the same manner as in Examples-1 and 2, and the results were compared. The comparison proved that fog production and the characteristic variations in raw stock storage are little and excellent effects of the invention can be reproduced to display.

Color-checker manufactured by Macbeth Co. was photographed on Sakuracolor negative film, SR-V100 manufactured by Konishiroku Photo Ind. Co., Ltd. and developed. The grey hued portions of the developed film were matched and then the prints were made on the Samples Nos. 16, 72 and 73. The color reproducibility of each hue was evaluated.

It was resultingly found that Samples Nos. 72 and 73 were excellent in green, red and magenta.

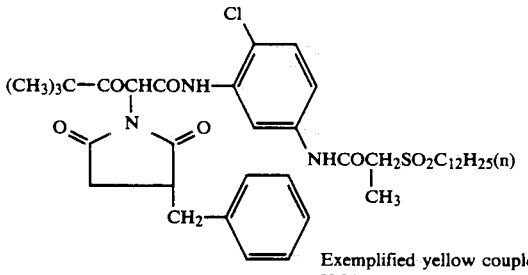

Exemplified yellow coupler Y-24

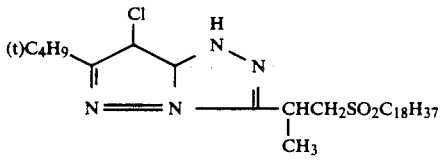

(M-2)

-continued

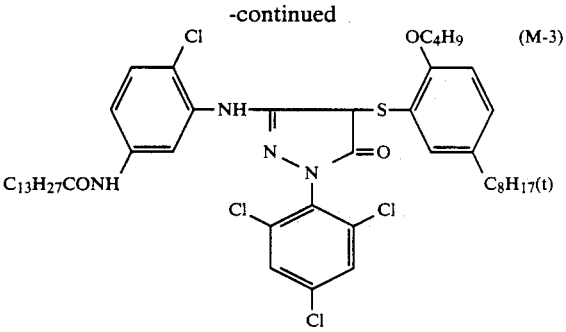

(M-3)

Exemplified magenta coupler b-9

EXAMPLE-5

Samples No. 74 through No. 76 of color light-sensitive materials were prepared in the same manner as in Sample No. 72 of Example-3, except that the cyan coupler of Layer 5 was replaced by the mixture of Coupler No. 21 of the invention and Coupler No. C-2 in the ratio of 4:1 by weight, the mixture of No. 21 and C-2 in the ratio of 4:1 by weight, and the mixture of No 21, C-2 and C-3 in the ratio of 3:0.5:1.5 by weight, respectively.

With respect to the resulted samples, the color reproducibilities thereof were evaluated by means of the color checker in the same manner as in Example-3. It was found that the color reproducibilities especially in blue and yellow were improved and the resulted samples were the color light-sensitive materials which were excellent in overall color reproducibility.

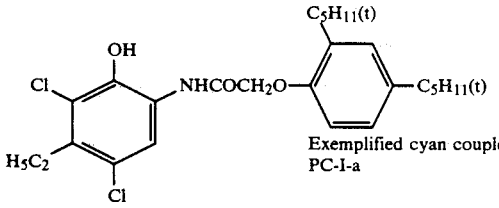

Exemplified cyan coupler PC-I-a

What is claimed is:

1. A silver halide color photographic light-sensitive material comprising a support having thereon a silver halide emulsion layer, wherein said silver halide emulsion layer contains silver halide grains having a silver chloride content of not less than 90 mol %, a cyan coupler of Formula C-1

Formula C-I

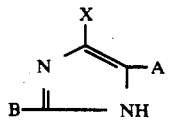

wherein A and B each represent an organic group combined with the imidazole ring through a carbon atoms, nitrogen atom, oxygen atom or a sulfur atom thereof, at least one of A and B being aryl; and X represents a hydrogen atom or a group capable of being split off upon reaction with the oxidized product of a color developing agent, and a nitrogen containing mercapto compound of Formula S;

Formula S

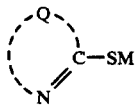

wherein Q represents a five- or six-member heterocyclic ring which may be condensed with a benzene ring, and M is a hydrogen atom or a cation.

2. The material of claim 1, said X is a halogen atom.

3. The material of claim 1, wherein said cyan coupler is represented by the following formula C-II;

Formula C-II

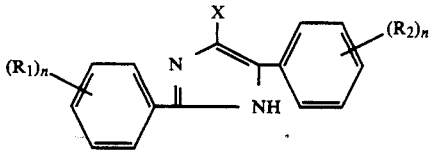

wherein $R_1$ and $R_2$ each represent a substituent; X is the same as denoted in the formula C-I and n is an integer of from 0 to 5.

4. The material of claim 3, wherein said cyan coupler is represented by the following formula C-V or C-VI;

Formula C-V

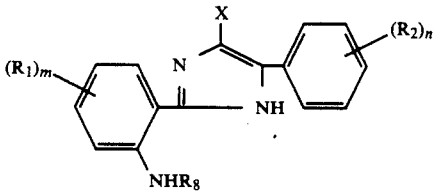

Formula C-VI

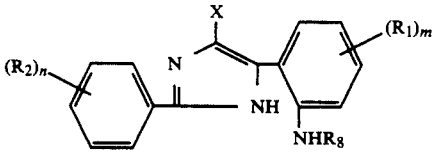

wherein $R_1$, $R_2$, X and n are each the same as denoted in the formula C-II and $R_8$ represents a group of alkyl, aryl, $—COR_6$, $—SO_2R_6$,

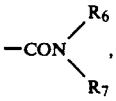

$—COOR_6$ or

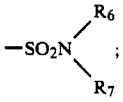

m is an integer of from 0 to 4; and $R_6$ and $R_7$ each represent an alkyl group or an aryl group.

5. The material of claim 4, wherein said cyan coupler is represented by the following formula C-VII;

Formula C-VII

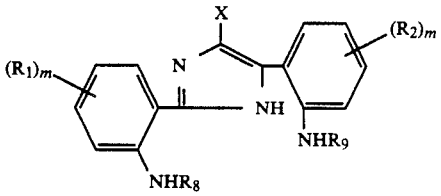

wherein $R_1$, $R_2$, $R_8$ X and m are each the same as denoted in the formula C-V and $R_9$ is individually the same as $R_8$ in Formula C-V.

6. The material of claim 1, wherein said cyan coupler is represented by the following formula C-VIII;

Formula C-VIII

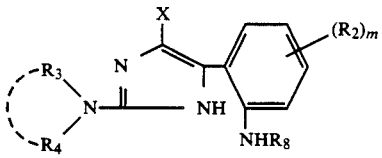

wherein $R_2$, $R_3$, $R_4$ and X are each the same as denoted in the formula C-III, and $R_8$ and m are each the same as denoted in the formula C-V.

7. The material of claim 1, wherein of said nitrogen-containing heterocyclic mercapto compound has a solubility product of not more than $1\times10^{-10}$ with a silver ion.

8. The material of claim 7, wherein said nitrogen-containing heterocyclic mercapto has a solubility product of not more than $1\times10^{-11}$ with a silver ion.

9. The material of claim 1, wherein said mercapto compound is represented by the following formula SA;

Formula SA

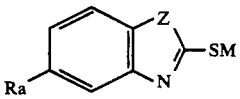

wherein Ra represents a hydrogen atom, an alkyl group, an akoxyl group, a halogen atom, a carboxyl group or a salt thereof, a sulfo group or a salt thereof, or an amino group: Z represents —NH—, —O— or —S—; and M is the same as denoted in the formula S.

10. The material of claim 1, wherein said mercapto compound is represented by the following formula SB;

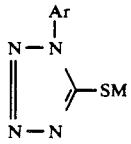

Formula SB wherein Ar represents a group of

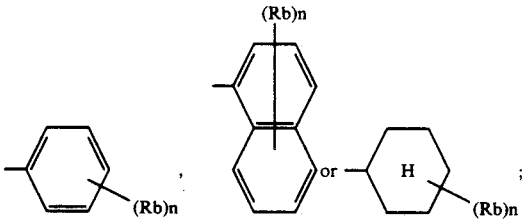

Rb represents an alkyl group, an alkoxyl group, a carboxyl group or a salt thereof, a sulfo group or a salt thereof, a hydroxy group, an amino group, an acylamino group, a carbamoyl group or a sulfonamido group; n is an integer of from 0 to 2; and M is the same as denoted in the formula S.

11. The material of claim 1, wherein said mercapto compound represented by the following formula SC;

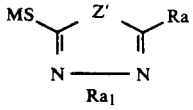

Formula SC wherein Z' represents an —N— group, an oxygen atom or a sulfur atom; Ra is a hydrogen atom, an alkyl group, an aryl group, an alkenyl group, a cycloalkyl group, an —$SRa_1$ group, group, an

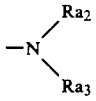

group, an —$NHCORa_4$ group, an —$NHSO_2Ra_5$ group or a heterocyclic group; $Ra_1$ represents a hydrogen atom, an alkyl group, an alkenyl group, a cycloalkyl group, an aryl group, a —$CORa_4$ group or an —$SO_2$-$Ra_5$ group; $Ra_2$ and $Ra_3$ each represent a hydrogen atom, an alkyl group or an aryl group; $Ra_4$ and $Ra_5$ each represent an alkyl group or an aryl qroup; and M is the same as denoted in the formula S.

12. The material of claim 1, wherein said mercapto compound is represented by the following formula SD;

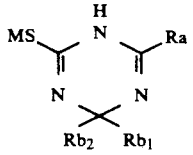

Formula SD wherein Ra, M, $Rb_1$ and $Rb_2$ are the same as denoted in the formula SC, respectively, provided that the $Rb_1$ and $Rb_2$ may be linked with each other to form a ring.

13. The material of claim 1, said mercapto compound is contained said silver halide emulsion layer in an amount of from $1\times10^{-5}$ mole to $1\times10^{-2}$ mole per mole of silver halide.

14. The material of claim 13, said mercapto compound is contained said silver halide emulsion layer in an amount of from $1\times10^{-5}$ mole to $1\times10^{-2}$ mole per mole of silver halide.

15. The material of claim 1, wherein said silver chloride content of said silver halide grains is within the range of from 90 mol % to 99.9 mol %.

16. The material of claim 1, wherein said silver halide grains having a silver chloride content of not less than 90 mol % are contained in said silver halide emulsion layer in a ration of not less than 60% by weight.

17. The material of claim 16, wherein said silver halide grains having a silver chloride content of not less than 90 mol % are contained in said silver halide emulsion layer in a ration of not less than 80% by weight.

18. The material of claim 1, wherein an average size of said silver halide grains is within the range of from 0.2 μm to 1.6 μm.

19. The material of claim 18, wherein an average size of said silver halide grains is within the range of from 0.25 μm to 1.2 μm.

20. The material of claim 1, wherein said silver halide emulsion layer contains oil drops comprising a high-boiling organic solvent and a ration by weight (Od/Hc) of said oil drops (Od) to a hydrophilic coloid (Hc) contained in said silver halide emulsion layer is not more than 0.8.

21. The material of claim 20, wherein said ratio of Od/Hc is with in the range of from 0.2 to 0.6.

22. The material of claim 20, wherein said high-boiling organic solvent has a dielectric constant of not more than 0.60.

23. The material of claim 22, said high-boiling organic solvent has a dielectric constant of from 1.9 to 6.0.

24. The material of claim 20, wherein said high-boiling organic solvent is represented by the following formula HA,

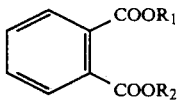

Formula HA wherein $R_1$ and $R_2$ each represent an alkyl group, an alkenyl group or an aryl group provided that a total number of carbon atoms contains in the groups represented by the $R_1$ and $R_2$ is within the range of from 12 to 32.

25. The material of claim 20, wherein said high-boiling organic solvent is represented by the following formula HB;

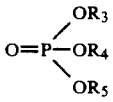

Formula HB wherein $R_3$, $R_4$ and $R_5$ each represent an alkyl group, analkenyl group or a aryl group, provided that a total number of carbon atoms contained in said groups represented by the $R_3$, $R_4$ and $R_5$ is within the range of from 24 to 54.

26. The material of claim 20, wherein said silver halide content is within the range of from 0.5 mg/dm$^2$ to 2.2 mg/dm$^2$.

27. The material of claim 1, a silver halide content of silver halide emulsion layer is not less than 2.7 mg/dm$^2$ in terms of silver.

28. A silver halide color photographic light-sensitive material comprising a support having thereon a silver halide emulsion layer, wherein said silver halide emulsion layer contains silver halide grains having a silver chloride content of not less than 90 mol %, a cyan coupler of Formula C-1 and a nitrogen-containing heterocyclic mercapto compound Formula C-1

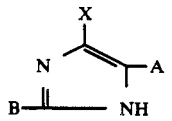

wherein A and B each represent an organic group combined with the imidazole ring through a carbon atom, nitrogen atom, oxygen atom or a sulfur atom thereof, and X represents a hydrogen atom or a group capable of being split off upon reaction with the oxidized product of a color developing agent, and said cyan coupler is of the Formula C-IV;

Formula C-IV

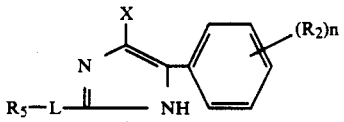

wherein $R_2$ and $R_5$ each represent a substituent; L represents an oxygen or sulfur atom, X is the same as denoted in the formula C-I and n is an integer of from 0 to 5.

29. The material of claim 28, wherein said cyan coupler is represented by the following formula C-IX;

Formula C-IX

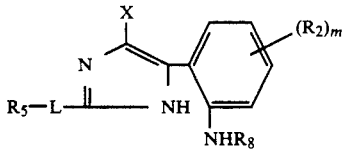

wherein $R_2$, $R_5$ L and X are each the same as denoted in the formula C-IV, and $R_8$ and m are each the same as denoted in the formula 5.

30. A silver halide color photographic light-sensitive material comprising a support having thereon a silver halide emulsion layer, wherein said silver halide emulsion layer contains silver halide grains having a silver chloride content of not less than 90 mol %, a cyan coupler of the Formula C-III;

Formula C-III

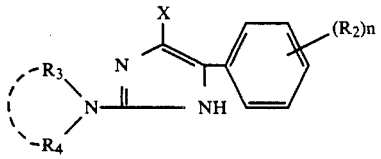

wherein $R_2$, $R_3$ and $R_4$ each represent a substituent; $R_3$ and $R_4$ being optionally combined to form a ring; X is the same as denoted in the formula C-1 and n is an integer of from 0 to 5, and a nitrogen containing heterocyclic mercapto compound.

* * * * *